US010569934B2

(12) United States Patent
Davidson

(10) Patent No.: US 10,569,934 B2
(45) **Date of Patent: *Feb. 25, 2020**

(54) PORTABLE BAG HAVING IMPROVED HANDLING FEATURES AND IMPROVED VOLUMETRIC CHARACTERISTICS AND ASSEMBLY FOR USE THEREWITH

(71) Applicant: United Parcel Service of America, Inc., Atlanta, GA (US)

(72) Inventor: Mark J. Davidson, Alpharetta, GA (US)

(73) Assignee: UNITED PARCEL SERVICE OF AMERICA, INC., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/948,827

(22) Filed: Apr. 9, 2018

(65) Prior Publication Data

US 2018/0222636 A1 Aug. 9, 2018

Related U.S. Application Data

(63) Continuation of application No. 15/333,815, filed on Oct. 25, 2016, now Pat. No. 9,988,189, which is a (Continued)

(51) Int. Cl.
*B65D 33/14* (2006.01)
*B65D 33/08* (2006.01)
(Continued)

(52) U.S. Cl.
CPC ..... *B65D 33/14* (2013.01); *B65D 31/10* (2013.01); *B65D 33/08* (2013.01); *B65D 33/16* (2013.01); *B65D 33/25* (2013.01); *B65D 33/28* (2013.01)

(58) Field of Classification Search
CPC ..... B65D 33/14; B65D 31/10; B65D 33/08; B65D 33/16; B65D 33/25; B65D 33/28
(Continued)

(56) References Cited

U.S. PATENT DOCUMENTS 2,159,279 A 5/1939 Lipowsky et al.
2,519,290 A * 8/1950 Saltz ..... A24F 23/02 24/585.12
(Continued)

FOREIGN PATENT DOCUMENTS

WO 2006/014146 A2 2/2006

OTHER PUBLICATIONS

Final Office Action received for U.S. Appl. No. 15/333,815, dated Nov. 13, 2017, 10 pages.
(Continued)

*Primary Examiner* — Jes F Pascua
(74) *Attorney, Agent, or Firm* — Shook, Hardy & Bacon L.L.P.

(57) ABSTRACT

A portable bag is provided, comprising: a plurality of surfaces configured to define an interior compartment, the surfaces including a front and rear surface connected by a pair of side surfaces; at least two handling extensions, a respective each of said at least two handling extensions being positioned adjacent to and extending outwardly relative to a respective one of said pair of side surfaces, and at least two handling openings, said at least two handling openings being integrally defined on at least one of said at least two handling extensions. An associated assembly is also provided, including the portable bag further comprising a set of eyelets positioned on each of the front and rear surfaces of the plurality of surfaces and the assembly further
(Continued)

comprising a portable bag dispenser comprising at least two portions configured to slidably extend through the set of eyelets.

20 Claims, 26 Drawing Sheets

Related U.S. Application Data continuation of application No. 15/014,396, filed on Feb. 3, 2016, now Pat. No. 9,505,526.

(60) Provisional application No. 62/114,408, filed on Feb. 10, 2015.

(51) Int. Cl.

| | |
|---|---|
| ***B65D 33/16*** | (2006.01) |
| ***B65D 33/25*** | (2006.01) |
| ***B65D 30/20*** | (2006.01) |
| ***B65D 33/28*** | (2006.01) |

(58) Field of Classification Search
USPC ..... 383/9, 10
See application file for complete search history.

(56) References Cited

U.S. PATENT DOCUMENTS

| | | | | |
|---|---|---|---|---|
| 2,586,283 | A | | 2/1952 | Wynn |
| 2,619,801 | A | | 12/1952 | Evans |
| 3,208,492 | A | | 9/1965 | Braithwaite |
| 3,351,064 | A | | 11/1967 | Cohn |
| 3,491,973 | A | | 1/1970 | Hartbauer et al. |
| 3,494,457 | A | | 2/1970 | Titchenal |
| 3,965,953 | A | | 6/1976 | Becker et al. |
| 4,468,933 | A | | 9/1984 | Christopher |
| 4,521,910 | A | | 6/1985 | Keppel et al. |
| 4,524,457 | A | | 6/1985 | Marino |
| 4,597,102 | A | | 6/1986 | Nattrass |
| 4,691,368 | A | | 9/1987 | Roessiger |
| 4,759,639 | A | | 7/1988 | DeMatteis |
| 4,781,472 | A | | 11/1988 | LaFleur et al. |
| 4,874,258 | A | | 10/1989 | Marino |
| 4,949,401 | A | | 8/1990 | Kimsey, Jr. |
| 5,328,268 | A | * | 7/1994 | Lafleur ..... B65D 88/1631 220/652 |
| 5,338,117 | A | | 8/1994 | Kucksdort et al. |
| 5,690,228 | A | | 11/1997 | DeMatteis |
| 6,105,842 | A | | 8/2000 | Cesare |
| 6,783,277 | B2 | | 8/2004 | Edwards et al. |
| 7,125,168 | B2 | | 10/2006 | La Fleur et al. |
| 7,219,944 | B2 | | 5/2007 | Klotz et al. |
| 7,427,160 | B2 | | 9/2008 | Richardson, Jr. et al. |
| 7,581,772 | B2 | | 9/2009 | Johnson et al. |
| 7,828,354 | B2 | | 11/2010 | Kohn et al. |
| 8,342,587 | B2 | | 1/2013 | Johnson et al. |
| 8,562,214 | B2 | | 10/2013 | Dozier et al. |
| 9,505,526 | B2 | | 11/2016 | Davidson |
| 9,988,189 | B2 | * | 6/2018 | Davidson ..... B65D 33/08 |
| 2002/0141663 | A1 | * | 10/2002 | Edwards ..... B65D 31/005 383/10 |
| 2007/0134378 | A1 | | 6/2007 | Burton et al. |
| 2010/0021088 | A1 | | 1/2010 | Wilfong, Jr. |
| 2015/0203288 | A1 | | 7/2015 | Hunter |
| 2016/0194131 | A1 | | 7/2016 | Taylor et al. |

OTHER PUBLICATIONS

Non-Final Office Action received for U.S. Appl. No. 15/333,815, dated Jul. 28, 2017, 19 pages.
Non-Final Office Action received for U.S. Appl. No. 15/333,840, dated Dec. 15, 2017, 10 pages.
Notice of Allowance received for U.S. Appl. No. 15/014,396, dated Sep. 14, 2016, 8 pages.
Notice of Allowance received for U.S. Appl. No. 15/333,815, dated Jan. 24, 2018, 7 pages.
Supplemental Notice of Allowance received for U.S. Appl. No. 15/333,815, dated May 10, 2018, 2 pages.
Non-Final Office Action received for U.S. Appl. No. 15/333,840, dated Aug. 29, 2018, 13 Pages.
Non-Final Office Action received for U.S. Appl. No. 15/872,477, dated Nov. 16, 2018, 11 pages.

* cited by examiner

PORTABLE BAG HAVING IMPROVED HANDLING FEATURES AND IMPROVED VOLUMETRIC CHARACTERISTICS AND ASSEMBLY FOR USE THEREWITH

CROSS-REFERENCE TO RELATED APPLICATIONS

This application is a continuation of and claims priority to and the benefit of U.S. Nonprovisional application Ser. No. 15/333,815, filed Oct. 25, 2016, which is a nonprovisional application claiming priority to and the benefit of U.S. Nonprovisional application Ser. No. 15/014,396, filed Feb. 3, 2016, and issued on Nov. 29, 2016, as U.S. Pat. No. 9,505,526, which is a nonprovisional application further claiming priority to and the benefit of U.S. Provisional Application No. 62/114,408, filed Feb. 10, 2015, the contents of all three are hereby incorporated by reference in their entireties.

BACKGROUND

Technical Field

The present invention is generally related to provision of a portable bag having integrated handling openings and improved volumetric characteristics.

Related Art

Traditionally, portable bags have been used for the transport of small packages by common carriers within a variety of transportation networks. Such portable bags permit consolidation of small packages based upon various considerations, such as a common destination or recipient. At the same time, efficiencies of scale are realized, as the handling for the small packages is significantly reduced. Conventional portable bags have been typically of a "pillow-case" type configuration, whereby two facing surfaces are stitched together relative to one another in a fashion so as to leave a single opening. In this manner, a substantially "V-shaped" pocket is created for insertion therein of one or more small packages. So as to facilitate at least semi-automated handling of such conventional portable bags, no peripheral accessories are typically incorporated therein.

In certain scenarios, the substantially "V-shaped" pocket created with the conventional portable bag configuration results in less than efficient utilization of the space therein. This is especially problematic where different sized and square or rectangular-shaped packages need to be placed within the portable bag for consolidated transport. Not only are oftentimes packages difficult to load within such a space, but the loading thereof can also result in a significant degree of unused or under-utilized space. Still further, upon loading of the small packages within the conventional portable bags, handling thereof is, in certain scenarios, less than optimal.

Thus, a need exists for portable bags having integrated handling openings and improved volumetric characteristics to facilitate more efficient and effective transport of small packages therein.

BRIEF SUMMARY

Therefore, the object of various embodiments of the present invention is to provide portable bags having integrated handling openings and improved volumetric characteristics to facilitate more efficient and effective transport of small packages therein. Associated systems for use with the same are also provided Various embodiments of the present invention achieve the aforementioned and other objects via a portable bag comprising: a plurality of surfaces configured to define an interior compartment for holding articles, the plurality of surfaces being constructed of a foldable material and comprising at least a front surface and a rear surface connected relative to each other by a pair of side surfaces, a bottom surface, and a top surface opposite the bottom surface; at least two handling openings, the at least two handling openings being integrally defined on at least one of the plurality of surfaces, the at least two handling openings being positioned substantially adjacent opposing sides of the at least one of the plurality of surfaces; and an interior liner further defining the interior compartment of the portable bag, the interior liner being positioned intermediate the interior compartment and the plurality of surfaces, at least two portions of the interior liner being inset relative to the plurality of surfaces, so as to define a respective cavities therebetween, the respective cavities being substantially aligned with and inset relative to the at least two handling openings.

According to still further embodiments of the present invention, an assembly for facilitating consolidated transport of a plurality of articles is provided. The assembly comprises at least one portable bag and a portable bag dispenser comprising at least two portions configured to slidably extend through the set of eyelets on each of the front and rear surfaces of the plurality of surfaces. Each portable bag comprises: a plurality of surfaces configured to define an interior compartment for holding articles, the plurality of surfaces being constructed of a foldable material and comprising at least a front surface and a rear surface connected relative to each other by a pair of side surfaces, a bottom surface, and a top surface opposite the bottom surface; at least two handling openings, the at least two handling openings being integrally defined on at least one of the plurality of surfaces, the at least two handling openings being positioned substantially adjacent opposing sides of the at least one of the plurality of surfaces; an interior liner further defining the interior compartment of the portable bag, the interior liner being positioned intermediate the interior compartment and the plurality of surfaces, at least two portions of the interior liner being inset relative to the plurality of surfaces, so as to define a respective cavities therebetween, the respective cavities being substantially aligned with and inset relative to the at least two handling openings; and a set of eyelets positioned on each of the front and rear surfaces of the plurality of surfaces.

According to still further embodiments of the present invention, another portable bag is provided, comprising: a plurality of surfaces configured to define an interior compartment for holding articles, the plurality of surfaces being constructed of a foldable material and comprising at least a front surface and a rear surface connected relative to each other by a pair of side surfaces, a bottom surface, and a top surface opposite the bottom surface; at least two handling extensions, a respective each of the at least two handling extensions being positioned adjacent and substantially perpendicular to and extending outwardly relative to a respective one of the pair of side surfaces; and at least two handling openings, the at least two handling openings being integrally defined on at least one of the at least two handling extensions.

In certain embodiments, the at least two handling extensions comprise four handling extensions; and each of the four handling extensions is positioned along a hemmed edge defined between the front surface, the pair of side surfaces, and the rear surface. In still further embodiments, the at least two handling openings comprise four handling openings; and a single handling opening is located on each of the four handling extensions. In another embodiment, each of the single handling openings is aligned with a horizontal midpoint line of a corresponding one of the four handling extensions.

In certain embodiments, each of the four handling extensions is elongate and extends an entirety of the hemmed edges defined between the front surface, the pair of side surfaces, and the rear surface.

In certain embodiments, the at least two handling openings comprise eight handling openings; and a pair of handling openings is located on each of the four handling extensions. In these and other embodiments, each of the pair of handling openings is offset a distance relative to a horizontal midpoint line of a corresponding one of the four handling extensions, each of the handling openings within each of the pair of handling openings being positioned opposite the horizontal midpoint line relative to the other handling opening within the pair.

In still other embodiments, the portable bag further comprises at least one side crease on each of the side surfaces; the at least two handling extensions comprise two handling extensions; and each of the two handling extensions is positioned and extends substantially along a length of the at least one side crease on each of the side surfaces of the portable bag. In at least one of such embodiments, the two handling extensions extend at least in part beyond the length of the at least one side crease on each of the side surfaces of the portable bag. In another embodiment, each of the two handling extensions is elongate and extends an entirety of a height of the portable bag, extending substantially between an edge of the side surfaces adjacent the top surface and an edge of the side surfaces adjacent the bottom surface. In yet another embodiment, the at least two handling openings comprise two handling openings; and a single handling opening is located on each of the at least two handling extensions. In at least one of these embodiments, each of the single handling openings is aligned with a horizontal midpoint line of a corresponding one of the two handling extensions.

In certain other embodiments, the at least two handling openings comprise four handling openings; and a pair of handling openings is located on each of the two handling extensions. In other embodiments, each of the pair of handling openings is offset a distance relative to a horizontal midpoint line of a corresponding one of the two handling extensions, each of the handling openings within each of the pair of handling openings being positioned opposite the horizontal midpoint line relative to the other handling opening within the pair.

In still further embodiments, the bag further comprises an interior liner further defining the interior compartment of the portable bag, the interior liner being positioned intermediate the interior compartment and the plurality of surfaces.

In another embodiment, the top surface further comprises a closure mechanism, the closure mechanism being operable to selectively open and close at least a portion of the top surface; and the closure mechanism is at least one of a zipper, a magnetic strip assembly, a spring-loaded assembly, or a draw-string assembly. In certain of these and other embodiments, the top surface comprises a first top portion and a second top portion; and the closure mechanism is positioned intermediate the first and second top portions, the closure mechanism being further operable to selectively separate the first and second top portions relative to one another, so as to define an opening therebetween, the opening being configured for receipt of the articles to be held in the portable bag. In at least one embodiment, the closure mechanism is configured such that the first and second top portions are biased toward each other such that the portable bag is, in its natural orientation, in a closed configuration.

In certain other embodiments, the portable bag further comprises a plurality of side creases and a single bottom crease; the plurality of side creases comprise at least three side creases defined on each of the pair of side surfaces, the at least three side creases each being oriented differently relative to one another; and the single bottom crease is defined on the bottom surface of the portable bag.

In another embodiment, the portable bag further comprises a plurality of side creases and a single front crease; the plurality of side creases comprise at least three side creases defined on each of the pair of side surfaces, the at least three side creases each being oriented differently relative to one another; and the single front crease is defined on a lower portion of the front surface of the portable bag, the lower portion being nearer the bottom surface of the portable bag than the top surface In yet another embodiment, the portable bag further comprises at least one set of eyelets configured to accept therethrough at least a portion of an assembly configured to hold or support a plurality of the portable bags; and the at least one set of eyelets is positioned nearer the top surface than the bottom surface of the portable bag, so as to enable a hanging configuration of the portable bag relative to the assembly.

According to still further embodiments of the present invention, an assembly for facilitating consolidated transport of a plurality of articles is provided. The assembly comprises a portable bag and a portable bag dispenser comprising at least two portions configured to slidably extend through the set of eyelets on each of the front and rear surfaces of the plurality of surfaces. The portable bag in at least these embodiments comprises: a plurality of surfaces configured to define an interior compartment for holding articles, the plurality of surfaces being constructed of a foldable material and comprising at least a front surface and a rear surface connected relative to each other by a pair of side surfaces, a bottom surface, and a top surface opposite the bottom surface; at least two handling extensions, a respective each of the at least two handling extensions being positioned adjacent and substantially perpendicular to and extending outwardly relative to a respective one of the pair of side surfaces; at least two handling openings, the at least two handling openings being integrally defined on at least one of the at least two handling extensions; and a set of eyelets positioned on each of the front and rear surfaces of the plurality of surfaces.

The assembly in certain embodiments further comprises a closure mechanism associated with the top surface of the portable bag, the closure mechanism being configured to selectively open and close at least a portion of the top surface so as to selective create an opening therein for receipt of the articles for holding in the portable bag, the closure mechanism being operatively biased such that the top surface of the portable bag is naturally in a closed configuration.

In other embodiments of the assembly, the at least two portions of the portable bag dispenser include two elongate prongs, the elongate prongs being configured to slidably extend through the set of eyelets of the portable bag; and the portable bag is selectively movable between a folded configuration and an unfolded configuration.

In still other embodiments of the assembly, in the unfolded configuration, the portable bag may be further positioned in an open configuration, counter the naturally-closed bias, so as to facilitate loading of a plurality of articles within the portable bag; and upon removal of the portable bag from the two elongate prongs, the closure mechanism is configured to return automatically to the naturally-closed bias orientation.

In still other embodiments, a portable bag is provided comprising: a plurality of surfaces configured to define an interior compartment for holding articles, the plurality of surfaces being constructed of a foldable material and comprising at least a front surface and a rear surface connected relative to each other by a pair of side surfaces, a bottom surface, and a top surface opposite the bottom surface; at least one elongate flap covering overlaying at least a portion of at least one of the pair of side surfaces, the at least one flap covering comprising at least one elongate flap opening formed therein; and at least one handle, the at least one handle being located on at least one of the pair of side surfaces and within the at least one elongate flap covering, the at least one handle being accessible only via the at least one elongate flap opening formed in the at least one flap covering.

In these and still other embodiments, the at least one handle may comprise two handles located on at least one of the pair of side surfaces. In certain embodiments, the at least one elongate flap covering comprises two elongate flap coverings, each of the two elongate flap coverings overlaying at least a portion of a respective one of the pair of side surfaces, each of the two flap coverings comprising at least one elongate flap opening formed therein, and the at least one handle comprises at least two handles, one of the at least two handles being located on each of the pair of side surfaces and within the at least one elongate flap covering, the at least two handles being accessible only via the at least one elongate flap opening formed in the at least one flap covering. In certain embodiments, the at least two handles comprise four handles, two of the four handles being located on each of the pair of side surfaces and within the at least one elongate flap covering.

Still further, in certain embodiments, the portable bag further comprises at least one side crease on each of the side surfaces, and each of the two elongate flap coverings overlays at least a portion of the at least one side crease. In these and still other embodiments the portable bag further comprises an interior liner further defining the interior compartment of the portable bag, the interior liner being positioned intermediate the interior compartment and the plurality of surfaces. In at least one embodiment, the top surface further comprises a closure mechanism, the closure mechanism being operable to selectively open and close at least a portion of the top surface, and the closure mechanism is at least one of a zipper, a magnetic strip assembly, a spring-loaded assembly, or a draw-string assembly. In certain variations of at least this embodiment, the top surface may also comprise a first top portion and a second top portion, and the closure mechanism may be positioned intermediate the first and second top portions, the closure mechanism being further operable to selectively separate the first and second top portions relative to one another, so as to define an opening therebetween, the opening being configured for receipt of the articles to be held in the portable bag. According to various embodiments, the closure mechanism is configured such that the first and second top portions are biased toward each other such that the portable bag is, in its natural orientation, in a closed configuration.

In these and still other embodiments, the portable bag further comprises one or more creases on at least two of the plurality of surfaces, and the one or more creases are configured to facilitate an inwardly folding configuration of the portable bag. In other embodiments, the one or more creases comprise a plurality of side creases and a single bottom crease; the plurality of side creases comprise at least three side creases defined on each of the pair of side surfaces, the at least three side creases each being oriented differently relative to one another; and the single bottom crease is defined on the bottom surface of the portable bag. In at least one embodiment, the one or more creases comprise a plurality of side creases and a single front crease; the plurality of side creases comprise at least three side creases defined on each of the pair of side surfaces, the at least three side creases each being oriented differently relative to one another; and the single front crease is defined on a lower portion of the front surface of the portable bag, the lower portion being nearer the bottom surface of the portable bag than the top surface. In still another embodiment, the portable bag further comprises at least one set of eyelets configured to accept therethrough at least a portion of an assembly configured to hold or support a plurality of the portable bags; and the at least one set of eyelets is positioned nearer the top surface than the bottom surface of the portable bag, so as to enable a hanging configuration of the portable bag relative to the assembly.

According to other various embodiments, a portable bag is provided comprising: a plurality of surfaces configured to define an interior compartment for holding articles, the plurality of surfaces being constructed of a foldable material and comprising at least a front surface and a rear surface connected relative to each other by a pair of side surfaces, a bottom surface, and a top surface opposite the bottom surface; and a closure mechanism associated with the top surface of the portable bag, the closure mechanism being configured to selectively open and close at least a portion of the top surface so as to selective create an opening therein for receipt of the articles for holding in the portable bag, the closure mechanism being operatively biased such that the top surface of the portable bag is naturally in a closed configuration.

In certain of these and still other embodiments, the portable bag further comprises: at least two handling openings, the at least two handling openings being integrally defined on at least one of the plurality of surfaces, the at least two handling openings being positioned substantially adjacent opposing sides of the at least one of the plurality of surfaces; and an interior liner further defining the interior compartment of the portable bag, the interior liner being positioned intermediate the interior compartment and the plurality of surfaces, at least two portions of the interior liner being inset relative to the plurality of surfaces, so as to define a respective cavities therebetween, the respective cavities being substantially aligned with and inset relative to the at least two handling openings. In certain embodiments, the closure mechanism is at least one of a zipper, a magnetic strip assembly, a spring-loaded assembly, or a draw-string assembly.

According to still other embodiments, the top surface comprises a first top portion and a second top portion; and the closure mechanism is positioned intermediate the first and second top portions, the closure mechanism being further operable to selectively separate the first and second top portions relative to one another, so as to define an opening therebetween, the opening being configured for receipt of the articles to be held in the portable bag. In certain embodiments, the portable bag further comprises one or more creases on at least two of the plurality of surfaces; and the one or more creases are configured to facilitate an inwardly folding configuration of the portable bag.

In at least one embodiment, the one or more creases comprise a plurality of side creases and a single bottom crease; the plurality of side creases comprise at least three side creases defined on each of the pair of side surfaces, the at least three side creases each being oriented differently relative to one another; and the single bottom crease is defined on the bottom surface of the portable bag. According to certain other embodiments, the one or more creases comprise a plurality of side creases and a single front crease; the plurality of side creases comprise at least three side creases defined on each of the pair of side surfaces, the at least three side creases each being oriented differently relative to one another; and the single front crease is defined on a lower portion of the front surface of the portable bag, the lower portion being nearer the bottom surface of the portable bag than the top surface.

According to various embodiments, the portable bag further comprises at least one set of eyelets configured to accept therethrough at least a portion of an assembly configured to hold or support a plurality of the portable bags; and the at least one set of eyelets is positioned nearer the top surface than the bottom surface of the portable bag, so as to enable a hanging configuration of the portable bag relative to the assembly. In at least one of these embodiments, the at least one set of eyelets comprises two sets of eyelets; a first set of the two sets of eyelets is located on the front surface of the portable bag; and a second set of the two sets of eyelets is located on the rear surface of the portable bag.

According to various embodiments, at least one of the plurality of surfaces further includes at least one of a shipping label or a machine-readable barcode symbol. In these and still other embodiments, the portable bag may further comprise: at least two handling extensions, a respective each of the at least two handling extensions being positioned adjacent and substantially perpendicular to and extending outwardly relative to a respective one of the pair of side surfaces; and at least two handling openings, the at least two handling openings being integrally defined on at least one of the at least two handling extensions. In certain embodiments, the at least two handling extensions comprise four handling extensions; and each of the four handling extensions is positioned along a hemmed edge defined between the front surface, the pair of side surfaces, and the rear surface. In at least one embodiment, each of the four handling extensions is elongate and extends an entirety of the hemmed edges defined between the front surface, the pair of side surfaces, and the rear surface. In certain embodiments, the portable bag further comprises at least one side crease on each of the side surfaces; the at least two handling extensions comprise two handling extensions; and each of the two handling extensions is positioned and extends substantially along a length of the at least one side crease on each of the side surfaces of the portable bag. In yet another embodiment, the two handling extensions extend at least in part beyond the length of the at least one side crease on each of the side surfaces of the portable bag.

According to various embodiments, the portable bag may further comprise at least one elongate flap covering overlaying at least a portion of at least one of the pair of side surfaces, the at least one flap covering comprising at least one elongate flap opening formed therein; and at least one handle, the at least one handle being located on at least one of the pair of side surfaces and within the at least one elongate flap covering, the at least one handle being accessible only via the at least one elongate flap opening formed in the at least one flap covering. In certain of these and other embodiments, the at least one elongate flap covering comprises two elongate flap coverings, each of the two elongate flap coverings overlaying at least a portion of a respective one of the pair of side surfaces, each of the two flap coverings comprising at least one elongate flap opening formed therein; and the at least one handle comprises at least two handles, one of the at least two handles being located on each of the pair of side surfaces and within the at least one elongate flap covering, the at least two handles being accessible only via the at least one elongate flap opening formed in the at least one flap covering.

In still other embodiments, the portable bag further comprises at least one side crease on each of the side surfaces; and each of the two elongate flap coverings overlays at least a portion of the at least one side crease. In any of these and still other embodiments, the bag further comprises an interior liner further defining the interior compartment of the portable bag, the interior liner being positioned intermediate the interior compartment and the plurality of surfaces.

According to still additional various embodiments, an assembly is provided for facilitating consolidated transport of a plurality of articles. The assembly in at least these embodiments may comprise a portable bag and a portable bag dispenser comprising at least two portions configured to slidably extend through the set of eyelets on each of the front and rear surfaces of the plurality of surfaces. The portable bag may comprise: a plurality of surfaces configured to define an interior compartment for holding articles, the plurality of surfaces being constructed of a foldable material and comprising at least a front surface and a rear surface connected relative to each other by a pair of side surfaces, a bottom surface, and a top surface opposite the bottom surface; a closure mechanism associated with the top surface of the portable bag, the closure mechanism being configured to selectively open and close at least a portion of the top surface so as to selective create an opening therein for receipt of the articles for holding in the portable bag, the closure mechanism being operatively biased such that the top surface of the portable bag is naturally in a closed configuration; and a set of eyelets positioned on each of the front and rear surfaces of the plurality of surfaces.

In these and still other embodiments of the assembly, the at least two portions of the portable bag dispenser include two elongate prongs, the elongate prongs being configured to slidably extend through the set of eyelets of the portable bag; and the portable bag is selectively movable between a folded configuration and an unfolded configuration. In certain embodiments, in the unfolded configuration, the portable bag may be further positioned in an open configuration, counter the naturally-closed bias, so as to facilitate loading of a plurality of articles within the portable bag; and upon removal of the portable bag from the two elongate prongs, the closure mechanism is configured to return automatically to the naturally-closed bias orientation.

According to various embodiments associated with this assembly, the portable bag further comprises: at least two handling openings, the at least two handling openings being integrally defined on at least one of the plurality of surfaces, the at least two handling openings being positioned substantially adjacent opposing sides of the at least one of the plurality of surfaces; and an interior liner further defining the interior compartment of the portable bag, the interior liner being positioned intermediate the interior compartment and the plurality of surfaces, at least two portions of the interior liner being inset relative to the plurality of surfaces, so as to define a respective cavities therebetween, the respective cavities being substantially aligned with and inset relative to the at least two handling openings. In certain embodiments, the closure mechanism is at least one of a zipper, a magnetic strip assembly, a spring-loaded assembly, or a draw-string assembly. In these and other embodiments, the top surface comprises a first top portion and a second top portion; and the closure mechanism is positioned intermediate the first and second top portions, the closure mechanism being further operable to selectively separate the first and second top portions relative to one another, so as to define an opening therebetween, the opening being configured for receipt of the articles to be held in the portable bag.

According to various embodiments associated with this assembly, the portable bag further comprises: one or more creases on at least two of the plurality of surfaces; and the one or more creases are configured to facilitate an inwardly folding configuration of the portable bag. In certain embodiments, the one or more creases comprise a plurality of side creases and a single bottom crease; the plurality of side creases comprise at least three side creases defined on each of the pair of side surfaces, the at least three side creases each being oriented differently relative to one another; and the single bottom crease is defined on the bottom surface of the portable bag. In still other embodiments, the one or more creases comprise a plurality of side creases and a single front crease; the plurality of side creases comprise at least three side creases defined on each of the pair of side surfaces, the at least three side creases each being oriented differently relative to one another; and the single front crease is defined on a lower portion of the front surface of the portable bag, the lower portion being nearer the bottom surface of the portable bag than the top surface.

According to various embodiments associated with this assembly, at least one of the plurality of surfaces further includes at least one of a shipping label or a machine-readable barcode symbol. In certain of these and still other embodiments, the portable bag further comprises: at least two handling extensions, a respective each of the at least two handling extensions being positioned adjacent and substantially perpendicular to and extending outwardly relative to a respective one of the pair of side surfaces; and at least two handling openings, the at least two handling openings being integrally defined on at least one of the at least two handling extensions. In at least one embodiment, the at least two handling extensions comprise four handling extensions; and each of the four handling extensions is positioned along a hemmed edge defined between the front surface, the pair of side surfaces, and the rear surface. In another embodiment, on the portable bag each of the four handling extensions is elongate and extends an entirety of the hemmed edges defined between the front surface, the pair of side surfaces, and the rear surface.

According to various embodiments associated with this assembly, the portable bag further comprises at least one side crease on each of the side surfaces; the at least two handling extensions comprise two handling extensions; and each of the two handling extensions is positioned and extends substantially along a length of the at least one side crease on each of the side surfaces of the portable bag. In certain of these and other embodiments, the two handling extensions extend at least in part beyond the length of the at least one side crease on each of the side surfaces of the portable bag. In still other embodiments, the portable bag further comprises: at least one elongate flap covering overlaying at least a portion of at least one of the pair of side surfaces, the at least one flap covering comprising at least one elongate flap opening formed therein; and at least one handle, the at least one handle being located on at least one of the pair of side surfaces and within the at least one elongate flap covering, the at least one handle being accessible only via the at least one elongate flap opening formed in the at least one flap covering.

In various embodiments of the assembly also the at least one elongate flap covering comprises two elongate flap coverings, each of the two elongate flap coverings overlaying at least a portion of a respective one of the pair of side surfaces, each of the two flap coverings comprising at least one elongate flap opening formed therein; and the at least one handle comprises at least two handles, one of the at least two handles being located on each of the pair of side surfaces and within the at least one elongate flap covering, the at least two handles being accessible only via the at least one elongate flap opening formed in the at least one flap covering. In various of these and still other embodiments, the portable bag further comprises at least one side crease on each of the side surfaces; and each of the two elongate flap coverings overlays at least a portion of the at least one side crease. In yet other embodiments, the portable bag further comprises an interior liner further defining the interior compartment of the portable bag, the interior liner being positioned intermediate the interior compartment and the plurality of surfaces.

According to still further embodiments, there is provided a portable bag comprising: a plurality of surfaces configured to define an interior compartment for holding articles, the plurality of surfaces comprising at least a front surface and a rear surface connected relative to each other by a pair of side surfaces; at least one elongate flap covering overlaying at least a portion of at least one of the pair of side surfaces, the at least one flap covering comprising at least one elongate flap opening formed therein; and at least one handle, the at least one handle being located on at least one of the pair of side surfaces and within the at least one elongate flap covering, the at least one handle being accessible only via the at least one elongate flap opening formed in the at least one flap covering.

In these and other embodiments, the at least one handle comprises two handles located on at least one of the pair of side surfaces. In certain embodiments, the at least one elongate flap covering comprises two elongate flap coverings, each of the two elongate flap coverings overlaying at least a portion of a respective one of the pair of side surfaces, each of the two flap coverings comprising at least one elongate flap opening formed therein; and the at least one handle comprises at least two handles, one of the at least two handles being located on each of the pair of side surfaces and within the at least one elongate flap covering, the at least two handles being accessible only via the at least one elongate flap opening formed in the at least one flap covering. In other embodiments, the at least two handles comprises four handles, two of the four handles being located on each of the pair of side surfaces and within the at least one elongate flap covering. In still other embodiments, the portable bag further comprises at least one side crease on each of the side surfaces; and each of the two elongate flap coverings overlays at least a portion of the at least one side crease. In at least one embodiment, the bag further comprises an interior liner further defining the interior compartment of the portable bag, the interior liner being positioned intermediate the interior compartment and the plurality of surfaces.

In certain further embodiments, the plurality of surfaces further comprise a bottom surface and a top surface opposite the bottom surface; the top surface further comprises a closure mechanism, the closure mechanism being operable to selectively open and close at least a portion of the top surface; and the closure mechanism is at least one of a zipper, a magnetic strip assembly, a spring-loaded assembly, or a draw-string assembly. In these and other embodiments, the plurality of surfaces further comprise a bottom surface and a top surface opposite the bottom surface; the top surface comprises a first top portion and a second top portion; and the closure mechanism is positioned intermediate the first and second top portions, the closure mechanism being further operable to selectively separate the first and second top portions relative to one another, so as to define an opening therebetween, the opening being configured for receipt of the articles to be held in the portable bag. In at least this embodiment, the closure mechanism is configured such that the first and second top portions are biased toward each other such that the portable bag is, in its natural orientation, in a closed configuration.

In yet other embodiments, the plurality of surfaces are constructed of a foldable material; the plurality of surfaces further comprise a bottom surface and a top surface opposite the bottom surface; the portable bag further comprises one or more creases on at least two of the plurality of surfaces; and the one or more creases are configured to facilitate an inwardly folding configuration of the portable bag. In these and other embodiments, the one or more creases comprise a plurality of side creases and a single bottom crease; the plurality of side creases comprise at least three side creases defined on each of the pair of side surfaces, the at least three side creases each being oriented differently relative to one another; and the single bottom crease is defined on the bottom surface of the portable bag. In still other embodiments, the one or more creases comprise a plurality of side creases and a single front crease; the plurality of side creases comprise at least three side creases defined on each of the pair of side surfaces, the at least three side creases each being oriented differently relative to one another; and the single front crease is defined on a lower portion of the front surface of the portable bag, the lower portion being nearer the bottom surface of the portable bag than the top surface.

In certain embodiments, the portable bag further comprises at least one set of eyelets configured to accept there through at least a portion of an assembly configured to hold or support a plurality of the portable bags; and the at least one set of eyelets is positioned nearer the top surface than the bottom surface of the portable bag, so as to enable a hanging configuration of the portable bag relative to the assembly. In these and still other embodiments, the plurality of surfaces further comprise a bottom surface and a top surface opposite the bottom surface; and the at least one elongate flap extends an entirety of a height of the portable bag, extending substantially between an edge of the side surfaces adjacent the top surface and an edge of the side surfaces adjacent the bottom surface.

Also provided according to various embodiments is an assembly for facilitating consolidated transport of a plurality of articles, the assembly comprising: a portable bag comprising: a plurality of surfaces configured to define an interior compartment for holding articles, the plurality of surfaces comprising at least a front surface and a rear surface connected relative to each other by a pair of side surfaces; at least one elongate flap covering overlaying at least a portion of at least one of the pair of side surfaces, the at least one flap covering comprising at least one elongate flap opening formed therein; at least one handle, the at least one handle being located on at least one of the pair of side surfaces and within the at least one elongate flap covering, the at least one handle being accessible only via the at least one elongate flap opening formed in the at least one flap covering; and a set of eyelets positioned on each of the front and rear surfaces of the plurality of surfaces; and a portable bag dispenser comprising at least two portions configured to slidably extend through the set of eyelets on each of the front and rear surfaces of the plurality of surfaces. In certain of these embodiments, the portable bag further comprises a closure mechanism associated with a top surface of the portable bag, the closure mechanism being configured to selectively open and close at least a portion of the top surface so as to selective create an opening therein for receipt of the articles for holding in the portable bag, the closure mechanism being operatively biased such that the top surface of the portable bag is naturally in a closed configuration. In at least one embodiment, the at least two portions of the portable bag dispenser include two elongate prongs, the elongate prongs being configured to slidably extend through the set of eyelets of the portable bag; and the portable bag is selectively movable between a folded configuration and an unfolded configuration. In another embodiment, in the unfolded configuration, the portable bag may be further positioned in an open configuration, counter the naturally-closed bias, so as to facilitate loading of a plurality of articles within the portable bag; and upon removal of the portable bag from the two elongate prongs, the closure mechanism is configured to return automatically to the naturally-closed bias orientation.

In certain of these and other embodiments, the at least one elongate flap covering of the portable bag comprises two elongate flap coverings, each of the two elongate flap coverings overlaying at least a portion of a respective one of the pair of side surfaces, each of the two flap coverings comprising at least one elongate flap opening formed therein; and the at least one handle of the portable bag comprises at least two handles, one of the at least two handles being located on each of the pair of side surfaces and within the at least one elongate flap covering, the at least two handles being accessible only via the at least one elongate flap opening formed in the at least one flap covering. In at least one embodiment, the portable bag further comprises at least one side crease on each of the side surfaces; and each of the two elongate flap coverings overlays at least a portion of the at least one side crease.

According to still further various embodiments, there is provided a portable bag comprising: a plurality of surfaces configured to define an interior compartment for holding articles, the plurality of surfaces comprising at least a bottom surface and a top surface opposite the bottom surface; and a closure mechanism associated with the top surface of the portable bag, the closure mechanism being configured to selectively open and close at least a portion of the top surface so as to selective create an opening therein for receipt of the articles for holding in the portable bag, the closure mechanism being operatively biased such that the top surface of the portable bag is naturally in a closed configuration. In certain embodiments, the portable bag further comprises: at least two handling openings, the at least two handling openings being integrally defined on at least one of the plurality of surfaces, the at least two handling openings being positioned substantially adjacent opposing sides of the at least one of the plurality of surfaces;

and an interior liner further defining the interior compartment of the portable bag, the interior liner being positioned intermediate the interior compartment and the plurality of surfaces, at least two portions of the interior liner being inset relative to the plurality of surfaces, so as to define a respective cavities therebetween, the respective cavities being substantially aligned with and inset relative to the at least two handling openings. In at least one embodiment, the closure mechanism is at least one of a zipper, a magnetic strip assembly, a spring-loaded assembly, or a draw-string assembly.

In certain embodiments, the top surface comprises a first top portion and a second top portion; and the closure mechanism is positioned intermediate the first and second top portions, the closure mechanism being further operable to selectively separate the first and second top portions relative to one another, so as to define an opening therebetween, the opening being configured for receipt of the articles to be held in the portable bag. In still other embodiments, the portable bag further comprises one or more creases on at least two of the plurality of surfaces; and the one or more creases are configured to facilitate an inwardly folding configuration of the portable bag. In at least one embodiment, the plurality of surfaces are constructed of a foldable material and further comprise a front surface and a rear surface connected relative to each other by a pair of side surfaces; the one or more creases comprise a plurality of side creases and a single bottom crease; the plurality of side creases comprise at least three side creases defined on each of the pair of side surfaces, the at least three side creases each being oriented differently relative to one another; and the single bottom crease is defined on the bottom surface of the portable bag. In yet another embodiment, the plurality of surfaces are constructed of a foldable material and further comprise a front surface and a rear surface connected relative to each other by a pair of side surfaces; the one or more creases comprise a plurality of side creases and a single front crease; the plurality of side creases comprise at least three side creases defined on each of the pair of side surfaces, the at least three side creases each being oriented differently relative to one another; and the single front crease is defined on a lower portion of the front surface of the portable bag, the lower portion being nearer the bottom surface of the portable bag than the top surface.

According to yet other embodiments, the portable bag further comprises at least one set of eyelets configured to accept there through at least a portion of an assembly configured to hold or support a plurality of the portable bags; and the at least one set of eyelets is positioned nearer the top surface than the bottom surface of the portable bag, so as to enable a hanging configuration of the portable bag relative to the assembly. In at least one of these embodiments, the plurality of surfaces further comprise a front surface and a rear surface connected relative to each other by a pair of side surfaces; the at least one set of eyelets comprises two sets of eyelets; a first set of the two sets of eyelets is located on the front surface of the portable bag; and a second set of the two sets of eyelets is located on the rear surface of the portable bag.

In certain embodiments, at least one of the plurality of surfaces further includes at least one of a shipping label or a machine-readable barcode symbol. In these and still other embodiments, the plurality of surfaces further comprise a front surface and a rear surface connected relative to each other by a pair of side surfaces; at least two handling extensions, a respective each of the at least two handling extensions being positioned adjacent and substantially perpendicular to and extending outwardly relative to a respective one of the pair of side surfaces; and at least two handling openings, the at least two handling openings being integrally defined on at least one of the at least two handling extensions. In at least one embodiment, the at least two handling extensions comprise four handling extensions; and each of the four handling extensions is positioned along a hemmed edge defined between the front surface, the pair of side surfaces, and the rear surface. In another embodiment, each of the four handling extensions is elongate and extends an entirety of the hemmed edges defined between the front surface, the pair of side surfaces, and the rear surface.

According to yet other embodiments, the plurality of surfaces are constructed of a foldable material and further comprise a front surface and a rear surface connected relative to each other by a pair of side surfaces; the portable bag further comprises at least one side crease on each of the side surfaces; the at least two handling extensions comprise two handling extensions; and each of the two handling extensions is positioned and extends substantially along a length of the at least one side crease on each of the pair of side surfaces of the portable bag. In one such embodiment, the two handling extensions extend at least in part beyond the length of the at least one side crease on each of the side surfaces of the portable bag.

In yet another embodiment, the plurality of surfaces further comprise a front surface and a rear surface connected relative to each other by a pair of side surfaces; at least one elongate flap covering overlaying at least a portion of at least one of the pair of side surfaces, the at least one flap covering comprising at least one elongate flap opening formed therein; and at least one handle, the at least one handle being located on at least one of the pair of side surfaces and within the at least one elongate flap covering, the at least one handle being accessible only via the at least one elongate flap opening formed in the at least one flap covering. In this and other embodiments, the at least one elongate flap covering comprises two elongate flap coverings, each of the two elongate flap coverings overlaying at least a portion of a respective one of the pair of side surfaces, each of the two flap coverings comprising at least one elongate flap opening formed therein; and the at least one handle comprises at least two handles, one of the at least two handles being located on each of the pair of side surfaces and within the at least one elongate flap covering, the at least two handles being accessible only via the at least one elongate flap opening formed in the at least one flap covering. In another such embodiment, the portable bag further comprises at least one side crease on each of the side surfaces; and each of the two elongate flap coverings overlays at least a portion of the at least one side crease. In yet another embodiment, the bag further comprises an interior liner further defining the interior compartment of the portable bag, the interior liner being positioned intermediate the interior compartment and the plurality of surfaces.

Also provided according to various embodiments is an assembly for facilitating consolidated transport of a plurality of articles, the assembly comprising: a portable bag comprising: a plurality of surfaces configured to define an interior compartment for holding articles, the plurality of surfaces comprising at least a front surface and a rear surface connected relative to each other by a pair of side surfaces, a bottom surface, and a top surface opposite the bottom surface; a closure mechanism associated with the top surface of the portable bag, the closure mechanism being configured to selectively open and close at least a portion of the top surface so as to selective create an opening therein for receipt of the articles for holding in the portable bag, the closure mechanism being operatively biased such that the top surface of the portable bag is naturally in a closed configuration; and a set of eyelets positioned on each of the front and rear surfaces of the plurality of surfaces; and a portable bag dispenser comprising at least two portions configured to slidably extend through the set of eyelets on each of the front and rear surfaces of the plurality of surfaces.

In certain embodiments of this assembly, the at least two portions of the portable bag dispenser include two elongate prongs, the elongate prongs being configured to slidably extend through the set of eyelets of the portable bag; and the portable bag is selectively movable between a folded configuration and an unfolded configuration. In other embodiments, in the unfolded configuration, the portable bag may be further positioned in an open configuration, counter the naturally-closed bias, so as to facilitate loading of a plurality of articles within the portable bag; and upon removal of the portable bag from the two elongate prongs, the closure mechanism is configured to return automatically to the naturally-closed bias orientation.

According to yet still further various embodiments, there is provided yet another assembly for facilitating consolidated transport of a plurality of articles, the assembly comprising: a portable bag comprising: a plurality of surfaces configured to define an interior compartment for holding articles, the plurality of surfaces comprising at least a front surface and a rear surface connected relative to each other by a pair of side surfaces; and a set of eyelets positioned on each of the front and rear surfaces of the plurality of surfaces; and a portable bag dispenser comprising at least two portions configured to slidably extend through the set of eyelets on each of the front and rear surfaces of the plurality of surfaces. In certain embodiments of this assembly, the at least two portions of the portable bag dispenser include two elongate prongs, the elongate prongs being configured to slidably extend through the set of eyelets of the portable bag; and the portable bag is selectively movable between a folded configuration and an unfolded configuration.

In other embodiments, the plurality of surfaces further comprise a bottom surface and a top surface opposite the bottom surface; and the portable bag further comprises a closure mechanism associated with a top surface of the portable bag, the closure mechanism being configured to selectively open and close at least a portion of the top surface so as to selective create an opening therein for receipt of the articles for holding in the portable bag, the closure mechanism being operatively biased such that the top surface of the portable bag is naturally in a closed configuration. In at least one embodiment, the at least two portions of the portable bag dispenser include two elongate prongs, the elongate prongs being configured to slidably extend through the set of eyelets of the portable bag; and the portable bag is selectively movable between a folded configuration and an unfolded configuration. In another embodiment, in the unfolded configuration, the portable bag may be further positioned in an open configuration, counter the naturally-closed bias, so as to facilitate loading of a plurality of articles within the portable bag; and upon removal of the portable bag from the two elongate prongs, the closure mechanism is configured to return automatically to the naturally-closed bias orientation.

According to various embodiments of at least this assembly, the closure mechanism is at least one of a zipper, a magnetic strip assembly, a spring-loaded assembly, or a draw-string assembly. In other embodiments, on the portable bag: the top surface comprises a first top portion and a second top portion; and the closure mechanism is positioned intermediate the first and second top portions, the closure mechanism being further operable to selectively separate the first and second top portions relative to one another, so as to define an opening therebetween, the opening being configured for receipt of the articles to be held in the portable bag.

According to various embodiments of at least this assembly the portable bag further comprises: at least two handling openings, the at least two handling openings being integrally defined on at least one of the plurality of surfaces, the at least two handling openings being positioned substantially adjacent opposing sides of the at least one of the plurality of surfaces; and an interior liner further defining the interior compartment of the portable bag, the interior liner being positioned intermediate the interior compartment and the plurality of surfaces, at least two portions of the interior liner being inset relative to the plurality of surfaces, so as to define a respective cavities therebetween, the respective cavities being substantially aligned with and inset relative to the at least two handling openings. In at least one embodiment, the portable bag further comprises: one or more creases on at least two of the plurality of surfaces; and the one or more creases are configured to facilitate an inwardly folding configuration of the portable bag. In another embodiment, the plurality of surfaces are constructed from a foldable material and further comprise a bottom surface and a top surface opposite the bottom surface; the one or more creases comprise a plurality of side creases and a single bottom crease; the plurality of side creases comprise at least three side creases defined on each of the pair of side surfaces, the at least three side creases each being oriented differently relative to one another; and the single bottom crease is defined on the bottom surface of the portable bag. In yet another embodiment, the plurality of surfaces are constructed from a foldable material and further comprise a bottom surface and a top surface opposite the bottom surface; the one or more creases comprise a plurality of side creases and a single front crease; the plurality of side creases comprise at least three side creases defined on each of the pair of side surfaces, the at least three side creases each being oriented differently relative to one another; and the single front crease is defined on a lower portion of the front surface of the portable bag, the lower portion being nearer the bottom surface of the portable bag than the top surface.

According to still further embodiments of at least this assembly, the portable bag further comprises: at least two handling extensions, a respective each of the at least two handling extensions being positioned adjacent and substantially perpendicular to and extending outwardly relative to a respective one of the pair of side surfaces; and at least two handling openings, the at least two handling openings being integrally defined on at least one of the at least two handling extensions. In at least one such embodiment, on the portable bag: the at least two handling extensions comprise four handling extensions; and each of the four handling extensions is positioned along a hemmed edge defined between the front surface, the pair of side surfaces, and the rear surface. In another embodiment, on the portable bag, each of the four handling extensions is elongate and extends an entirety of the hemmed edges defined between the front surface, the pair of side surfaces, and the rear surface.

In yet other embodiments of at least this assembly, the portable bag further comprises at least one side crease on each of the side surfaces; the at least two handling extensions comprise two handling extensions; and each of the two handling extensions is positioned and extends substantially along a length of the at least one side crease on each of the side surfaces of the portable bag. In at least one embodiment, the two handling extensions extend at least in part beyond the length of the at least one side crease on each of the side surfaces of the portable bag. In other embodiments, the portable bag further comprises: at least one elongate flap covering overlaying at least a portion of at least one of the pair of side surfaces, the at least one flap covering comprising at least one elongate flap opening formed therein; and at least one handle, the at least one handle being located on at least one of the pair of side surfaces and within the at least one elongate flap covering, the at least one handle being accessible only via the at least one elongate flap opening formed in the at least one flap covering. In one such embodiment, the at least one elongate flap covering comprises two elongate flap coverings, each of the two elongate flap coverings overlaying at least a portion of a respective one of the pair of side surfaces, each of the two flap coverings comprising at least one elongate flap opening formed therein; and the at least one handle comprises at least two handles, one of the at least two handles being located on each of the pair of side surfaces and within the at least one elongate flap covering, the at least two handles being accessible only via the at least one elongate flap opening formed in the at least one flap covering. In another such embodiment, the portable bag further comprises at least one side crease on each of the side surfaces; and each of the two elongate flap coverings overlays at least a portion of the at least one side crease. In yet other embodiments, the portable bag further comprises an interior liner further defining the interior compartment of the portable bag, the interior liner being positioned intermediate the interior compartment and the plurality of surfaces.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF VARIOUS EMBODIMENTS

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Portable Bag 1

Figure 1:
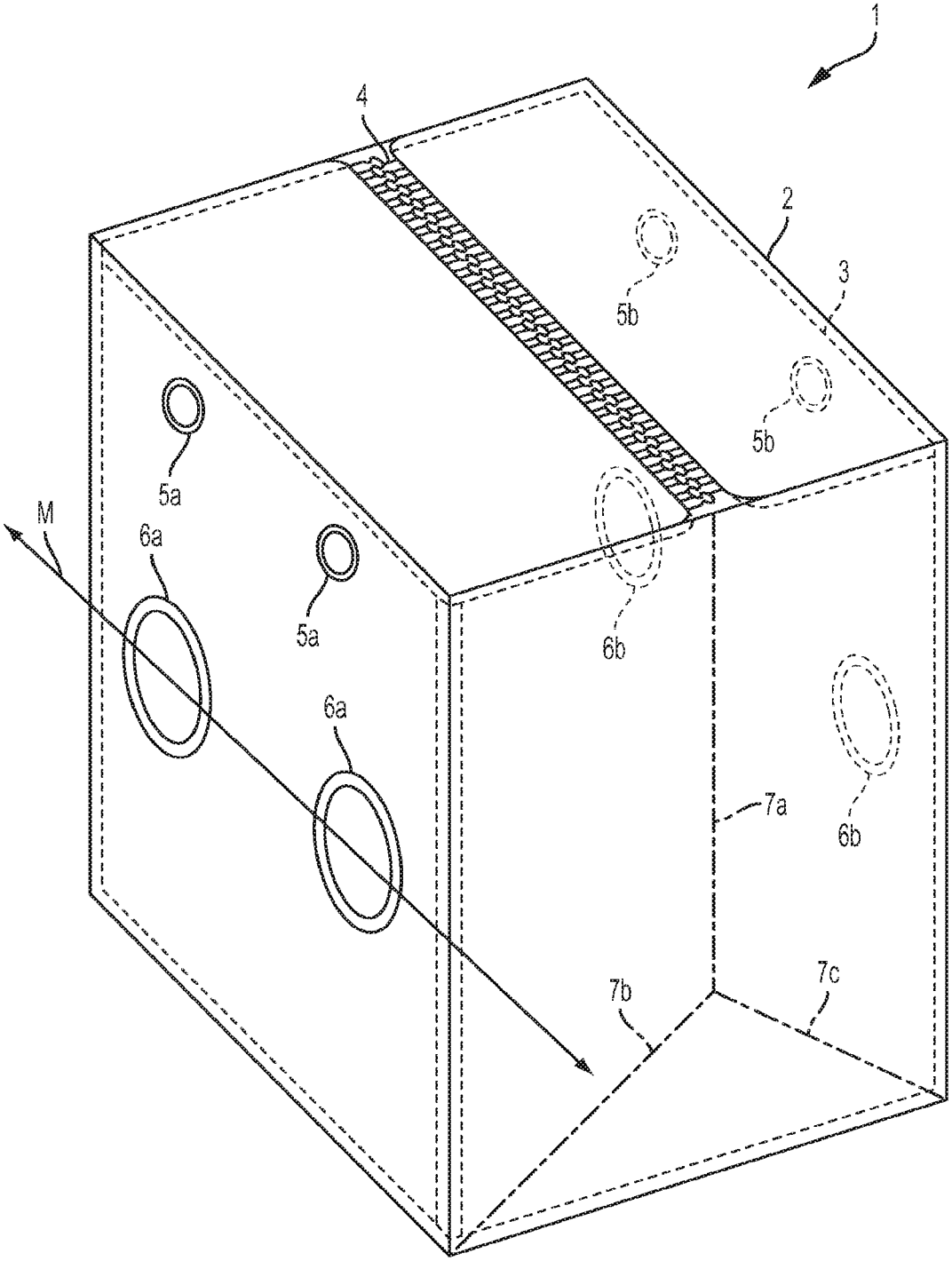
FIG. 1 is a perspective view illustrating a portable bag 1 having integrated handling openings according to a first exemplary embodiment of the present invention.

FIG. 1 illustrates a portable bag 1 according to various embodiments of the present invention. The portable bag 1 comprises a plurality of external surfaces including a front surface 10 (see FIG. 2), a rear surface 11 (see FIG. 3), a first side surface 12 (see FIG. 4), a second side surface (see FIG. 5), and one or more top surface portions 14*a*, 14*b* (see FIG. 6). Each of these surfaces may be, in certain embodiments, secured relative to one another in a stitched or hemmed configuration so as to define a set of edge hems 2 and corner hems 8 (see FIGS. 2-7), as such are commonly known or understood by those of ordinary skill in the art. In other embodiments, the surfaces may be formed by one or more creases in an otherwise seamless material, as may be desirable for particular scenarios or applications, and as may be comparable to the side creases 7*a-c* (see FIGS. 4-5) and the bottom crease (see FIG. 7) described further below.

Figure 2:
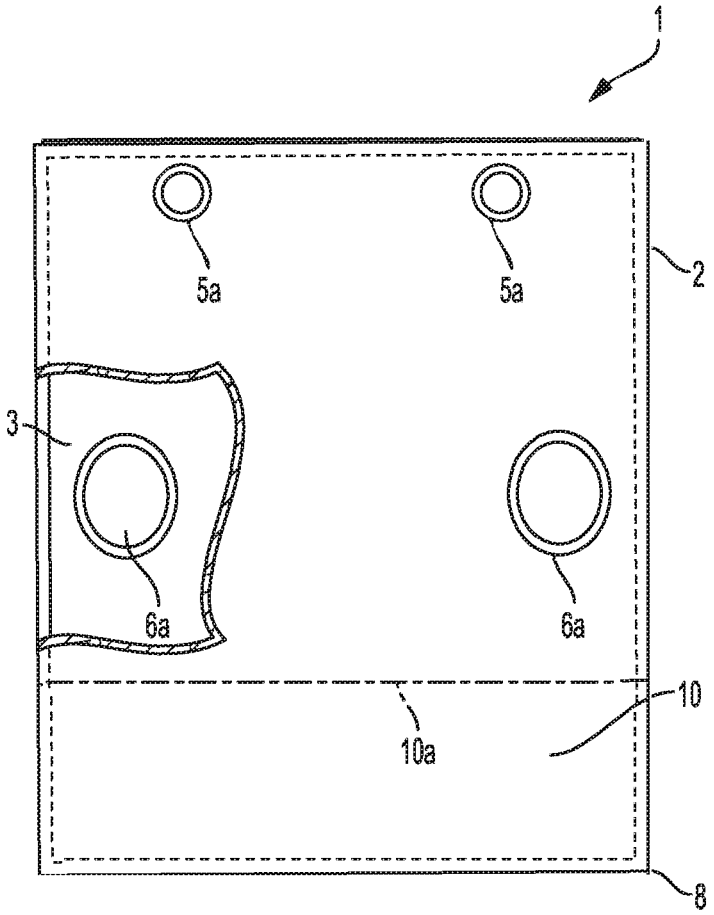
FIG. 2 is a front view of the portable bag of FIG. 1, illustrating a front surface 10 thereof.
Figure 3:
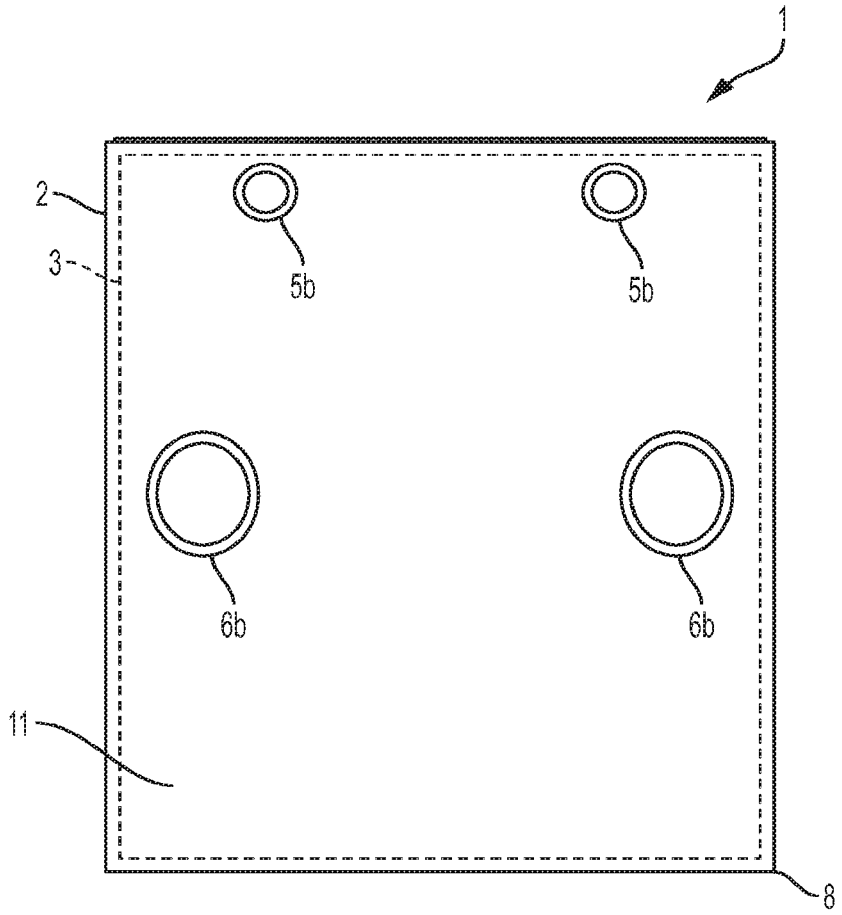
FIG. 3 is a rear of the portable bag of FIG. 1, illustrating a rear surface 11 thereof, the rear surface being substantially identical to the front surface of FIG. 2.

With reference to FIGS. 2 and 3, it may be understood therefrom that the front surface 10 and the back surface 11 of the portable bag 1 may be in certain embodiments substantially identical relative to one another. For example, each contain a pair of eyelets 5*a*, 5*b* configured to receive there-through portions of a wire rack or rack assembly 22, as will be described in further detail below, with reference to at least FIGS. 9-10. Still further, each of the front and back surfaces 10, 11 contain in certain embodiments a pair of handling openings 6*a*, 6*b* positioned substantially along a horizontal midpoint line M thereof (see FIG. 1). Of course, in other embodiments, the front and back surfaces 10, 11 may have one or more different elements, for example, the portable bag 1 may have only handling openings 6*a* or handling openings 6*b*, such that the handling openings exist on only one or the other of the front and back surfaces 10, 11. In still other embodiments, as will be described elsewhere herein, the positioning of the handling openings 6*a*, 6*b* may also differ as between the front and back surfaces 10, 11, and/or further still relative to the pattern and/or number thereof contained on any one surface, whether the front or back surface 10, 11.

Figure 4:
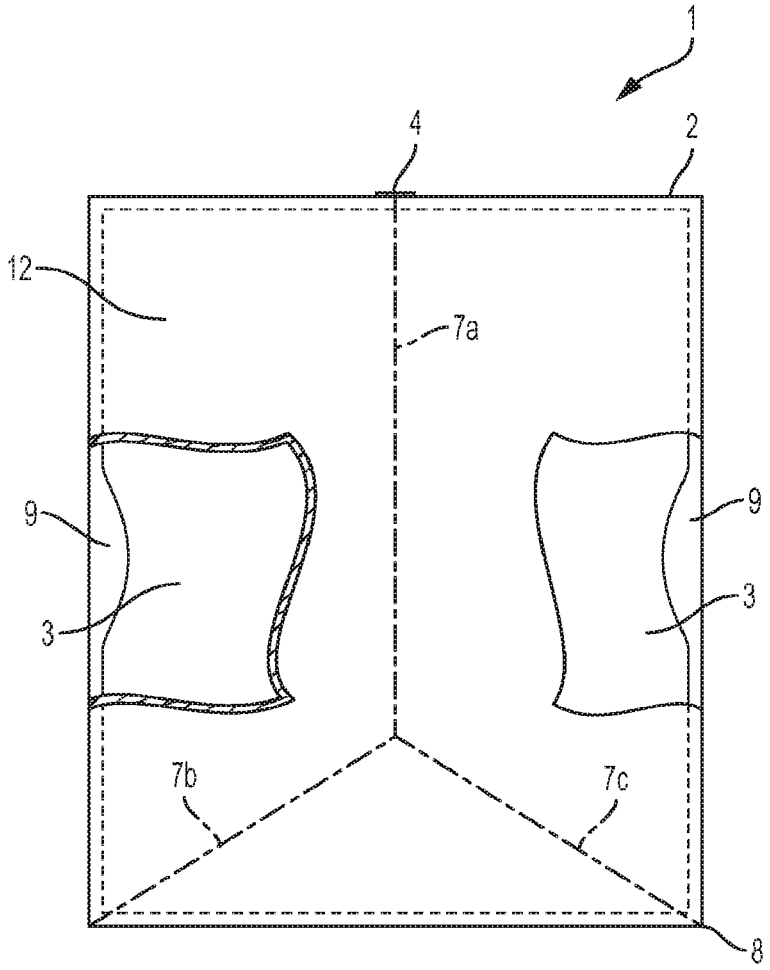
FIG. 4 is a first side view of the portable bag of FIG. 1, illustrating a first side surface 12 thereof.
Figure 5:
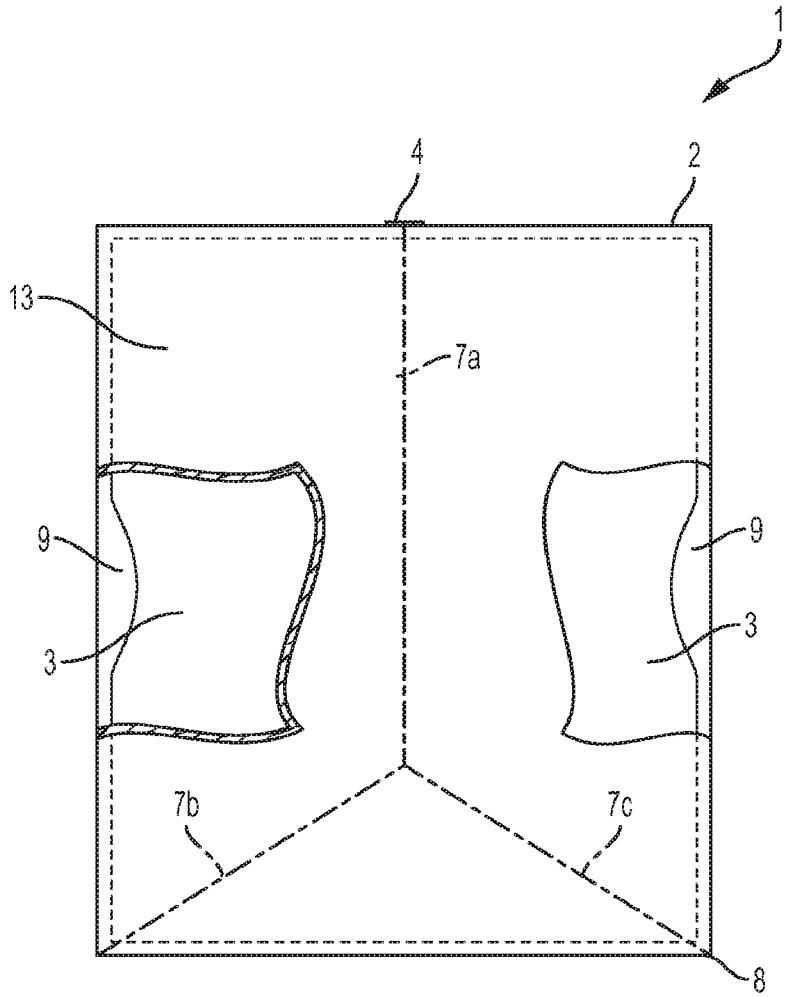
FIG. 5 is a second side view of the portable bag of FIG. 1, illustrating a second side surface 13 thereof, the second side surface being substantially identical to the first side surface of FIG. 4.

With reference to FIGS. 4 and 5, it may be understood therefrom that the first side surface 12 and the second side surface 13 of the portable bag 1 may be in certain embodiments substantially identical relative to one another. For example, each may contain a set of creases 7*a-c* formed thereon, so as to facilitate folding of the portable bag 1 between an open or unfolded configuration 30 (see FIG. 10) and a first or second folded configuration 20*a*, 20*b* (see FIGS. 8 and 9), all as will be described in further detail elsewhere herein. In at least the illustrated embodiment, a configuration of three creases 7*a-c* are provided in each side surface 12, 13, namely a primary and substantially vertical crease 7*a* and two secondary and substantially diagonal creases 7*b*, 7*c*—each branching off from the primary crease and extending from an end thereof to respective corner hems 8 of the portable bag 1. In other embodiments, alternative numbers of creases and/or alternative crease configurations may exist, provided such likewise facilitate folding of the portable bag 1 into a substantially flat and folded configuration, such as that illustrated in FIGS. 8 and 9.

Figure 6:
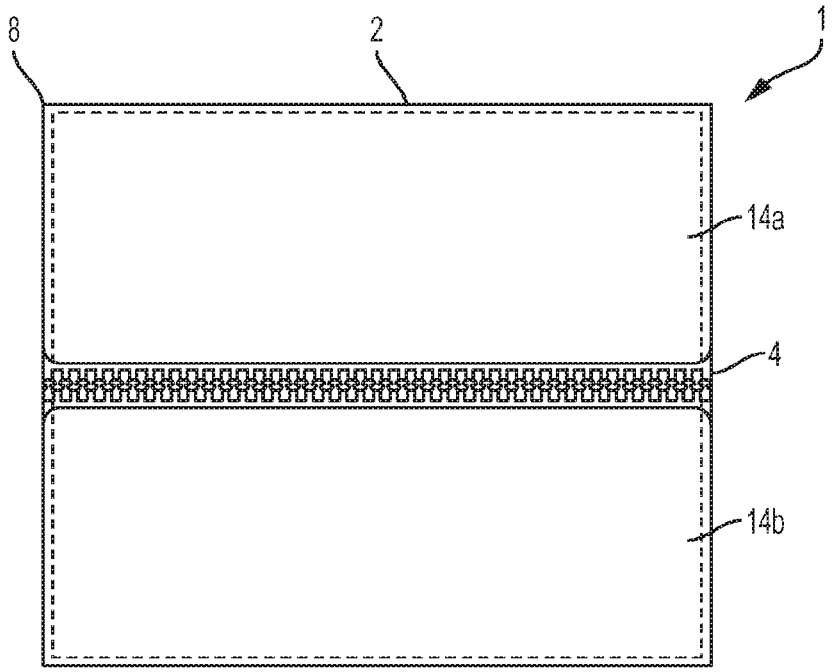
FIG. 6 is a top view of the portable bag of FIG. 1, illustrating a top surface portions 14*a*, 14*b* and a closure mechanism 4 thereof.

With reference to FIG. 6, it may be understood therefrom that the top surface may in certain embodiments, as illustrated, contain two surface portions 14*a*, 14*b*. In at least the illustrated embodiment, each surface portion 14*a*, 14*b* comprises approximately one half of the totality of the top surface of the portable bag 1. Each may also have in certain embodiments a closure mechanism 4 attached to a portion thereof intermediate each surface portion 14*a*, 14*b*. Such closure mechanism 4 is configured, according to these and still other embodiments, to facilitate secure sealing of the portable bag 1 upon filling thereof with a plurality of packages (e.g., small packages for transport by a common carrier server). In certain embodiments, the closure mechanism 4 may extend along an entirety of a length or width of the top surface; in other embodiments, the closure mechanism 4 may be centrally or otherwise located within a periphery of the top surface, as will be described in further detail elsewhere herein with reference to at least FIGS. 17A-D.

Figure 7:
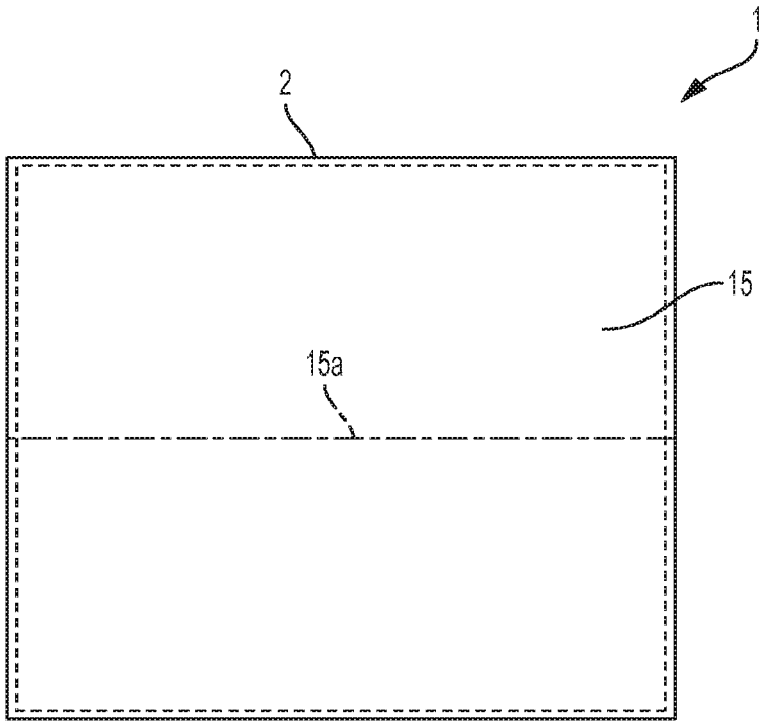
FIG. 7 is a bottom view of the portable bag of FIG. 1, illustrating a bottom surface 15 thereof.

Turning now to FIG. 7, it may be understood therefrom that the bottom surface 15 of the portable bag 1 may much like the side surfaces 12, 13 contain thereon at least one crease 15*a*. Such is, according to certain embodiments, configured to facilitate folding of the portable bag 1 into a substantially flat and folded configuration, such as that illustrated in FIGS. 8 and 9. Such combinations of creases, so as to facilitate folding may take alternative forms. For example, a crease may instead appear on one of the front or rear surfaces 10, 11—with no crease thus necessary or formed upon the bottom surface 15 in at least such embodiments.

With continued reference to FIGS. 1-7 generally, it should be understood that according to various embodiments, the front surface 10, back or rear surface 11, and first and second side surfaces 12, 13 of the portable bag 1 may be substantially rectangular in shape. In those and other embodiments, the top and bottom surfaces 14*a*, 14*b*, 15 may each be substantially square-shaped when viewed in their entirety. In those embodiments where the top surfaces 14*a*, 14*b* each form approximately one half of the total top surface (see FIG. 6), each of such surfaces may also be substantially rectangular in shape, but smaller in size relative to the front, back, and side surfaces 10-13. Of course, in still other embodiments, the surfaces 10-15 may be otherwise shaped, whether square, rectangular, triangular, a combination thereof, or otherwise, however as may be desirable for particular applications.

Returning to FIG. 1, it may be seen that the top surface portions 14*a*, 14*b* are, in certain embodiments, selectively secured relative to one another via a closure mechanism 4. In the illustrated embodiment, the closure mechanism 4 is a zipper, as may be seen likewise in FIG. 6. In other embodiments, the closure mechanism may comprise any of a variety of closure mechanisms commonly known or understood in the art as useful for selectively securing two separate components or items relative to one another, including but not limited to the non-limiting examples of magnetic strips, magnetic dots, adhesive bonding material, a spring-loaded or otherwise biased assembly, Velcro®, interlacing and/or interlocking components, or the like.

According to various embodiments, the portable bag 1 of FIGS. 1-7 is equipped with an internal liner 3 configured to encompass substantially an entirety of the internal volume of the portable bag. In this manner, in certain embodiments, the internal liner 3 defines the cavity filled by the plurality of packages placed within the portable bag 1. As a result, so as to maximize the volume available for the plurality of packages, the liner 3 is, in these and other embodiments, hemmed to internal edges or seams of the surfaces 10-15 of the portable bag, as such have been described previously herein. In still other embodiments, the internal liner 3 may be otherwise adhered or affixed to an internal surface of the portable bag 1, whether via a bonding procedure or any of a variety of procedures as commonly known and understood in the art and configured for retaining and/or otherwise securing two components relative to one another.

With reference now to FIGS. 2-3, it may be seen that the interior liner 3 may be configured so as to substantially adhere to the edges 2 (whether hemmed or not) of the portable bag 1. This is the case in certain embodiments relative to a majority of the interior liner 3. In particular embodiments, however, such as that illustrated in FIGS. 1-7, at least a portion of the interior liner 3 is not adhered directly to the surfaces 10-15 of the portable bag 1. This may be understood with reference to FIGS. 4-5, wherein a cavity or pocket 9 is illustrated, such that all around the circumference thereof the interior liner 3 remains adhered or otherwise secured relative to the portable bag 1. The cavity or pocket 9 substantially aligns with the handling opening(s) 6*a*, as illustrated in FIG. 2, so as to enable a user to place his/her hands through the handling openings to hold or otherwise transport or move the portable bag 1 without at the same time passing his/her hands through the interior liner 3. In addition to not only preventing user access to the plurality of packages stored within the portable bag 1, this cavity or pocket 9 containing liner 3 configuration ensures that no packages can inadvertently pass through the handling openings and out of the portable bag 1.

With continued reference to FIGS. 4-5, with incorporation further of FIGS. 1-3, it should be understood that multiple cavities or pockets 9 may be present, for example, one associated with each of the handling openings 6*a*, 6*b*, adjacent both the front and the rear surfaces of the portable bag 1. Of course, in still other embodiments, the interior liner 3 may be configured and secured relative to the portable bag 1 such that no cavities or pockets 9 are formed therebetween, as may be advantageous or otherwise desirable in configurations such as that of portable bag 301 (see FIG. 13), wherein no integrated handling openings are provided on a surface of the portable bag.

According to various embodiments, the interior liner 3 may be constructed of any of a variety of materials, comparable and including the non-limiting examples of materials set forth previously herein with respect to the surfaces 10-15 of the portable bag 1 itself. In other embodiments, the interior liner 3 may be otherwise constructed, however, as may be desirable.

Returning now to FIGS. 1-3, illustrated therein are a set of handling openings 6*a* located on the front surface 10 of the portable bag 1. Corresponding handling openings 6*b* appear, in at least the illustrated embodiment, upon the opposing and rear or back surface 11 of the portable bag 1. In other embodiments, it should be understood that only one or the other of openings 6*a*, 6*b* may be provided, as may be desirable, for example, where only openings upon a front surface may be useful for a particular application. Still further, as illustrated in FIGS. 1-3, the handling openings 6*a*, 6*b* may be, each as a set, substantially aligned along a horizontal midpoint line M of the front surface 10. Of course, in other embodiments, as will be described in detail further below, differing placement configurations may be provided, along with differing total numbers of handling openings (e.g., two, three, four, five, six, or more).

As may also be understood from FIGS. 1-3, the handling openings 6*a*, 6*b* are according to various embodiments defined at least in part by a grommet, as such are commonly known or understood in the art. Such may be provided, as a non-limiting example, so as to provide improved durability of the handling openings 6*a*, 6*b*. Details regarding the shape, size, color, and even material of such grommets are described in detail further below. Remaining now with FIG. 1, in particular, it should be understood therefrom further that such involves a non-limiting and exemplary embodiment; in other embodiments, the handling openings 6*a*, 6*b*, formed as orifices or holes in the surfaces 10, 11 of the portable bag 12 may simply be hemmed around a periphery thereof, likewise so as to provide a desired degree of durability thereof for reuse over time. In still other embodiments, the handling openings 6*a*, 6*b* may be formed, defined, or otherwise strengthened for durability and the like by one or more mechanisms other than grommets, stitching, hemming, or the like.

As illustrated in FIGS. 1-3, the handling openings 6*a*, 6*b* are according to various embodiments substantially circular in shape. In certain embodiments, the handling openings 6*a*, 6*b* are shaped in this fashion so as to facilitate and other enable passage of a user's hand there-through. In these and other embodiments, the handling openings 6*a*, 6*b* are likewise appropriately sized so as to permit passage of a typically sized user's hand there through.

Also illustrated in FIGS. 1-3 are a set of eyelets 5*a* located upon at least the front surface 10 of the portable bag 1. According to various embodiments, corresponding eyelets 5*b* are provided on the rear surface 11 of the portable bag 1, so as to amongst other benefits, facilitate sliding of the portable bag (through and via the eyelets) onto a storage or packing or transport rack (see e.g., rack 22 of FIGS. 9 and 10). As may be understood from FIGS. 1-3, in certain embodiments, the eyelets 5*a*, 5*b* are positioned substantially adjacent a top edge of the front and rear surfaces 10, 11, so as to permit the remainder of the bag 1 to "hang" there below, for example upon hanging of the bag upon a rack (see again FIGS. 9 and 10). In these and other embodiments, the eyelets are substantially smaller in size that the handling openings 6*a*, 6*b* described previously herein. Of course, in still other embodiments, the size of the eyelets and the handling openings may be substantially the same or otherwise, as may be desirable.

Remaining further with FIGS. 1-3, it should also be understood therefrom that the eyelets 5*a*, 5*b* are according to various embodiments defined at least in part by a grommet, as such are commonly known or understood in the art. Such may be provided, as a non-limiting example, so as to provide improved durability of the eyelets 5*a*, 5*b*. Details regarding the shape, size, color, and even material of such grommets are described in detail further below. Remaining now with FIG. 1-3, in particular, it should be understood therefrom further that such involves a non-limiting and exemplary embodiment; in other embodiments, the eyelets 5*a*, 5*b*, formed as orifices or holes in the surfaces 10, 11 of the portable bag 12 may simply be hemmed around a periphery thereof, likewise so as to provide a desired degree of durability thereof for reuse over time. In still other embodiments, the eyelets 5*a*, 5*b* may be formed, defined, or otherwise strengthened for durability and the like by one or more mechanisms other than grommets, stitching, hemming, or the like.

As illustrated in FIGS. 1-3, the eyelets 5*a*, 5*b* are according to various embodiments substantially circular in shape. In certain embodiments, the eyelets 5*a*, 5*b* are shaped in this fashion so as to facilitate and other enable passage of one or more prongs of an associated rack there through, as will be described in further detail elsewhere herein with reference to at least FIGS. 9 and 10.

Turning now to FIGS. 4 and 5, illustrated thereon are exemplary creases 7*a-c*, as may be formed in the side surfaces 12, 13 of the portable bag 1 according to various embodiments thereof. The primary crease 7*a* is oriented substantially vertically, extending from a location upon the side surfaces 12, 13 substantially adjacent the top surfaces 14*a*, 14*b* (see FIG. 6) of the portable bag 1. The primary crease 7*a* according to certain embodiments does not extend an entire length of the side surfaces 12, 13, but merely approximately ⅔ of the distance thereof, at which point, the primary crease 7*a* is joined by the secondary creases 7*b*, 7*c*. As may be understood from FIGS. 4 and 5, at this intersection of the creases 7*a-c*, the secondary creases 7*b*, 7*c* extend diagonally outward and downward, toward and extending to respective corner hems 8 of the portable bag 1.

Figure 8:
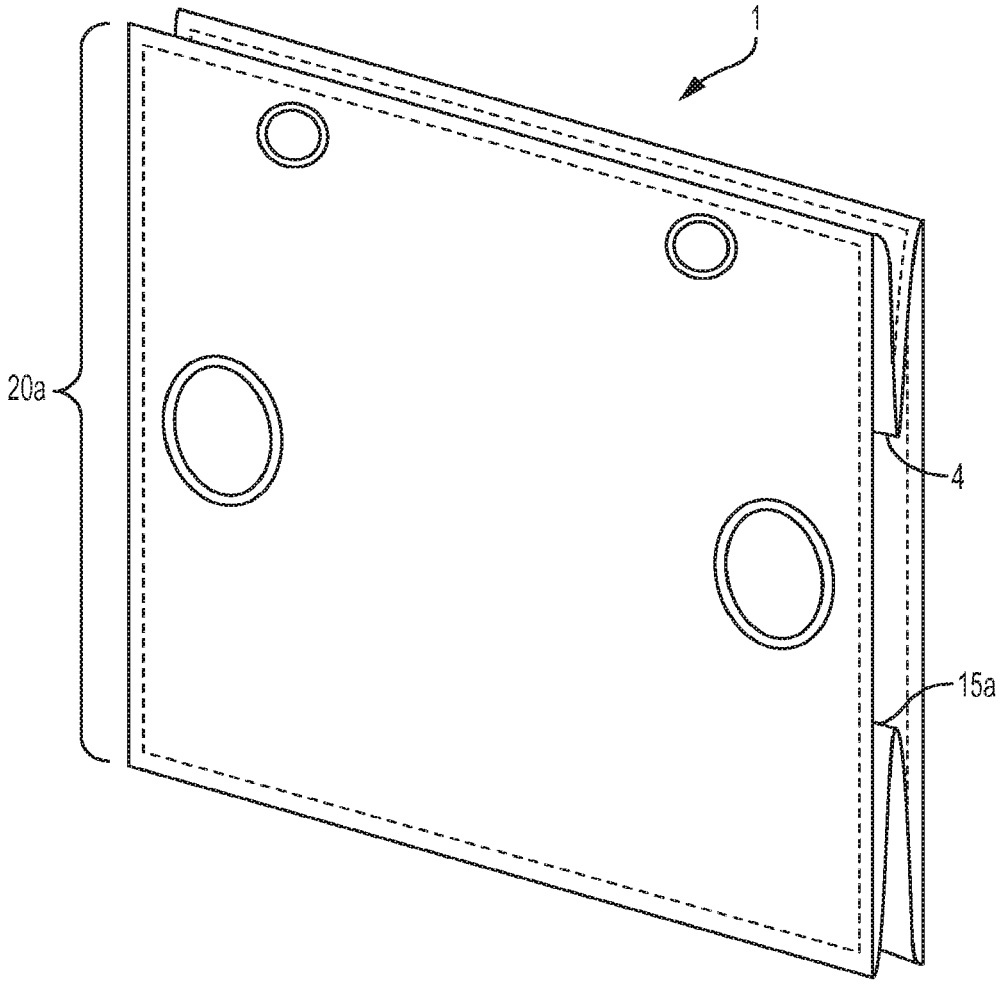
FIG. 8 is another perspective view of the portable bag of FIG. 1, illustrating the portable bag in a first folded configuration 20*a* according to various embodiments.

In at least the illustrated embodiment of FIGS. 4-5, the creases 7*a-c* are oriented inwardly, so as permit folding of the portable bag 1 in a fashion such that the side surfaces 12, 13 fold inwardly, as illustrated, for example in FIG. 8. Such a folded and creased configuration facilitates ease of handling of the portable bag 1 (e.g., via an automated process or the like) while maintaining a minimal degree of risk that any portions of the portable bag 1 will be caught or otherwise tangled or twisted in one or more components external to the bag. This is particularly of importance, when considered in comparison to the conventional "pillow-type" bags, which did not have an expanded lower side surface or any sort of base surface.

Figure 9:
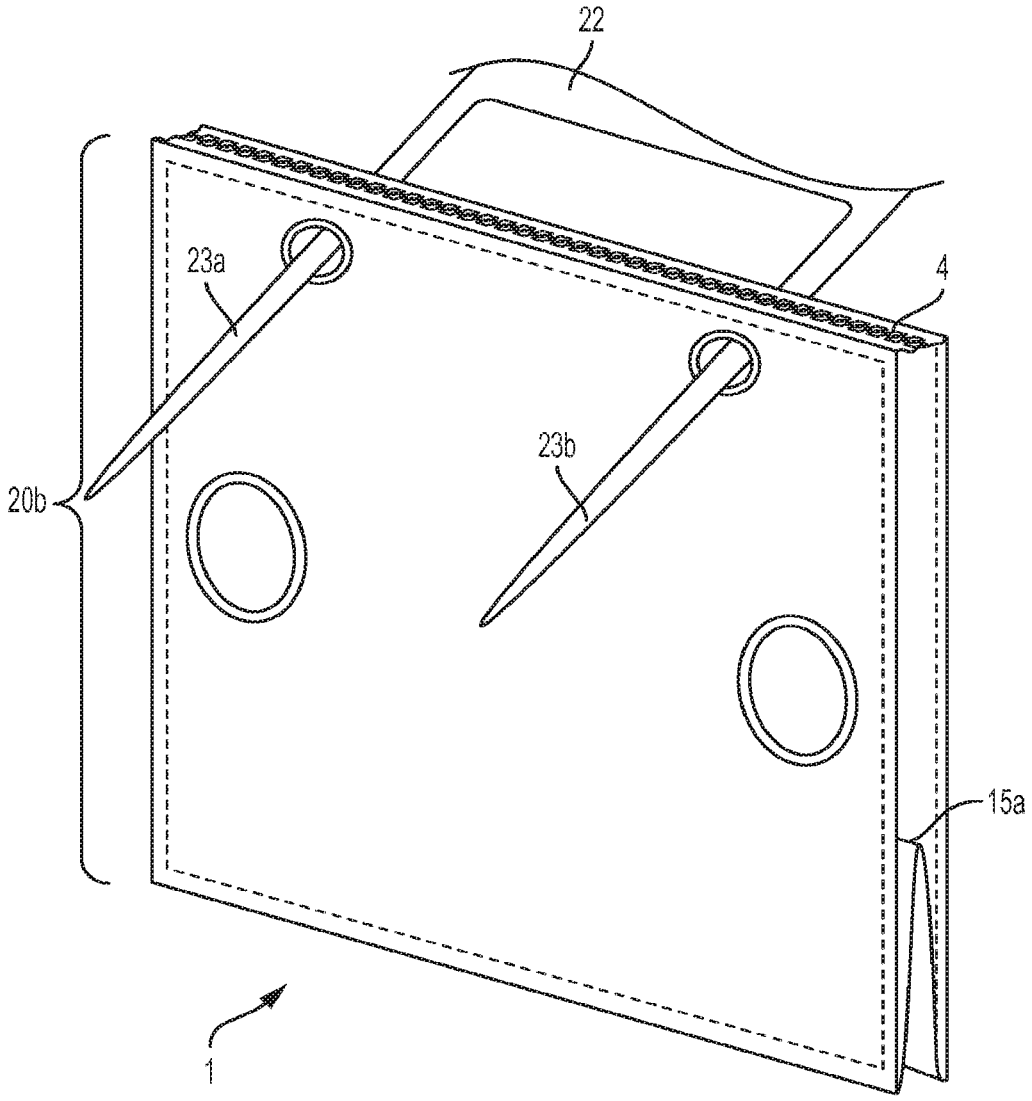
FIG. 9 is yet another perspective view of the portable bag of FIG. 1, illustrating the portable bag in a second folded configuration 20*b* according to various embodiments, oriented for use with a wire rack assembly 22.

Of course, in other embodiments, the creases 7*a-c* may be otherwise oriented, as may be desirable for particular scenarios; although in any of such and still other embodiments, the creases will generally be pressed inward, so as to avoid the side surfaces 12, 13 of the back extending outward relative to the front or rear surfaces 10, 11 of the portable bag, upon folding thereof as in FIG. 8 or 9. Still further, although three creases 7*a-c* are illustrated, still other embodiments may have differently oriented or a different number of creases, provided the same folding capabilities are provided thereby.

Turning with particular focus to FIG. 7, a crease 15*a* is provided in the bottom surface 15 of the portable bag 1 in certain embodiments, and such operates in conjunction with the above described creases 7*a-c*, so as to facilitate folding of the portable bag (see e.g., FIGS. 8 and 9). As may be understood from FIGS. 8 and 9, the bottom crease 15*a*, like the creases 7*a-c* is configured according to various embodiments so as to fold inwardly when the portable bag is folded or otherwise collapsed into a substantially flat configuration. In this manner, the bottom surface 15 is likewise shielded behind and between the front and rear surfaces 10, 11, so as to minimize the risk of catching, tangling, or twisting thereof in one or more handling or processing components external to the bag. Of course, in other embodiments, alternative crease 15*a* configurations may be provided; in at least one embodiment, no crease 15*a* may be provided, with a crease 10*a* (see e.g. FIGS. 2 and 10) being instead formed upon one of the front or rear surfaces 10, 11, so as to facilitate folding of the bag in a manner analogous to the folding of a conventional brown paper bag.

Figure 10:
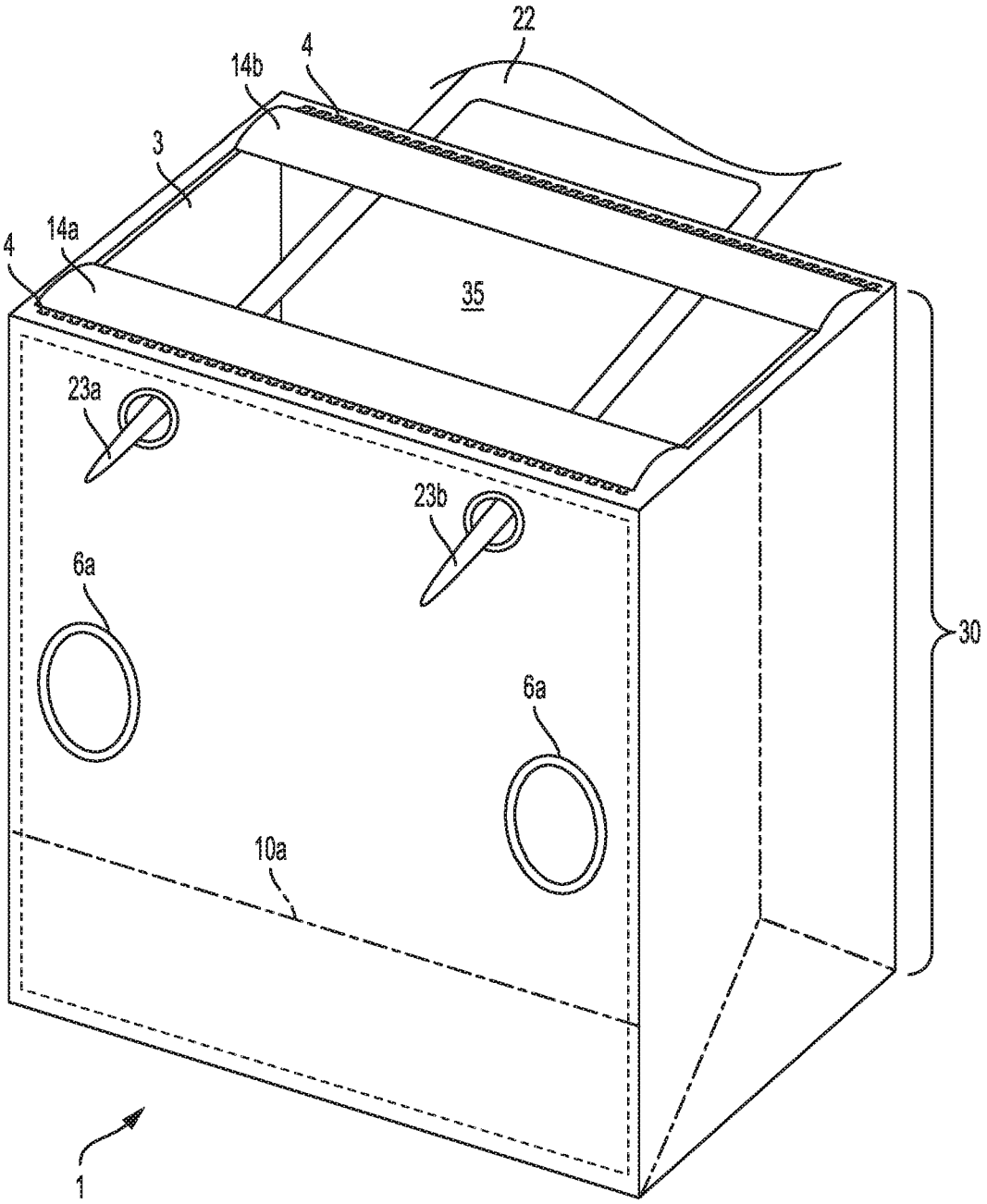
FIG. 10 is yet another perspective view of the portable bag of FIG. 1, illustrating the portable bag in an unfolded configuration 30 according to various embodiments, as likewise oriented for use with the wire rack assembly 22.

Turning now with attention upon FIGS. 8-10, illustrated therein are a first folded configuration 20*a*, a second folded configuration 20*b*, and an unfolded configuration 30. In certain embodiments, the folded configurations 20*a*, 20*b* are substantially the same, but for that when an external component, such as the wire rack 22 and its associated first and second prongs (or tusks) 23*a*, 23*b* are passed through the eyelets 5*a*, 5*b* of the portable bag 1, the closure mechanism 4 does not further fold inward and downward, as seen, for example in FIG. 8. Instead, as illustrated in FIG. 9, the closure mechanism 4 and the remaining portions of the top surfaces 14*a*, 14*b* may fold inward and downward, but only to an extent such that the top surfaces 14*a*, 14*b* remain relatively positioned above the eyelets 5*a*, 5*b*. In this manner, the prongs 23*a*, 23*b* may nevertheless pass through the eyelets 5*a*, 5*b*, even in the folded configuration 20*b*.

Figure 25:
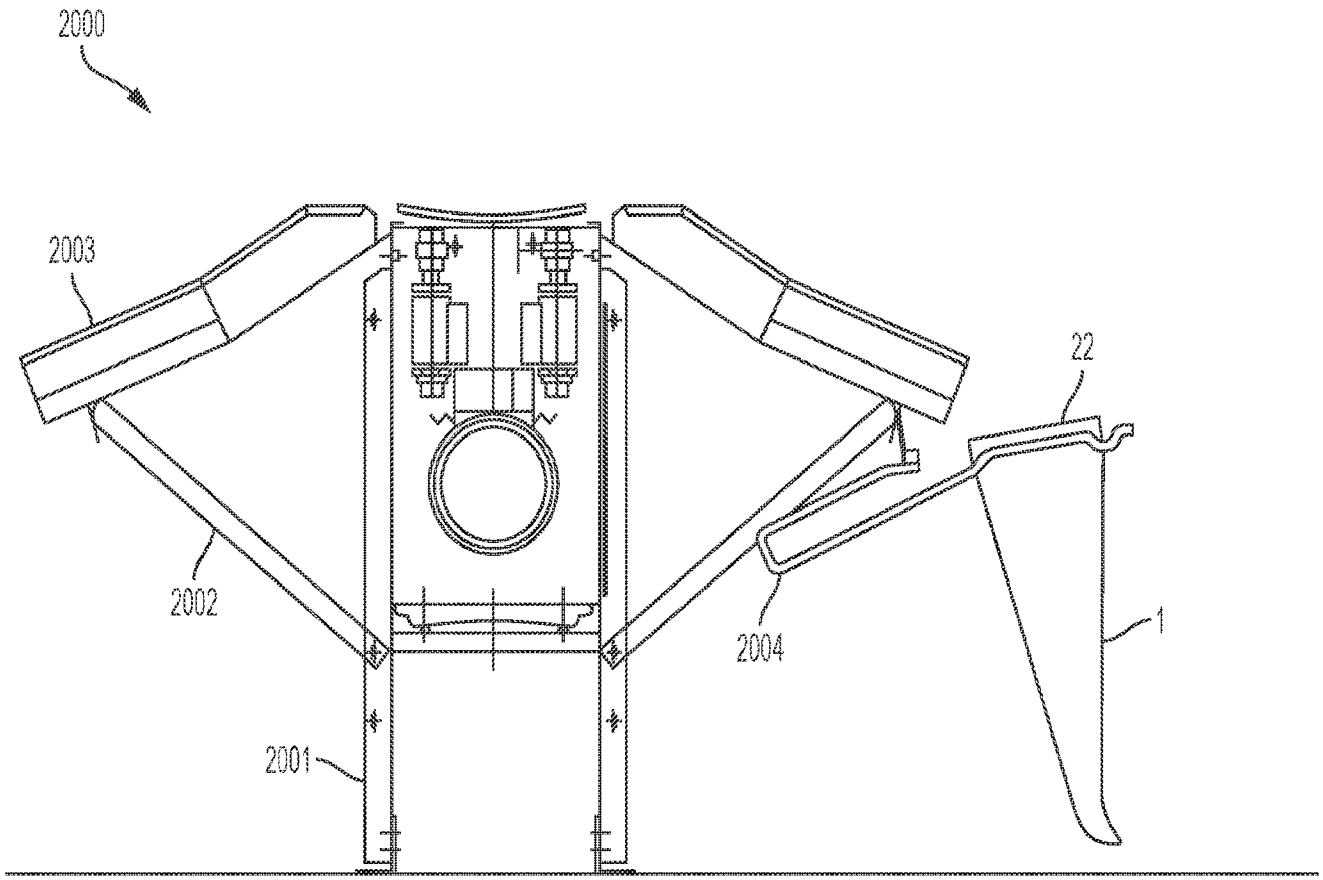
FIG. 25 is an illustration of a first exemplary assembly configured for use with the portable bags according to various exemplary embodiments of the present invention.
Figure 26:
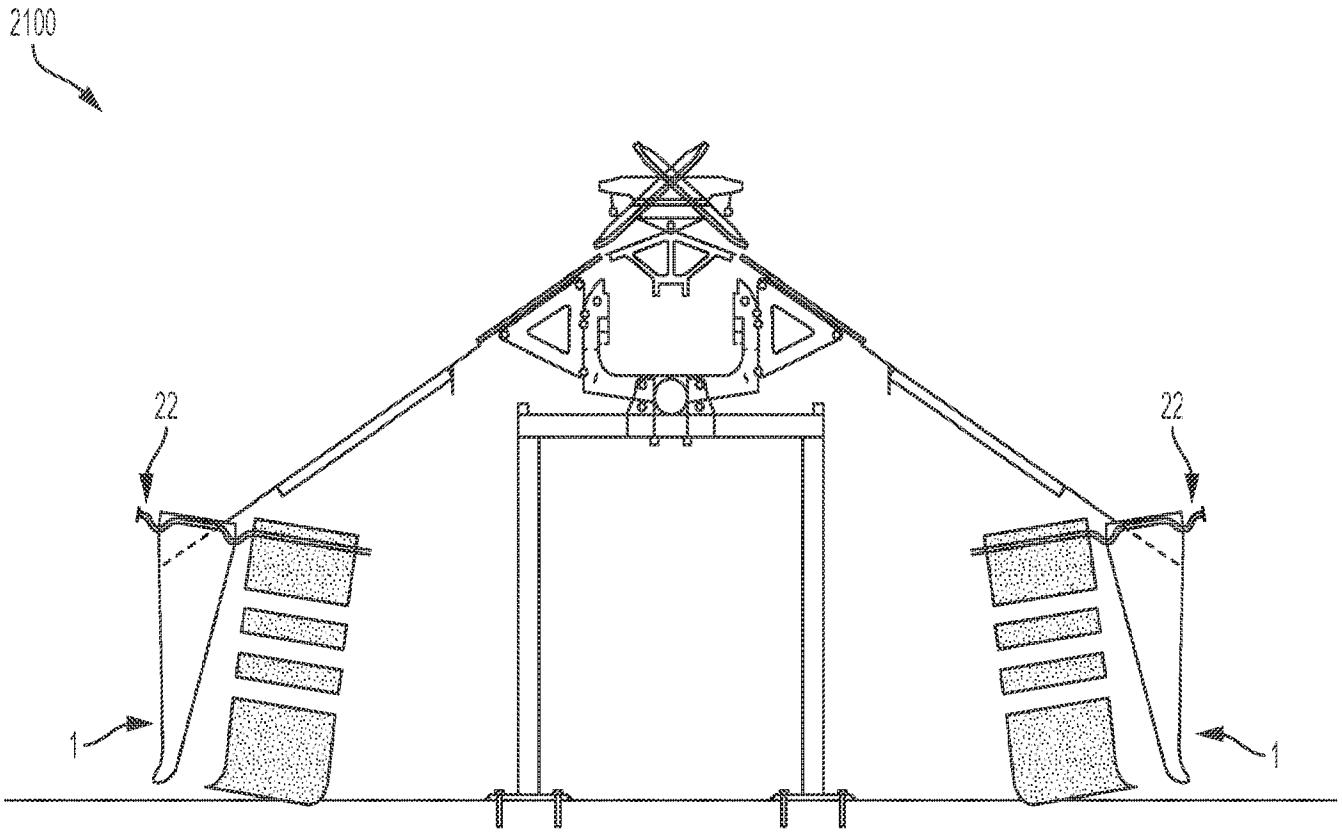
FIG. 26 is an illustration of a second exemplary assembly configured for use with the portable bags according to various exemplary embodiments of the present invention.

Additional details of such a rack 22 or external processing component and any prongs or tusks associated therewith may be understood with reference to FIGS. 25 and 26, which illustrated respective exemplary assemblies 2000 and 2100, which may be used in conjunction with the portable bag 1 (and with any of the portable bag embodiments described herein). With reference to FIG. 25, it may be seen therein a frame 2001 that may be configured to support rack (or tusk) 22 mounting supports 2002. These supports 2002 may further support slides 2003 (or tubes or the like) configured for a plurality of packages to travel thereupon. A continuous angle may be provided, such that the supports 2002 and the slides 2003 are configured to align substantially with the rack 22, which may be mounted in certain embodiments to the supports 2002 as illustrated (or otherwise). In certain embodiments, the racks 22 may extend outwardly from the supports, defining a shape thereof as in FIG. 10 (for example); in other embodiments, such as that illustrated in FIG. 25, the racks 22 may be configured to provide not only for a bag hanging portion to receive bag 1, but also a bag storage area 2004, where additional bags may be retained, for example in a closed configuration (as described elsewhere herein) until such may be retrieved and clipped as illustrated in FIG. 25 (and FIG. 10) adjacent the ends or tips of the rack 22. Of course, alternative configurations of external processing components and/or assemblies for use with the portable bag 1 (or those bags of other embodiments described herein) may be envisioned. An additional exemplary assembly 2100 is illustrated in FIG. 26, configured similarly but with differently oriented supports and a dual slide/rack configuration, as compared to the single rack configuration illustrated in FIG. 25.

With reference now again to FIG. 10, illustrated therein is an open or unfolded configuration 30 according to various embodiments of the portable bag 1. As may be seen, the open or unfolded configuration 30 may be provided likewise in conjunction with an external component, such as a rack of dispensing unit 22, such having at least two prongs 23*a*, 23*b*, sized and oriented so as to extend through the eyelets 5*a*, 5*b*, as described previously herein. In certain embodiments, the closure mechanism 4 may be biased so as to further define a top opening 35 when in the open or unfolded configuration 30. Such may be provided, for example, via a spring-loaded assembly or via any of the variety of closure mechanisms, as are described in further detail elsewhere herein. In certain embodiments, the closure mechanism 4 may be biased in a fashion so that the portable bag is naturally closed; in other embodiments, the closure mechanism may be instead oppositely biased so that the portable bag is naturally open, as in FIG. 10. In at least one embodiment, upon removal of the portable bag 1 from the wire rack 22 or dispensing assembly, the closure mechanism 4 may be further configured to automatically close. In this manner, upon filling of the portable bag 1 with a plurality of packages (e.g., while on the rack 22 and in an unfolded configuration 30 with the top surface(s) biased so as to define a top opening 35), the dispensing or removal thereof from the rack 22 or another comparable external component may automatically or otherwise in a near real-time fashion close or seal the closure mechanism and thus the portable bag 1.

With reference generally to FIGS. 8-9 and the descriptions of such as provided immediately above, it should be understood by analogy that the same configurations 20*a*, 20*b*, 30; the same external components including a rack 22 and prongs 23*a*, 23*b*; and a biased top opening 35 may be provided in conjunction with any of the various portable bags 101, 201, 301, 401, 501, 601, 701, 801, 901, 1001—all as described in detail further below. In other embodiments, of course, any one or a combination of such folding features or external components may be substantially different with respect to such other embodiments of the portable bags however as may be desirable for a particular application.

Portable Bag 101

While the embodiment of the portable bag 1 illustrated in FIGS. 1-10 comprises a single pair of handling openings 6*a* on the front surface 10 thereof (see FIGS. 1 and 2 particularly) and a corresponding single pair of handling openings 6*b* on the rear surface 11 thereof (see FIGS. 1 and 3 particularly), it should be appreciated that in still other embodiments, any number or positioning of the handling openings 6*a*, 6*b* may be provided, however as may be desirable for specific scenarios or applications. As a non-limiting example, a portable bag 101, as shown in FIG. 11, may include a set of two pairs of handling openings 106*a*, 106*b*, all positioned on a front surface 110 of the portable bag.

Figure 11:
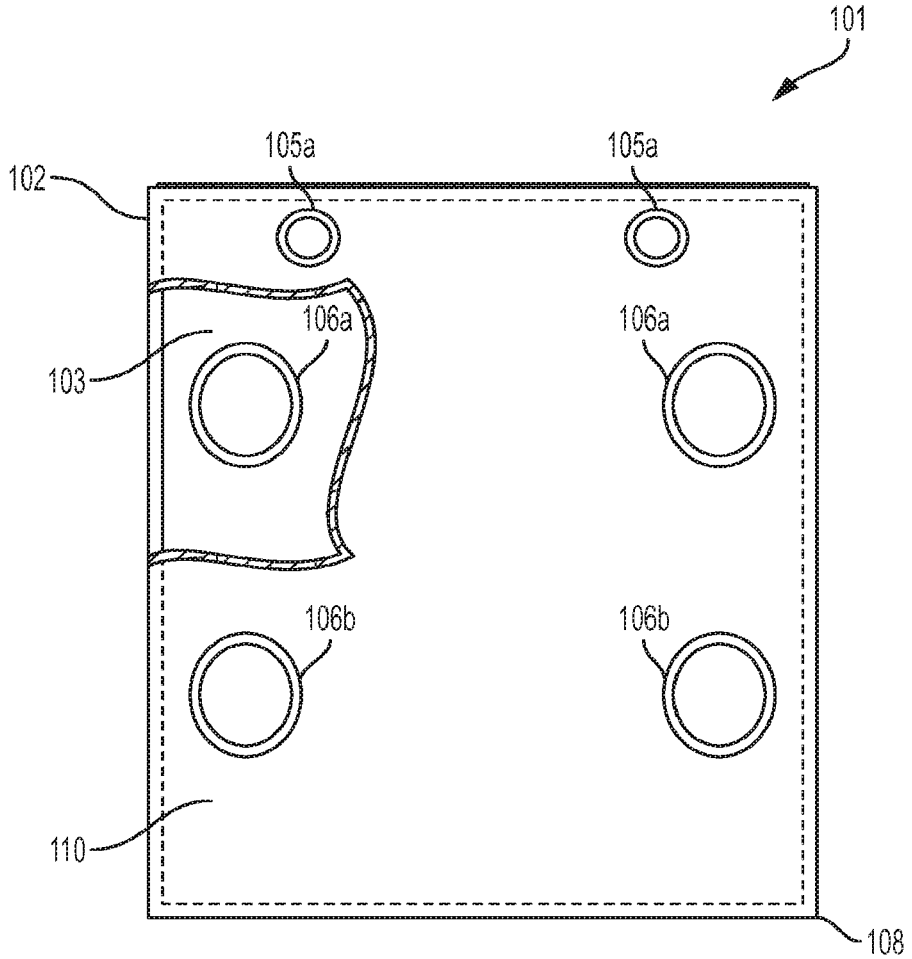
FIG. 11 is a front view of a portable bag 101 having integrated handling openings according to a second exemplary embodiment of the present invention.

As illustrated, and with reference by comparison to FIG. 2, it may be seen that the handling openings 106*a*, 106*b* on the front surface 110 of the portable bag 101 shown in FIG. 11 are each offset relative to a midpoint along a height of the front surface. In other words, rather than being positioned substantially at a midpoint of the height of the front surface, as in FIG. 2 where a set of two pair of handling openings 6*a*, 6*b* is provided, such are oriented on opposing sides of the midpoint. In certain embodiments, the offset of each of the two pair of handling openings 6*a*, 6*b* may be equal relative to the midpoint. In other embodiments, it should be understood that the offset of each of the two pairs may differ relative to the midpoint of the height of the front surface 110.

Still further, although the offsets illustrated are equal for each of the first pair of handling openings 106*a* and the second pair of handling openings 106*b*, the offsets for each may differ relative to one another. The offset of the openings 106*a*, 106*b* relative to a side hem/edge of the front surface 110 (versus relative to a horizontal midpoint thereof as described above) may also be substantially the same as that of the openings 6*a*, 6*b*, as described previously herein in certain embodiments, although in other embodiments, the offset relative to the side hem/edge may be substantially different, provided the offset is less than that of the eyelets relative to the side hem/edge.

Returning now to FIG. 11, it should be understood with reference thereto that although such illustrates only a front surface 110 of the portable bag 101, the portable bag 101 is configured according to various embodiments in substantially the same fashion as that illustrated in FIG. 1, but for the location and placement of alternative handling openings 106*a*, 106*b*. Thus, it should be understood in this regard that corresponding handling openings are present on a rear surface (not illustrated) of the portable bag 101, in much the same corresponding fashion as described above with respect to the portable bag 1. Of course, in other embodiments, the handling openings 106*a*, 106*b* may be limited to only the front surface 110 of the portable bag 101, with no corresponding handling openings on a rear surface thereof, as may be desirable.

Still further, although each of the handling openings 106*a*, 106*b* are illustrated in FIG. 11 as being the same size and shape; one or more of such may in other embodiments differ in size and/or shape relative to the remaining handling openings. For example, the handling openings may be, as non-limiting examples, substantially circular, elliptical, rectangular, or square-shaped, however as may be desirable. The handling openings 106*a*, 106*b* may also be formed in conjunction with a grommet that defines the opening. Such grommet (illustrated in FIG. 11, but not numbered) may be made of a variety of materials, including the non-limiting examples of plastic, ceramic, or metal. The grommet may include a first side portion and/or a second side portion, each of which as may be different colors and/or different materials. In certain embodiments, the grommet may be selectively removable from the portable bag 101, in which case the handling openings 106*a*, 106*b* may be further hemmed. In still other embodiments, the handling openings may be hemmed and defined without the use of a grommet.

So as to facilitate automated (or near automated) dispensing of the portable bag 101, much like that of portable bag 1, as described previously herein with reference to FIGS. 8-10, the portable bag 101 should be understood to include corresponding eyelets 105*a* on a rear surface (not illustrated) of the portable bag, as described and present on portable bag 1. With this configuration, placement of the portable bag 101 upon a wire rack assembly such as assembly 22 illustrated in FIGS. 9-10 remains possible.

With reference again to FIG. 11, in the embodiment illustrated therein, the remaining structural features of the portable bag 101 including, but not limited to, the hemmed edges 102, the interior liner 103, the eyelets 105*a*, and the hem corner(s) 108, may be substantially the same in structure, shape, and/or configuration to the hemmed edges 2, the interior liner 3, the eyelets 5*a*, and the hem corner(s) 8 of portable bag 1, as illustrated in FIGS. 1-10 and described previously herein. For example, although not expressly illustrated in FIG. 11, the interior liner 103 may be configured so as to define a hollow or space around each of the handling openings 106*a*, 106*b*, much like the interior liner 3, so as to not only prevent access to the packages located inside the bag by a user's hands or fingers, but also to prevent inadvertent passage of any relatively small packages through the handling openings. Alternatively, any combination of these structural features and still others not illustrated in FIG. 11 but understood to be present by analogy to FIGS. 1-10 can be substantially different in structure, shape, and/or configuration from those present in the portable bag 1, however as may be desirable for particular scenarios or applications. Those not illustrated in FIG. 11, but which may be either substantially the same or substantially different from those corresponding structures in FIGS. 1-10 may include, in a non-limiting fashion, closure mechanisms, side creases, liner cavities, top surface portions, bottom surfaces and crease(s), and the like.

Portable Bag 201

Figure 12:
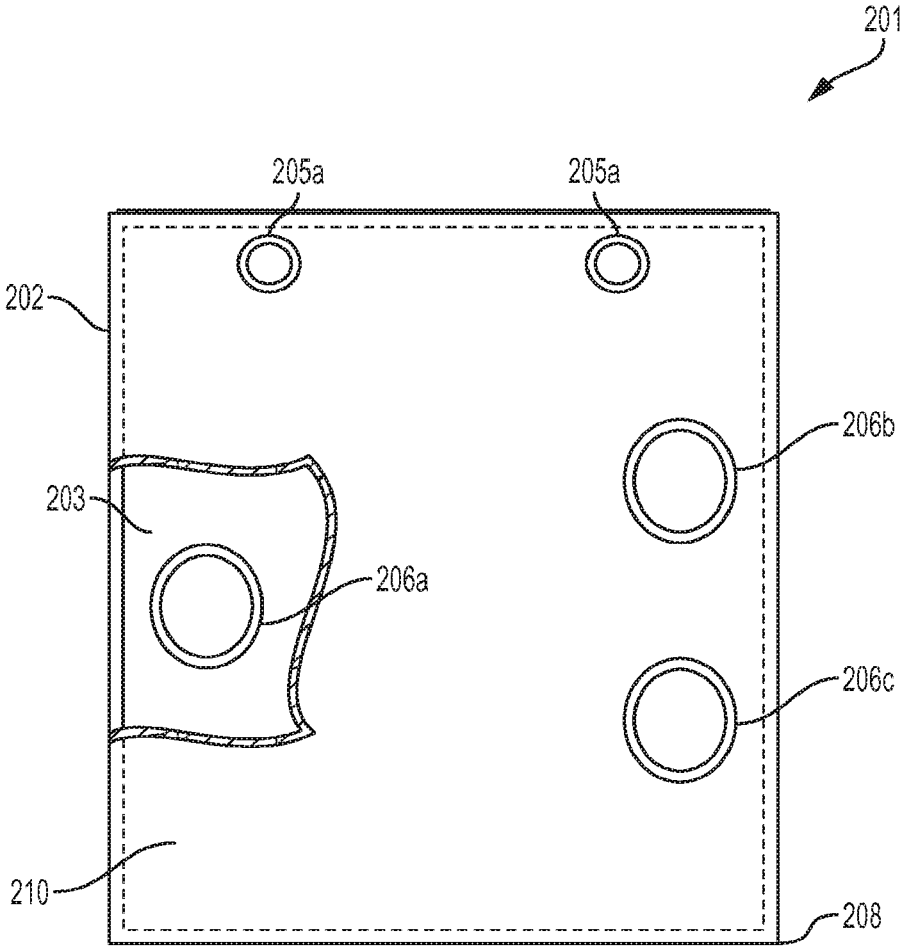
FIG. 12 is a front view of a portable bag 201 having integrated handling openings according to a third exemplary embodiment of the present invention.

While the embodiment of the portable bag 101 illustrated in FIG. 11 comprises a set of two pair of handling openings 106*a*, 106*b* on the front surface 110 thereof, it should be appreciated that in still other embodiments, any number or positioning of such handling openings may be provided, however as may be desirable for specific scenarios or applications. As a non-limiting example, a portable bag 201, as shown in FIG. 12, may include a set of three mutually offset handling openings 206*a*, 206*b*, 206*c*, all positioned on a front surface 210 of the portable bag. In certain embodiments, corresponding offset handling openings exist in the rear surface (not shown) of the portable bag 201. In these embodiments, the positioning pattern thereof may substantially match that on the front surface 210; in other embodiments, however, the positioning pattern may differ on the respective front and rear surfaces of the portable bag 201.

As illustrated, and with reference by comparison to FIG. 11 (portable bag 101), it may be seen that the handling openings 206*b*, 206*c* on the front surface 210 of the portable bag 201 shown in FIG. 12 are each offset relative to a midpoint along a height of the front surface. In other words, rather than being positioned substantially at a midpoint of the height of the front surface (as in FIG. 2), these handling openings 206*b*, 206*c* are provided such that they are oriented on opposing sides of the midpoint. In certain embodiments, the offset of each of the handling openings 206*b*, 206*c* may be equal relative to the midpoint. In other embodiments, it should be understood that the offset of each may differ relative to the midpoint of the height of the front surface 210. Still further, although the offsets illustrated are equal for each of the handling openings 106*b*, 106*c*, the offsets for each may differ relative to one another and the midpoint, particularly so in the embodiment of the portable bag 201 illustrated in FIG. 12.

Remaining with FIG. 12, it may be seen that a third and separately positioned handling opening 206*a* may also be provided in this embodiment, such that a combination of the embodiments of the portable bag 1 and the portable bag 101 (both described previously herein) is provided. Such may be beneficial where alternative manners of handling such bags may be desirable or necessary depending upon the size, shape, and/or weight of the contents packaged therein. In at least the illustrated embodiment, the third handling opening 206*a* is positioned substantially on the midpoint of the height of the front surface 210. The offset of the openings 206*a*, 206*b*, 206*c* relative to a side hem/edge of the front surface 210 may also be substantially the same as that of the openings 6*a*, 6*b*, 106*a*, 106*b*, as described previously herein in certain embodiments, although in other embodiments, the offset relative to the side hem/edge may be substantially different for one or more of the handling openings 206*a*, 206*b*, 206*c*, provided the offset is less than that of the eyelets relative to the side hem/edge.

Still further, although each of the handling openings 206*a*, 206*b*, 206*c* are illustrated in FIG. 12 as being the same size and shape; one or more of such may in other embodiments differ in size and/or shape relative to the remaining handling openings. For example, the handling openings may be, as non-limiting examples, substantially circular, elliptical, rectangular, or square-shaped, however as may be desirable. The handling openings 206*a*, 206*b*, 206*c* may also be formed in conjunction with a grommet that defines the opening. Such grommet (illustrated in FIG. 12, but not numbered) may be made of a variety of materials, including the non-limiting examples of plastic, ceramic, or metal. The grommet may include a first side portion and/or a second side portion, each of which as may be different colors and/or different materials. In certain embodiments, the grommet may be selectively removable from the portable bag 201, in which case the handling openings 206*a*, 206*b*, 206*c* may be further hemmed. In still other embodiments, the handling openings may be hemmed and defined without the use of a grommet.

Returning now to FIG. 12, it should be understood with reference thereto that although such illustrates only a front surface 210 of the portable bag 201, the portable bag 201 is configured according to various embodiments in substantially the same fashion as that illustrated in FIGS. 1 and 11, but for the location and placement of alternative handling openings 206*a*, 206*b*, 206*c*. Thus, it should be understood in this regard that corresponding handling openings are present on a rear surface (not illustrated) of the portable bag 201, in much the same corresponding fashion as described above with respect to the portable bags 1, 101. Of course, in other embodiments, the handling openings 206*a*, 206*b*, 206*c* may be limited to only the front surface 210 of the portable bag 201, with no corresponding handling openings on a rear surface thereof, as may be desirable. In still other embodiments, the handling openings on a rear surface of the portable bag 201 may differ from those on the front surface 210 of the portable bag. As a non-limiting example, the handling openings on the rear surface of the portable bag 201 may be disposed differently than those on the front surface thereof, such that the rear surface of the portable bag 201 may be configured substantially the same as the rear surface 11 of the portable bag 1 (see FIG. 3).

So as to facilitate automated (or near automated) dispensing of the portable bag 201, much like that of portable bags 1 and 101, as described previously herein with reference to FIGS. 8-11, the portable bag 201 should be understood to include corresponding eyelets 205*a* on a rear surface (not illustrated) of the portable bag, as described and present on at least portable bag 1. With this configuration, placement of the portable bag 201 upon a wire rack assembly such as assembly 22 illustrated in FIGS. 9-10 remains possible.

With reference again to FIG. 12, in the embodiment illustrated therein, the remaining structural features of the portable bag 201 including, but not limited to, the hemmed edges 202, the interior liner 203, the eyelets 205*a*, and the hem corner(s) 208, may be substantially the same in structure, shape, and/or configuration to the hemmed edges 2, the interior liner 3, the eyelets 5*a*, and the hem corner(s) 8 of portable bag 1, as illustrated in FIGS. 1-10 and described previously herein. Alternatively, any combination of these structural features and still others not illustrated in FIG. 12 but understood to be present by analogy to FIGS. 1-10 can be substantially different in structure, shape, and/or configuration from those present in the portable bag 1, however as may be desirable for particular scenarios or applications. Those structural features not illustrated in FIG. 12, but which may be either substantially the same or substantially different from those corresponding structures in FIGS. 1-10 may include, in a non-limiting manner, closure mechanisms, side creases, liner cavities, top surface portions, bottom surfaces and crease(s), and the like.

Portable Bag 301

While the embodiments of the portable bag 1 illustrated in FIGS. 1-10 and the portable bags 101, 201 illustrated in FIGS. 11-12 comprise various configurations of handling openings 6*a*, 6*b*, 106*a*, 106*b*, 206*a*, 206*b*, 206*c* that are integrally formed upon front and/or rear surfaces of such bags, it should be appreciated that in still other embodiments, no such handling openings may be formed upon the front and/or rear surfaces of the portable bag. Instead, for example, as illustrated in FIG. 13, one or more extension members 32 may be provided, such extension members including one or more sets of handling openings 324, 326 defined thereon.

Figure 13:
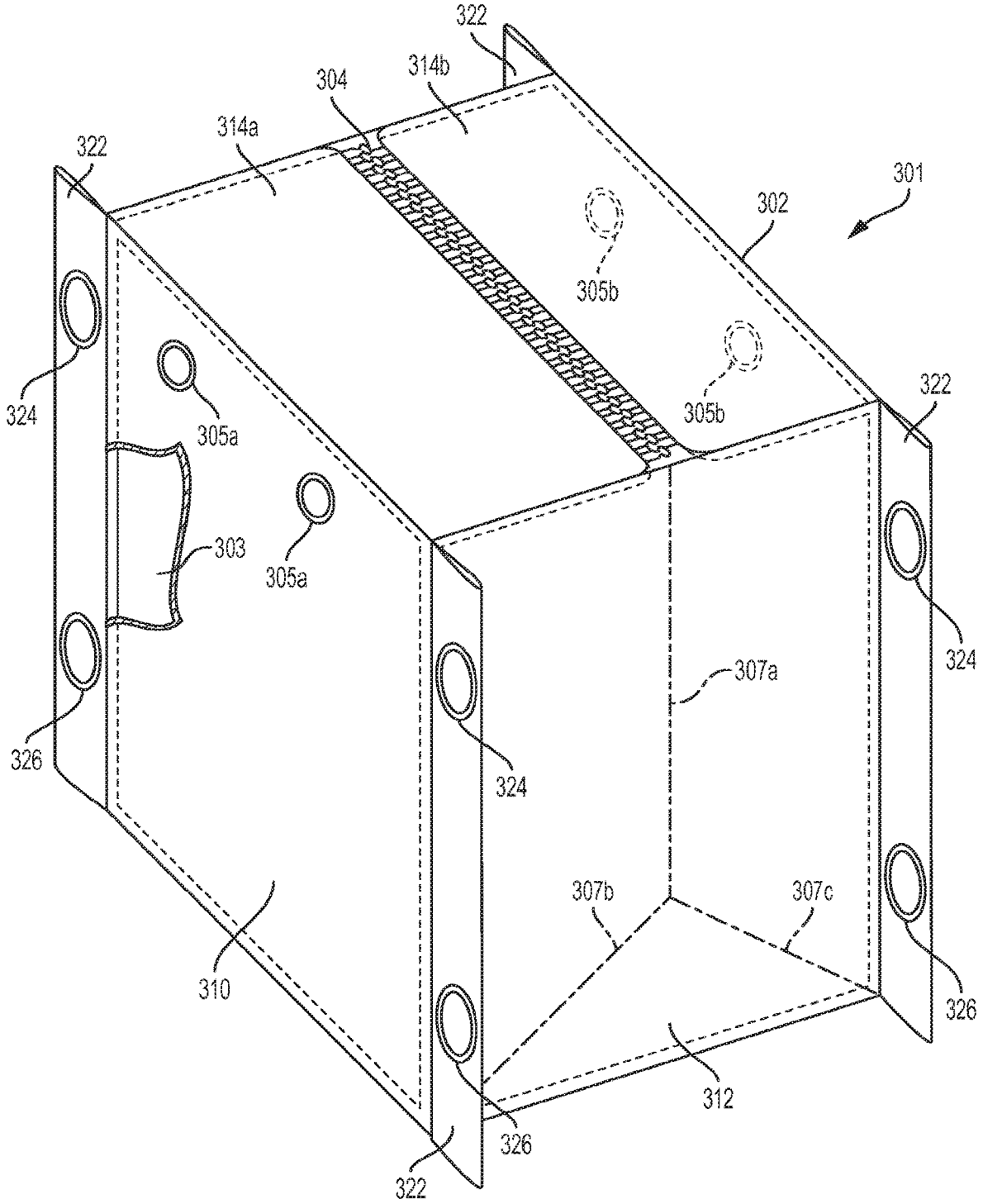
FIG. 13 is a perspective view of a portable bag 301 having integrated handling openings according to a fourth exemplary embodiment of the present invention.

With continued reference to FIG. 13, it may be understood that the one or more extension members 322 may be configured in certain embodiments as extensions of the hemmed edges 302 of the portable bag 301, such that the extension members 322 extend outwardly relative to and are at least in part formed by the hems sewn along such hemmed edges. In this manner, according to various embodiments, the extension members 322 may be flexibly movable relative to the remainder (i.e., the various central surface portions) of the portable bag 301.

According to various embodiments, as also illustrated in FIG. 13, four extension members 322 may be provided, such that one is provided along an intersection hem between each of the respective sides and front and back surfaces of the portable bag 301. In certain embodiments, only two extension members 322 may be provided, for example upon opposite and diagonally oriented corner hems. In other embodiments, two extension members 322 may be provided, both adjacent the front surface 310 of the portable bag. In still other embodiments, any of one, two, three, four, or still another quantity of extension members 322 may be provided, with such oriented vertically as illustrated in FIG. 13, or even horizontally (i.e., parallel to a top surface portion 314*a*, 314*b* of the portable bag 301.

According to various embodiments, as illustrated in FIG. 13, the extension members 322 may be configured to extend an entirety of the height of the portable bag 301. In other embodiments, however, the extension members may have a length less than that of the height of the portable bag 301. In such embodiments, the extension members may be centered about a midpoint of the front surface of the portable bag 301. In still other embodiments, the extension members 322 may be offset relative to one another, for example, where two extension members are provided on opposing and diagonal corner hems of the portable bag, one may be positioned adjacent the top surface and extend only partly toward the bottom surface, whereas the other may be positioned adjacent the bottom surface and extend only partly toward the top surface. In this manner, a counter-acting balance may be provided when handling the portable bag 301 via such extension members 322.

As also illustrated in FIG. 13, each of the extension members 322 may include a pair of handling openings 324, 326. These handling openings 324, 326 in certain embodiments are configured to pass through an entirety of the extension members 322, so as to provide a user of the portable bag 301 an opening for a hand-hold when handling or otherwise transporting the bag. As may be understood from FIG. 13, in the embodiment illustrated therein, the handling openings 324, 326 may be positioned relative to a midpoint of the front surface 310 of the portable bag 301 in substantially the same manner as the handling openings 106*a*, 106*b* of the portable bag 101, illustrated in FIG. 11 and described previously herein. In other words, as a non-limiting example, the handling openings 324, 326 may be each offset relative to the horizontal midpoint (see, by analogy, midpoint line M of FIG. 1) of the front surface 310, as illustrated in FIG. 13. In other embodiments, the offset of the handling opening 324 may differ from that of the handling opening 326. In still other embodiments, the handling openings 324, 326 may be replaced with instead a single handling opening on each extension member 322, analogous to the manner in which a single handling opening 6*a* is adjacent each side of the front surface 10 of the portable bag 1, as illustrated in FIG. 2 and described previously herein.

Remaining further with FIG. 13, according to the embodiment illustrated therein, the extension members 322 may be substantially rectangular in shape or otherwise mirror the shape of the portable bag 301 in its entirety. In other embodiments, however, it should be understood that the extension members 322 may be otherwise shaped, provided they are configured in such a manner so as to provide at least one handling opening in each thereof. As non-limiting examples, the extension members 322 could be substantially semi-circularly shaped, truncated triangularly shaped, or even rectangular or square-shaped with rounded or otherwise truncated corner regions. In these and still other embodiments, it should be understood that any rounding, truncation, curvature, and flexibility (as referenced previously) of the extension members 322 is desirable so as to minimize the likelihood of the members being caught, tangled, or otherwise "hung-up" upon external components during an automated or semi-automated bag handling or transport process.

As may also be understood from FIG. 13, the extension members 322 may be two-sided, such that in those embodiments, as illustrated, where the members are formed from hem extensions, such may be a folded member that provides an extension of, for example, front surface 310 and side surface 312 of the portable bag 301. In this manner, once so folded, the extension member 322 and (again for example) the front and side surfaces 310, 312 may be hemmed along hem line 302, so as to define an interface between such surfaces and the member.

With continued reference to FIG. 13, via the cut-out provided therein, a portion of the interior liner 303 thereof is visible adjacent the front surface 310. It should be noted that, with no integrally formed handling openings in certain embodiments of the portable bag 301, the need to define a cavity or to otherwise inset a portion of the liner 303 relative to one or more surfaces of the bag is not necessary. Such may be best understood with reference by analogy to at least FIGS. 2 and 4, illustrating portable bag 1 with its integrally formed handling openings 6*a* and the manner in which its liner 3 is configured so as to define a cavity or space 9 between surfaces of the bag and the liner adjacent the openings. In this manner, as previously described herein with reference to portable bag 1, the hands of a user thereof, when placed through the handling openings do not pass further through the liner. This also prevents inadvertent passage of a relative small package through the handling openings, also as described in detail previously herein.

Remaining with FIG. 13, it should be understood with reference thereto that although such illustrates only a perspective view of the portable bag 301, the portable bag 301 is configured according to various embodiments in substantially the same fashion as that illustrated in FIGS. 1-12, but for the interchanging of the integrally formed handling openings 6*a*, 6*b*, 106*a*, 106*b*, 206*a*, 206*b*, 206*c* described previously herein with alternative handling openings 324, 326 located upon distinctive extension members 322. Thus, it should be understood that, in the embodiment of FIG. 13, any remaining structural features of the portable bag 301 including, but not limited to, the hemmed edges 302, the eyelets 305*a*, 305*b*, the side crease lines 307*a-c*, the front surface 310, the side surface 312, the top surface portions 314*a*, 314*b*, and the closure mechanism 304 may be substantially the same in structure, shape, and/or configuration to the hemmed edges 2, the eyelets 5*a*, 5*b*, the side crease lines 7*a-c*, the front surface 10, the side surface 12, the top surface portions 14*a*, 14*b*, and the closure mechanism 4 of portable bag 1, as illustrated in FIGS. 1-10 and described previously herein. Alternatively, any combination of these structural features and still others not illustrated in FIG. 13 but understood to be present by analogy to FIGS. 1-10 can be substantially different in structure, shape, and/or configuration from those present in the portable bag 1, however as may be desirable for particular scenarios or applications. Those structural features not illustrated in FIG. 13, but which may be either substantially the same or substantially different from those corresponding structures in FIGS. 1-10 may include, in a non-limiting manner, rear surfaces, bottom surfaces and crease(s), and the like.

Portable Bag 401

Figure 14:
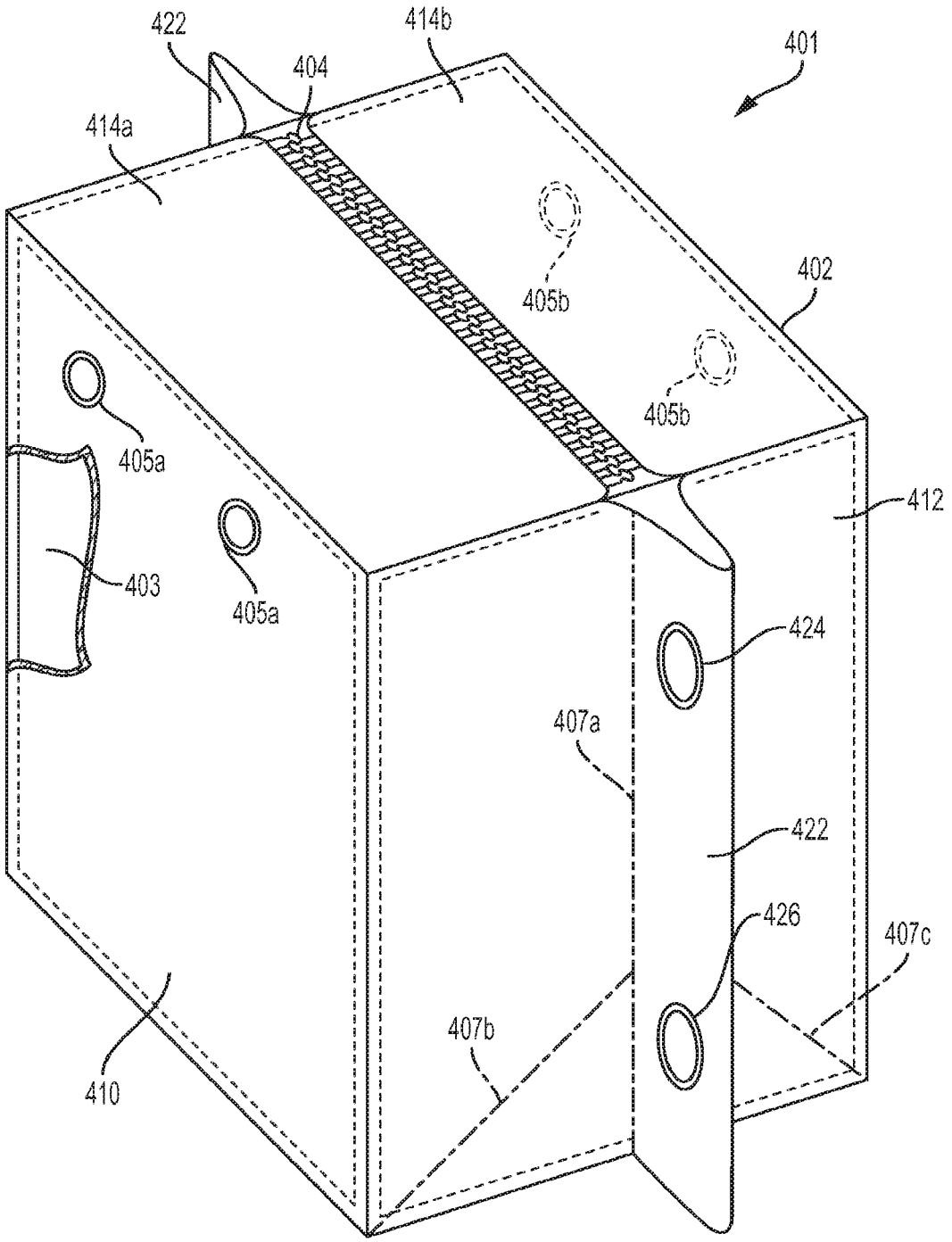
FIG. 14 is a perspective view of a portable bag 401 having integrated handling openings according to a fifth exemplary embodiment of the present invention.

Turning now to FIG. 14, illustrated therein is another exemplary embodiment of a portable bag 401. As should be readily understood, various features and components of portable bag 401 may be according to various embodiments substantially the same as those of portable bag 301, as described above, with the exception only of the location, placement, and number of the pair of crease extensions 422, as compared to the plurality of hem extensions 322 of portable bag 301 (see also, by comparison, FIG. 13). In this regard, in certain embodiments the pair of crease extensions 422 are positioned substantially along the length of a side crease 407*a* located on the side surface 412 of the portable bag 401.

In at least the illustrated embodiment, the pair of crease extensions 422 further extend to a bottom edge of the side surface 412, namely substantially adjacent a bottom surface (not illustrated) of the portable bag 401. In other embodiments, however, so as to facilitate folding of the portable bag 401 into a folded configuration (see, by analogy, FIG. 8 and a folded configuration of portable bag 1), the crease extensions 422 may be configured to run only the length of crease 407*a*. In still other embodiments, the crease extensions 422 may extend along the length of crease 407*a* and then still further along at least one of the creases 407*b*, 407*c*. In such an embodiment, as compared to that illustrated in FIG. 14, where the crease extension 422 extends further along both creases 407*b*, 407*c*, three extension openings may be provided, as compared to the two extension openings 424, 426 described below.

With reference now to the extension openings 424, 426 of FIG. 14, each may be configured in certain embodiments to pass through an entirety of the extension members 422, so as to provide a user of the portable bag 401 an opening for a hand-hold when handling or otherwise transporting the bag. As may be understood from FIG. 14, in the embodiment illustrated therein, the handling openings 424, 426 may be positioned relative to a midpoint of the front surface 410 of the portable bag 401 in substantially the same manner as the handling openings 324, 326 of the portable bag 301, illustrated in FIG. 13 and described previously herein. In other words, as a non-limiting example, the handling openings 424, 426 may be each offset relative to a horizontal midpoint of the front surface 410, as illustrated in FIG. 14. In other embodiments, the offset of the handling opening 424 may differ from that of the handling opening 426. In still other embodiments, the handling openings 424, 426 may be replaced with instead a single handling opening on each extension member 422, analogous to the manner in which a single handling opening 6*a* is adjacent each side of the front surface 10 of the portable bag 1, as illustrated in FIG. 2 and described previously herein.

Remaining further with FIG. 14, according to the embodiment illustrated therein, the extension members 422 may be substantially rectangular in shape or otherwise mirror the shape of the portable bag 401 in its entirety. In other embodiments, however, it should be understood that the extension members 422 may be otherwise shaped, provided they are configured in such a manner so as to provide at least one handling opening in each thereof. As non-limiting examples, the extension members 422 could be substantially semi-circularly shaped, truncated triangularly shaped, or even rectangular or square-shaped with rounded or otherwise truncated corner regions. In these and still other embodiments, it should be understood that any rounding, truncation, curvature, and flexibility (as referenced previously) of the extension members 422 is desirable so as to minimize the likelihood of the members being caught, tangled, or otherwise "hung-up" upon external components during an automated or semi-automated bag handling or transport process. As described previously herein, one or more of the extension members 422 may not extend an entirety of a length or height of the portable bag 401; however, so as to facilitate folding thereof, the extension members in many embodiments follow (or are otherwise positioned upon and along) at least one crease line (e.g., 407*a-c*) formed on the side surface 412 of the portable bag.

As may also be understood from FIG. 14, the extension members 422 may be two-sided, such that in those embodiments, as illustrated, where the members are formed from hem extensions, such may be a folded member that provides an extension of at least the crease line 407*a*, which may itself in certain embodiments also be hemmed. In this manner, once so folded, the extension member 422 and (again for example) the crease line 407*a* may be hemmed or otherwise secured relative to one another so as to define an interface between the same.

With continued reference to FIG. 14, via the cut-out provided therein, a portion of the interior liner 403 thereof is visible adjacent the front surface 410. It should be noted that, with no integrally formed handling openings in certain embodiments of the portable bag 401, the need to define a cavity or to otherwise inset a portion of the liner 403 relative to one or more surfaces of the bag is not necessary. Such may be best understood with reference by analogy to at least FIGS. 2 and 4, illustrating portable bag 1 with its integrally formed handling openings 6*a* and the manner in which its liner 3 is configured so as to define a cavity or space 9 between surfaces of the bag and the liner adjacent the openings. Such should also be understood with reference by analogy to FIG. 13, wherein the liner 303 of the portable bag 301 illustrated therein likewise has no need for any liner-defined cavities or openings.

Remaining with FIG. 14, it should be understood with reference thereto that although such illustrates only a perspective view of the portable bag 401 and certain features thereof, the portable bag 401 is configured according to various embodiments in substantially the same fashion as those illustrated in FIGS. 1-13, but for the interchanging of the integrally formed handling openings 6*a*, 6*b*, 106*a*, 106*b*, 206*a*, 206*b*, 206*c* described previously herein and the hem extension handling openings 324, 326 with alternative crease extension handling openings 424, 426 located upon distinctive extension members 422. Thus, it should be understood that, in the embodiment of FIG. 14, any remaining structural features of the portable bag 401 including, but not limited to, the hemmed edges 402, the eyelets 405*a*, 405*b*, the side crease lines 407*a-c*, the front surface 410, the side surface 412, the top surface portions 414*a*, 414*b*, and the closure mechanism 404 may be substantially the same in structure, shape, and/or configuration to the hemmed edges 2, the eyelets 5*a*, 5*b*, the side crease lines 7*a-c*, the front surface 10, the side surface 12, the top surface portions 14*a*, 14*b*, and the closure mechanism 4 of portable bag 1, as illustrated in FIGS. 1-10 (or comparable features as illustrated in any of FIGS. 11-13), all as described previously herein. Alternatively, any combination of these structural features and still others not illustrated in FIG. 14 but understood to be present by analogy to FIGS. 1-13 can be substantially different in structure, shape, and/or configuration from those present in the portable bags 1, 101, 201, 301, however as may be desirable for particular scenarios or applications. Those structural features not illustrated in FIG. 14, but which may be either substantially the same or substantially different from those corresponding structures in FIGS. 1-13 may include, in a non-limiting manner, rear surfaces, bottom surfaces and crease(s), and the like.

Portable Bag 501

Figure 15:
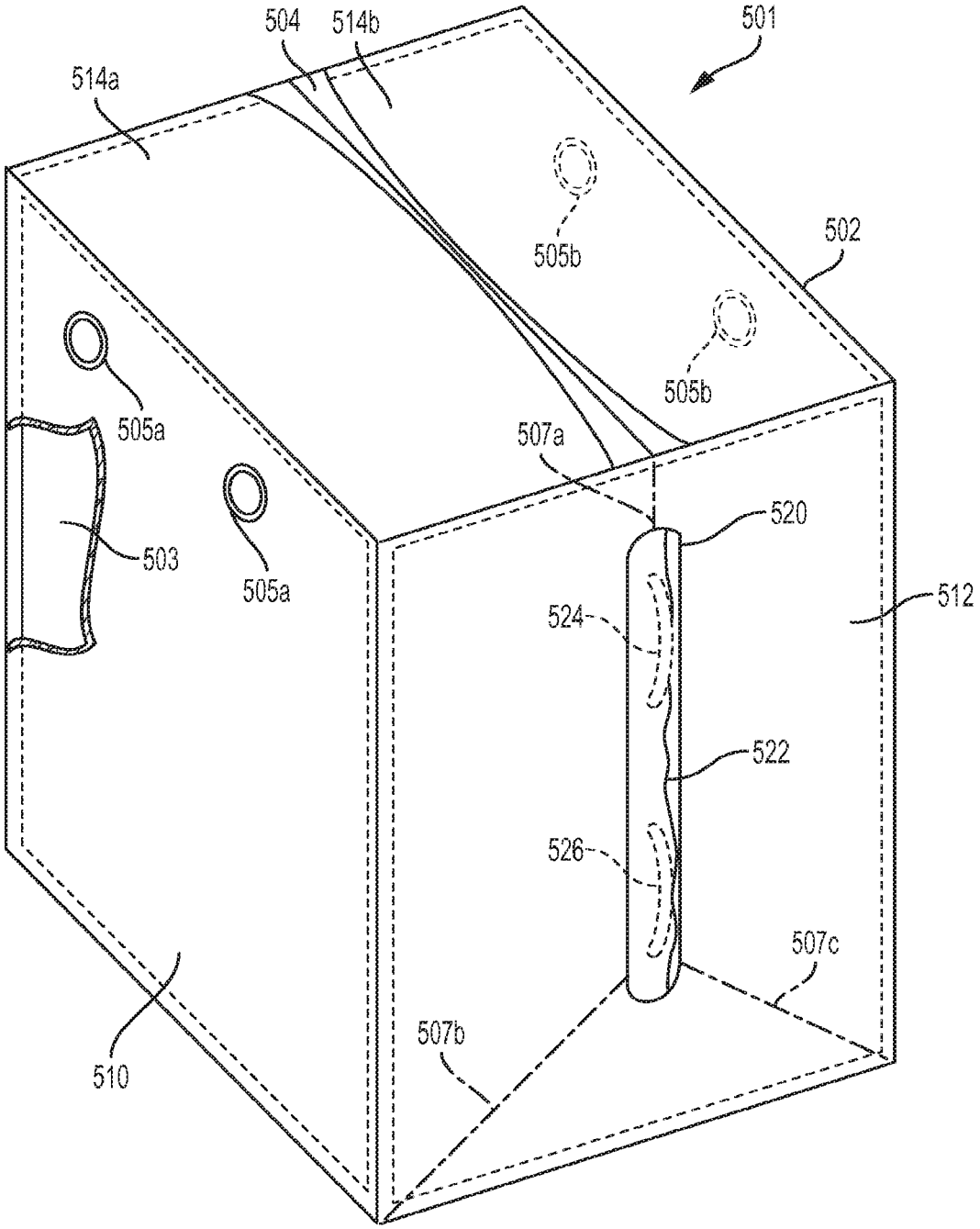
FIG. 15 is a perspective view of a portable bag 501 having integrated handling openings according to a sixth exemplary embodiment of the present invention.

Turning now to FIG. 15, illustrated therein is another exemplary embodiment of a portable bag 501. Two primary differences exist between this embodiment of portable bag 501, as compared to the bags 1, 101, 201, 301, and 401 described previously herein. First, instead of a zipper-containing closure mechanism, the closure mechanism 504 of portable bag 501 is magnetically based. In at least the illustrated embodiment, two magnetic strips are included, one attached relative to a portion of each of the top surfaces 514*a*, 514*b*, essentially in place of the zipper-containing closure mechanism. In other embodiments, magnetic dots, spaced periodically along a length of the illustrated closure mechanism 504 may be provided instead of a strip extending along the entirety of the length thereof. It should be understood in such embodiments that the magnetic dots will be spaced such that none of the small packages placed within the portable bag 501 and upon closure thereof can inadvertently pass through any opening formed by the spacing between the magnetic dots.

Although illustrated as a centrally positioned magnetic strip containing closure mechanism 504, it should also be understood that the strip may be otherwise oriented on the top surfaces 514*a*, 514*b* of the portable bag 501. In at least one embodiment, a side or overlapping flap configuration may be provided with a magnetic closure mechanism, as for example illustrated in FIGS. 17C-D and as will be described in further detail below.

The second distinguishing feature of the portable bag 501, as compared to the previously described bags 1, 101, 201, 301, and 401, is the replacement of integrally formed handling openings 6*a*, 106*a*, 106*b*, 206*a*, 206*b*, 206*c* and extension members 322, 422 with a flap covering 520 and a set of handles 524, 526 instead of handle openings. The flap covering 520 may, in certain embodiments have a flap opening 522 or slit formed therein, such that upon opening thereof, the set of handles 524, 526 may be accessed by a user or person handling the portable bag 501. At other times, the flap covering 520 is configured in these and other embodiments to cover or otherwise substantially overlay the handles, so as to substantially reduce the likelihood of the handles 524, 526 getting caught on any automated machinery components configured to process, load, or otherwise handle the portable bag 501.

In certain embodiments, the set of handles 524, 526 may be made of a plastic or rigid material; in other embodiments, the handles may be made of rope or any of a variety of alternative materials having some degree of strength and as commonly known and understood in the art. In other embodiments, the handles 524, 526 may be retractable when not in use, much like the handle atop a computer monitor box, as a non-limiting example. And while in the illustrated embodiment, a set of two handles 524, 526 are illustrated, in yet other embodiments, a single handle, or three, or four, or more handles may be provided, as may be desirable. For example, four handles could be provided, with the two (as illustrated) extending along the crease 507*a*, along with two additional handles positioned one along each of the creases 507*b*, 507*c*. In such embodiments, the additional handles may likewise be covered by the flap covering 520 or by separately formed flap coverings, each having respective flap openings 522 formed therein.

Remaining with FIG. 15, it should be understood with reference thereto that although such illustrates only a perspective view of the portable bag 501 and certain features thereof, the portable bag 501 is configured according to various embodiments in substantially the same fashion as those illustrated in FIGS. 1-14, but for the incorporation of a flap covering 520 and handles 524, 526 (instead of handling openings or extension members) and a magnetic-based closure mechanism 504 (instead of the zipper of, for example, FIG. 1). In certain embodiments, however, the portable bag 501 may only include one of these two features, such that, as a non-limiting example, a bag may be provided having the flap covering and associated handles, but with a zipper (or otherwise based) closure mechanisms. Any of a variety of combinations are indeed possible, with further reference to FIGS. 17A-D, as will be described further below.

Thus, it should be understood that, in the embodiment of FIG. 15, any remaining structural features of the portable bag 501 including, but not limited to, the hemmed edges 502, the liner 503, the eyelets 505*a*, 505*b*, the side crease lines 507*a-c*, the front surface 510, the side surface 512, and the top surface portions 514*a*, 514*b* may be substantially the same in structure, shape, and/or configuration to the hemmed edges 2, the eyelets 5*a*, 5*b*, the side crease lines 7*a-c*, the front surface 10, the side surface 12, and the top surface portions 14*a*, 14*b* of portable bag 1, as illustrated in FIGS. 1-10 (or comparable features as illustrated in any of the bag embodiments of FIGS. 11-14), all as described previously herein. Alternatively, any combination of these structural features and still others not illustrated in FIG. 15 but understood to be present by analogy to FIGS. 1-14 can be substantially different in structure, shape, and/or configuration from those present in the portable bags 1, 101, 201, 301, 401, however as may be desirable for particular scenarios or applications. Those structural features not illustrated in FIG. 15, but which may be either substantially the same or substantially different from those corresponding structures in FIGS. 1-14 may include, in a non-limiting manner, rear surfaces, bottom surfaces and crease(s) therein/thereon, and the like.

Portable Bag 601

Figure 16:
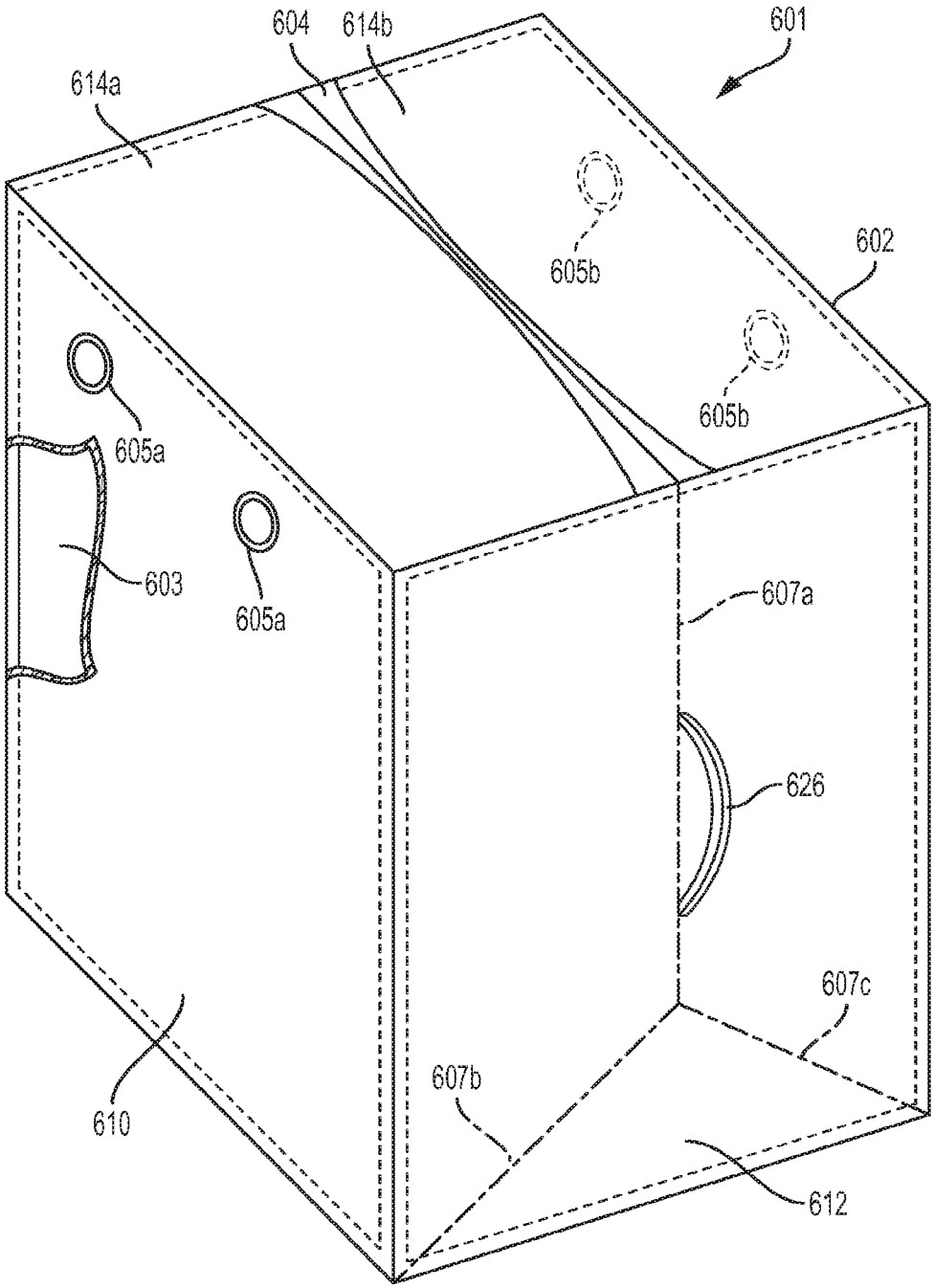
FIG. 16 is a perspective view of a portable bag 601 having integrated handling openings according to a seventh exemplary embodiment of the present invention.

Turning now to FIG. 16, illustrated therein is another exemplary embodiment of a portable bag 601. The primary difference between this embodiment of portable bag 601, as compared to the portable bag 501 described previously herein is the absence herein of any sort of flap covering, leaving instead an exposed handle 626. A magnetic-based closure mechanism 604 is also provided in the illustrated embodiment; although in other embodiments any of the various closure mechanisms described elsewhere herein may be substituted therewith.

As illustrated in FIG. 16, handle 626 may be positioned substantially along crease 607. In this manner, when the portable bag 601 is folded (see, by analogy, folded configuration of FIG. 8), the handle 626 is recessed relative to an outer periphery or edge of the folded configuration, such that the risk of the handle being caught or otherwise hung-up with or tangled in external components such as automated machinery for handling the portable bag 601 is substantially reduced or otherwise minimized. Still further, although a single handle 626 is illustrated in FIG. 16, it should be understood that, as with embodiments 1, 101, 201, 301, 401, and 501, that a corresponding handle may, in certain embodiments, be provided on the opposing side (not illustrated) of the bag. Of course, in still other embodiments relative to any of the bags described elsewhere herein, a handle or handles may only be provided on a single side of the bag, as mentioned previously herein. Additionally, on each side, two, three, or more handles may be provided, as opposed to the single handle of the illustrated embodiment of FIG. 16. As a non-limiting example, handles may be provided along each of the creases 607*a-c*, for a total of three handles on each side of the portable bag 601. Any of a variety of configurations are, in fact, possible in this regard without departing from the scope and nature of the present inventive concept.

Remaining with FIG. 16, it should be understood with reference thereto that although such illustrates only a perspective view of the portable bag 601 and certain features thereof, the portable bag 601 is configured according to various embodiments in substantially the same fashion as those illustrated in FIGS. 1-14, but for the incorporation of an exposed handle 626 (instead of handling openings or extension members or a handle covered by a flap) and a magnetic-based closure mechanism 604 (instead of the zipper of, for example, FIG. 1). In certain embodiments, however, the portable bag 601 may only include one of these two features, such that, as a non-limiting example, a bag may be provided having the flap covering and associated handles, but with a zipper (or otherwise based) closure mechanisms. Any of a variety of combinations are indeed possible, with further reference to FIGS. 17A-D, as will be described further below.

Thus, it should be understood that, in the embodiment of FIG. 16, any remaining structural features of the portable bag 601 including, but not limited to, the hemmed edges 602, the liner 603, the eyelets 605*a*, 605*b*, the side crease lines 607*a-c*, the front surface 610, the side surface 612, and the top surface portions 614*a*, 614*b* may be substantially the same in structure, shape, and/or configuration to the hemmed edges 2, the eyelets 5*a*, 5*b*, the side crease lines 7*a-c*, the front surface 10, the side surface 12, and the top surface portions 14*a*, 14*b* of portable bag 1, as illustrated in FIGS. 1-10 (or comparable features as illustrated in any of the bag embodiments of FIGS. 11-15), all as described previously herein. Alternatively, any combination of these structural features and still others not illustrated in FIG. 16 but understood to be present by analogy to FIGS. 1-15 can be substantially different in structure, shape, and/or configuration from those present in the portable bags 1, 101, 201, 301, 401, 501, however as may be desirable for particular scenarios or applications. Those structural features not illustrated in FIG. 16, but which may be either substantially the same or substantially different from those corresponding structures in FIGS. 1-15 may include, in a non-limiting manner, rear surfaces, bottom surfaces and crease(s) therein/thereon, and the like.

Portable Bag 701

Figure 17A:
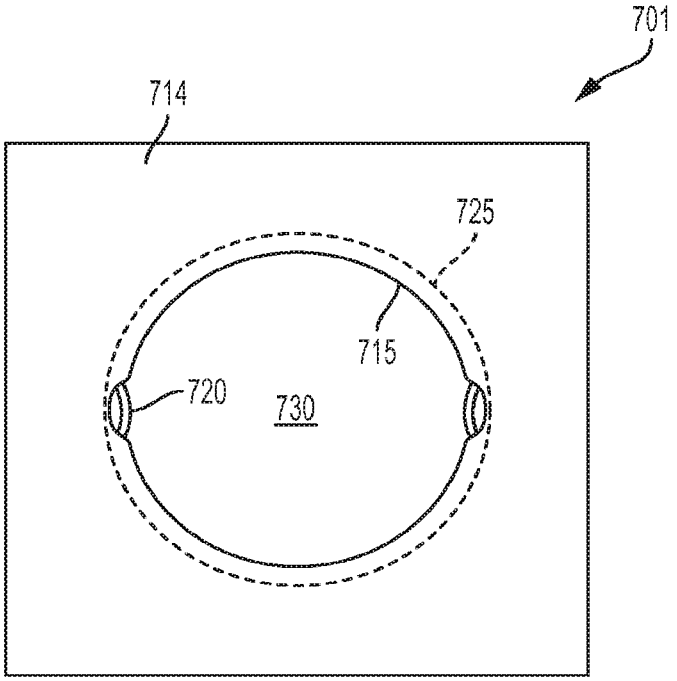
FIG. 17A is a top view of a portable bag 701 having integrated handling openings according to an eighth exemplary embodiment of the present invention.

Illustrated in FIG. 17A is an alternative top surface 714 of a portable bag 701. But for the alternative features described here with reference to this figure, it should be understood that all of the remaining structural features and characteristics of the portable bag 701 may be substantially the same as those of any of the portable bags 1, 101, 201, 301, 401, 501, 601, as described previously herein. In certain embodiments, the structural features and characteristics of the portable bag 701 may include a combination or selected mixture of various features of the portable bags 1, 101, 201, 301, 401, 501, 601, however, as may be desirable for a particular application. Such should not be considered a departure from the scope and nature of the inventive concept described herein throughout. In still other embodiments, of course, one or more of the remaining structural features and characteristics of the portable bag 701 that are not illustrated in FIG. 17A may be substantially different from those corresponding features of portable bags 1, 101, 201, 301, 401, 501, 601, also as may be desirable.

Remaining with FIG. 17A, it may be seen therein that instead of a zipper-based closure mechanism, as described previously herein with respect to at least the embodiment of portable bag 1, a selectively rope-tied closure mechanism 715 may be provided. This mechanism 715 may a rope or string element 720, a channel defining seam or hem 725, and an opening 730, defined substantially by the mechanism 715. Such "draw-string" type closure mechanisms are commonly known and understood in the art, but illustrated here for purposes of an alternative possible closure mechanism. In certain embodiments, the opening 730 may be shaped other than circular, for example, in an oval, square, oblong, triangular, or other shape, however as may be desirable. It should be understood, however, that in all of these and still other embodiments, the size of the opening 730 should be at least equal to the distance of spacing between the eyelets provided in the portable bag 701, as such eyelets are described further below in a general fashion.

Portable Bag 801

Figure 17B:
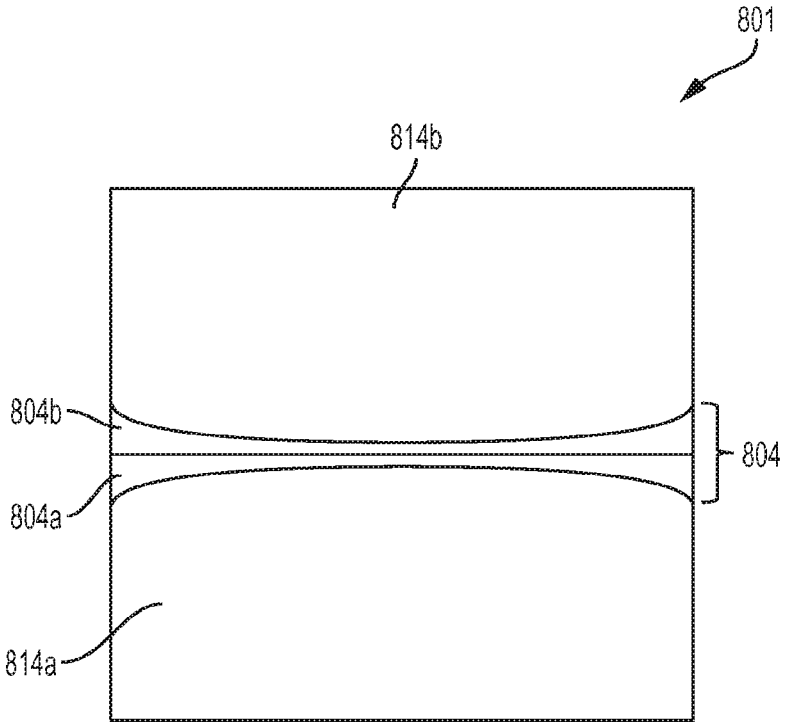
FIG. 17B is a top view of a portable bag 801 having integrated handling openings according to a ninth exemplary embodiment of the present invention.

Illustrated in FIG. 17B is an alternative top surface 814*a*, 814*b* of a portable bag 801. But for the alternative features described here with reference to this figure, it should be understood that all of the remaining structural features and characteristics of the portable bag 801 may be substantially the same as those of any of the portable bags 1, 101, 201, 301, 401, 501, 601, 701, as described previously herein. In certain embodiments, the structural features and characteristics of the portable bag 801 may include a combination or selected mixture of various features of the portable bags 1, 101, 201, 301, 401, 501, 601, 701, however as may be desirable for a particular application. Such should not be considered a departure from the scope and nature of the inventive concept described herein throughout. In still other embodiments, of course, one or more of the remaining structural features and characteristics of the portable bag 801 that are not illustrated in FIG. 17B may be substantially different from those corresponding features of portable bags 1, 101, 201, 301, 401, 501, 601, 701, also as may be desirable.

In FIG. 17B, the closure mechanism 804 comprises a set of magnetic strips 804*a*, 804*b*, as have been described previously herein with reference to FIGS. 15-16 and portable bags 501, 601. As described, the magnetic strips 804*a*, 804*b* may comprise two opposing strips that are configured to mate with one another so as to hold the top surfaces 814*a*, 814*b* securely closed relative to each other. Still further, as described previously herein, the magnetic strips 804*a*, 804*b* may be substantially continuous along a length of the top surfaces 814*a*, 814*b*, particularly at an intersection thereof; in other embodiments, as also described previously herein, the magnetic strips may be replaced with a plurality of spaced apart magnetic dots or a series of magnetic fibers (e.g., fibers made from a magnetic material). In any of these and still other embodiments, the top surfaces 814*a*, 814*b* may be further biased into a closed orientation, until the portable bag 801 is placed upon an associated rack (see e.g., wire rack 22) or the like, in which case the positioning thereof thereon may bias the top surfaces 814, 814*b* into an open orientation (see, by analogy, FIG. 10).

Additional details of such a rack 22 or external processing component and any prongs or tusks associated therewith may be understood with reference to FIGS. 25 and 26, which illustrated respective exemplary assemblies 2000 and 2100, which may be used in conjunction with the portable bag 801 (and with any of the portable bag embodiments described herein). With reference to FIG. 25, it may be seen therein a frame 2001 that may be configured to support rack (or tusk) 22 mounting supports 2002. These supports 2002 may further support slides 2003 (or tubes or the like) configured for a plurality of packages to travel thereupon. A continuous angle may be provided, such that the supports 2002 and the slides 2003 are configured to align substantially with the rack 22, which may be mounted in certain embodiments to the supports 2002 as illustrated (or otherwise). In certain embodiments, the racks 22 may extend outwardly from the supports, defining a shape thereof as in FIG. 10 (for example); in other embodiments, such as that illustrated in FIG. 25, the racks 22 may be configured to provide not only for a bag hanging portion to receive bag 801, but also a bag storage area 2004, where additional bags may be retained, for example in a closed configuration (as described elsewhere herein) until such may be retrieved and clipped as illustrated in FIG. 25 (and FIG. 10) adjacent the ends or tips of the rack 22. Of course, alternative configurations of external processing components and/or assemblies for use with the portable bag 801 (or those bags of other embodiments described herein) may be envisioned. An additional exemplary assembly 2100 is illustrated in FIG. 26, configured similarly but with differently oriented supports and a dual slide/rack configuration, as compared to the single rack configuration illustrated in FIG. 25.

Portable Bag 901

Figure 17C:
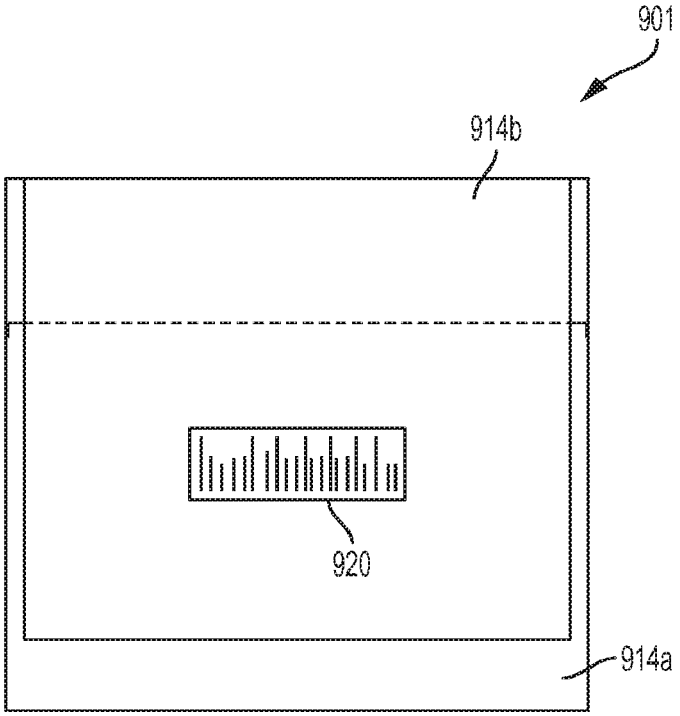
FIG. 17C is a top view of a portable bag 901 having integrated handling openings according to a tenth exemplary embodiment of the present invention.

Illustrated in FIG. 17C is an alternative top surface 914*a*, 914*b* of a portable bag 901. But for the alternative features described here with reference to this figure, it should be understood that all of the remaining structural features and characteristics of the portable bag 901 may be substantially the same as those of any of the portable bags 1, 101, 201, 301, 401, 501, 601, as described previously herein. In certain embodiments, the structural features and characteristics of the portable bag 901 may include a combination or selected mixture of various features of the portable bags 1, 101, 201, 301, 401, 501, 601 however, as may be desirable for a particular application. Such should not be considered a departure from the scope and nature of the inventive concept described herein throughout. In still other embodiments, of course, one or more of the remaining structural features and characteristics of the portable bag 901 that are not illustrated in FIG. 17C may be substantially different from those corresponding features of portable bags 1, 101, 201, 301, 401, 501, 601, also as may be desirable.

In FIG. 17C in particular, it may be seen that instead of two "half-lid" type portions of the top surface (see, by analogy, the top surface of portable bag 1), such may instead have two or more overlapping portions of the top surface, namely 914*a*, 914*b*. Neither may extend, as illustrated, an entirety of a width or depth of the portable bag 901 in certain embodiments; in other embodiments, each may extend an entirety of a width or depth of the bag, as may be desirable, depending upon a degree of certain of closure desired.

Although not illustrated in FIG. 17C, it should also be understood that the overlapping surfaces 914*a*, 914*b* may be secured relative to one another in certain embodiments in an adhesive manner with bonding glue, Velcro®, snaps, or the like. In other embodiments, the overlapping surfaces 914*a*, 914*b* may be secured relative to one another in any of the variety of fashions of closure mechanisms, as previously discussed herein (e.g., zippers, magnets, draw-string-type closures, a spring-biased mechanism, or the like). In certain of these and still other embodiments, as mentioned, the overlapping surfaces 914*a*, 914*b* may be biased into either an open or closed configuration, however as may be desirable. In at least one embodiment, such bias may be created at least in part by a spring-loaded mechanism and/or configuration (not illustrated).

As illustrated in FIG. 17C, a machine-readable barcode 920 may also be provided on the top surface portion 914*b*. Such a feature may be provided further on any of the remaining portable bags 1, 101, 201, 301, 401, 501, 601, 701, 801, 1001, as described elsewhere herein.

Portable Bag 1001

Figure 17D:
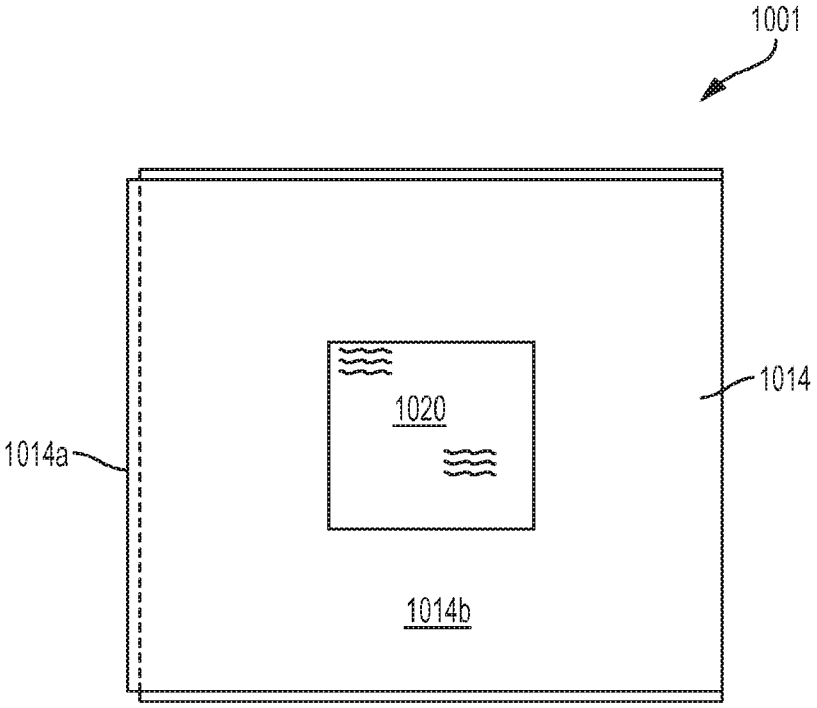
FIG. 17D is a top view of a portable bag 1001 having integrated handling openings according to an eleventh exemplary embodiment of the present invention.

Illustrated in FIG. 17D is an alternative top surface 1014*a*, 1014*b* of a portable bag 1001. But for the alternative features described here with reference to this figure, it should be understood that all of the remaining structural features and characteristics of the portable bag 1001 may be substantially the same as those of any of the portable bags 1, 101, 201, 301, 401, 501, 601, as described previously herein. In certain embodiments, the structural features and characteristics of the portable bag 1001 may include a combination or selected mixture of various features of the portable bags 1, 101, 201, 301, 401, 501, 601, however, as may be desirable for a particular application. Such should not be considered a departure from the scope and nature of the inventive concept described herein throughout. In still other embodiments, of course, one or more of the remaining structural features and characteristics of the portable bag 1001 that are not illustrated in FIG. 17D may be substantially different from those corresponding features of portable bags 1, 101, 201, 301, 401, 501, 601, also as may be desirable.

With focus upon FIG. 17D, it may be understood with comparison to FIG. 17C that herein, in contrast with the two overlapping portions found there, the configuration of the portable bag 1001 according to various embodiments may contain a single top surface 1014. The top surface 1014 may in certain embodiments have two portions, namely a top portion 1014*b* that solely restricted to within a perimeter defined by the top surface 1014 of the portable bag 1001, and a side portion 1014*a* that represents an overlaying of the top surface 1014 over and around at least one edge of the portable bag 1001. In this manner, at least a portion of the surface 1014 extends down and over at least one side (or front or back) of the portable bag 1001. In other embodiments, an underlying top portion (not illustrated or numbered) may lay under the top portions 1014*a*, 1014*b*, so as to provide a dual coverage and thus substantially reduce the likelihood of one or more packages inadvertently falling out of the portable bag 1001 upon filling and closing of the same.

Also illustrated in FIG. 17D is an exemplary shipping label 1020, as may be placed on the top surface 1014 of the portable bag 1001. Such may contain shipping address data, along with tracking and still other carrier transport-related data, as such is commonly known and understood to involve in the art. The shipping label 1020 may be alternatively placed on any surface of the portable bag 1001, as opposed to the illustrated top surface 1014 placement. Still further, the shipping label 1020 illustrated with reference to portable bag 1001 may likewise be applied to any of portable bags 1, 101, 201, 301, 401, 501, 601, 701, 801, 901, as may be desirable.

Portable Bag 1101

Figure 18:
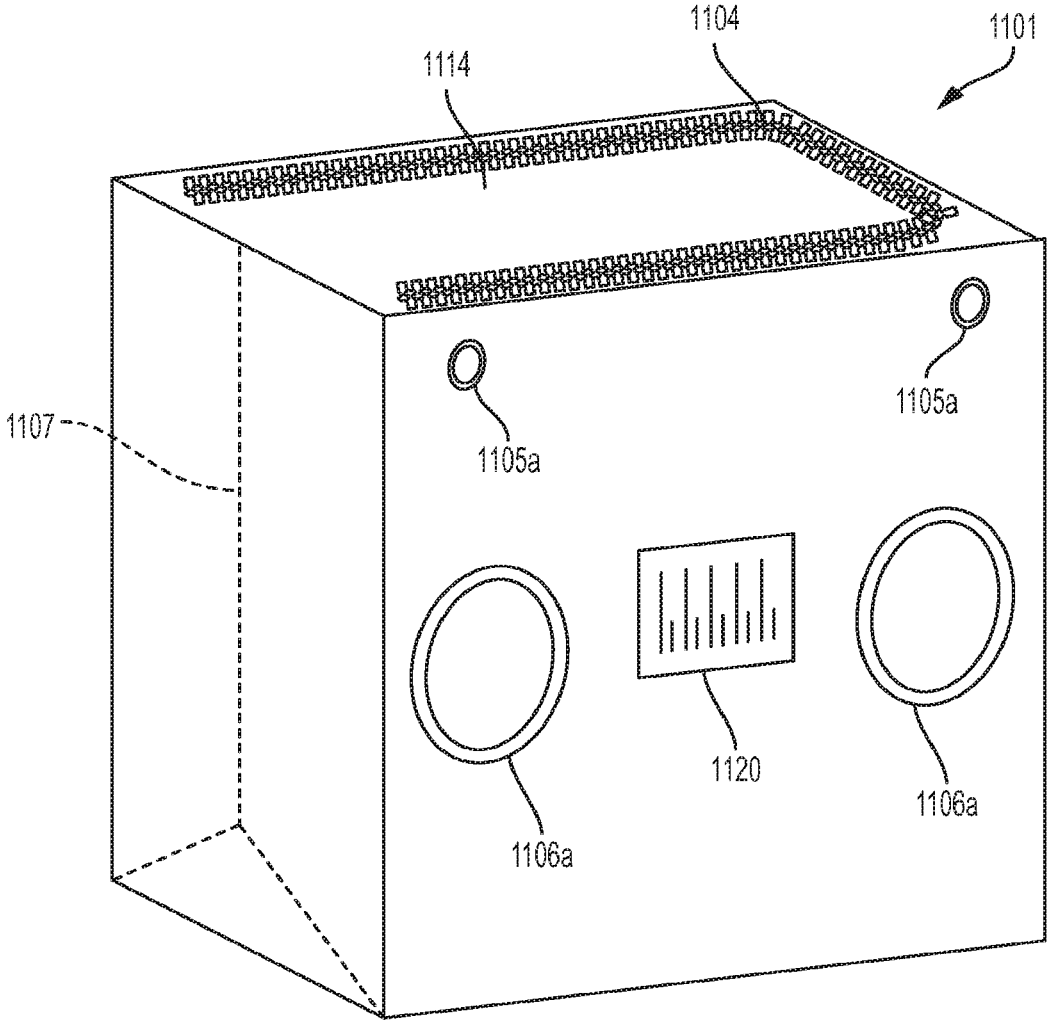
FIG. 18 is a perspective view of a portable bag 1101 having integrated handling openings according to a twelfth exemplary embodiment of the present invention.

Turning now to FIG. 18, illustrated therein is another exemplary embodiment of a portable bag 1101. The primary difference between this embodiment of the portable bag 1101, as compared to any of those previously described herein is a closure mechanism 1104 (as illustrated, a zipper) that is substantially U-shaped and extending along at least three edges of a top surface 1114 of the portable bag. Although illustrated as a zipper in FIG. 18, it should be understood that the closure mechanism 1104 may in other embodiments be magnetically or otherwise based, as previously described herein, and nevertheless U-shaped, as presently illustrated. In still other embodiments, the closure mechanism 1104 may be otherwise shaped, for example L-shaped, in which the closure mechanism would extend along only two edges of the top surface 1114 of the portable bag 1101.

According to various embodiments, where a U-shaped closure mechanism 1104 is provided, such may extend substantially along an entirety of each of the corresponding three edges of the top surface 1114 of the portable bag 1101. In other embodiments, the closure mechanism 1104 may extend along an entirety of at least one of the three edges and only partially along a length of the two remaining edges, as may be desirable. In still other embodiments, the closure mechanism 1104 may be partially inset relative to all three edges of the top surface 1114, such that the mechanism only extends partially along a length of all three edges, for example, as illustrated and described elsewhere herein with respect to at least FIG. 24.

Remaining with FIG. 18, it should be understood with reference thereto that although such illustrates only a perspective view of the portable bag 1101 and certain features thereof, the portable bag 1101 is configured according to various embodiments in substantially the same fashion as those illustrated in FIGS. 1-16, but for the incorporation of a U-shaped closure mechanism 1104. Thus, it should be understood that, in the embodiment of FIG. 18, any remaining structural features of the portable bag 1101 including, but not limited to, the illustrated eyelets 1105*a*, the side crease lines 1107, the handling openings 1106*a*, and the shipping indicia 1120 may be substantially the same in structure, shape, and/or configuration to the corresponding features illustrated in any of at least FIGS. 1-16, all as described previously herein. Alternatively, any combination of these structural features and still others not illustrated in FIG. 18 but understood to be present by analogy to FIGS. 1-16 can be substantially different in structure, shape, and/or configuration from those present in the portable bags 1, 101, 201, 301, 401, 501, 601, etc., however as may be desirable for particular scenarios or applications. Those structural features not illustrated in FIG. 18, but which may be either substantially the same or substantially different from those corresponding structures in FIGS. 1-16 may include, in a non-limiting manner, rear surfaces, bottom surfaces and any crease(s) contained therein/thereon, and the like.

Portable Bag 1201

Figure 19:
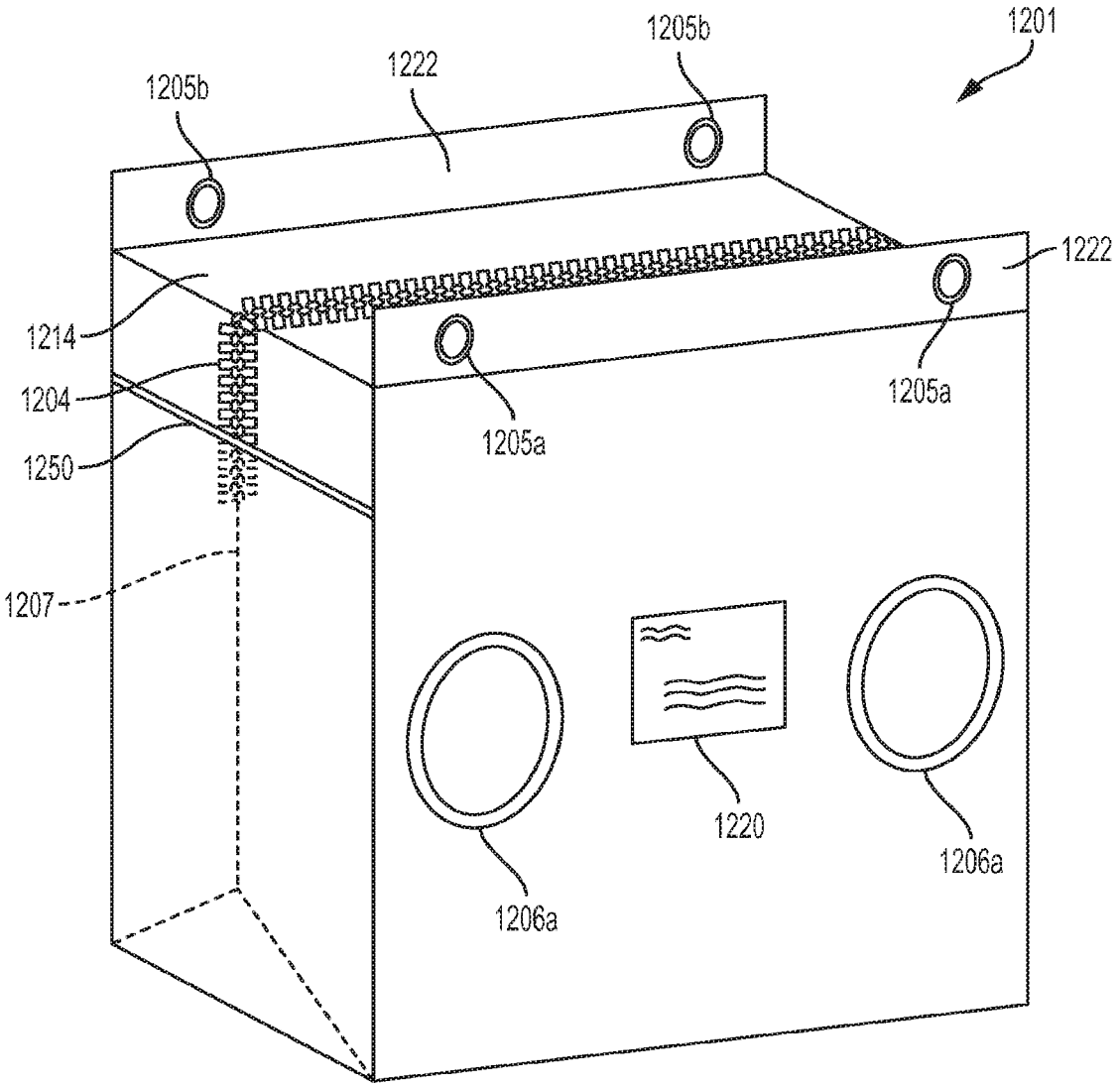
FIG. 19 is a perspective view of a portable bag 1201 having integrated handling openings according to a thirteenth exemplary embodiment of the present invention.

Turning now to FIG. 19, illustrated therein is another exemplary embodiment of a portable bag 1201. One non-limiting difference between this embodiment of the portable bag 1201, as compared to any of those previously described herein is a closure mechanism 1204 (as illustrated, a zipper) that extends not only across a top surface 1214 of the portable bag but that also extends at least partially onto at least one side surface of the portable bag. Another non-limiting difference is the provision in this embodiment of the portable bag 1201 of at least one side pocket 1250 or flap, into which the elongated closure mechanism 1204 extends. Still another non-limiting difference lies in the provision of one or more eyelet hem extensions 1222 along an edge or edges of the top surface 1214 of the portable bag 1201.

As may be understood with reference to FIG. 19, the side pocket 1250 or flap may extend substantially along an entirety of a width of at least one side surface of the portable bag, such that the closure mechanism 1204 (as illustrated, a zipper) may be securely tucked or otherwise retained within the side pocket upon closure of the bag. In this manner, automated handling of the portable bag 1201 may be optimized, in that the likelihood of catching or tangling of the closure mechanism 1204 with external components is reduced. In other embodiments, as may be desirable, the side pocket 1250 or flap may extend only along a portion of the width of at least one side surface. In still other embodiments, the side pocket 1250 or flap is provided on both side surfaces of the portable bag. In any of these and still other embodiments, it should be understood that the side pocket 1250 or flap is provided so as to minimize the existence of loose or dangling portions of the closure mechanism; as such, the side pocket 1250 or flap may be alternatively configured, provided such objective remains sufficiently satisfied.

With continued reference to FIG. 19, it may be seen that, as compared to the various embodiments of portable bags described previously herein, the eyelets 1205*a*, 1205*b* thereof are provided on top surface hem extensions 1222 that extend substantially along an entirety of two respective edges of the top surface 1214 of the portable bag. These hem extensions 1222 may be configured substantially in the same fashion as those described previously herein and configured for containing handling openings thereon; in other embodiments, as a non-limiting example, the hem extensions 1222 may formed from a single sided piece of material. In certain embodiments, as illustrated, the hem extensions 1222 may be placed on the outside of the bag; in other embodiments, the hem extensions may be internally configured, such that they are accessible after opening of the closure mechanism (e.g., after unzipping of the zipper), such that the hem extensions 1222 may thus be folded upward to engage the tusks or prongs of an associated wire rack or dispensing component. In this manner, upon subsequent closure of the portable bag 1201 upon packing thereof, the hem extensions 1222 would be returned internal to the bag and thus substantially reduce any likelihood of tangling thereof with external processing components.

In still other embodiments, the hem extensions 1222 may extend only a portion of the respective edges of the top surface 1214, as may be desirable. For example, where four eyelets 1205*a*, 1205*b* are provided, four hem extensions 1222 may be provided, as compared to the two presently illustrated. As another non-limiting example, one or more edges of the hem extensions 1222 may be rounded or otherwise curved so as to substantially reduce the likelihood of any sharp corners or edges becoming tangled or otherwise caught in processing components external to the portable bag 1201. Indeed, any of a variety of configurations are possible, provided the eyelets 1205*a*, 1205*b* are configured for receipt of prongs or tusks of an associated wire rack, as has been described previously herein with respect to other embodiments. Additional details of such a rack or external processing components or the like and/or any prongs or tusks associated therewith may be understood with reference to FIGS. 25-26, as described elsewhere herein, but also applicable for use with the portable bags 1201 of the present embodiment.

Remaining with FIG. 19, it should be understood with reference thereto that although such illustrates only a perspective view of the portable bag 1201 and certain features thereof, the portable bag 1201 is configured according to various embodiments in substantially the same fashion as those illustrated in FIGS. 1-16 and 18, but for the incorporation of an extended closure mechanism 1204, at least one side pocket 1250 configured to retain and secure ends of the closure mechanism, and two or more eyelet hem extensions 1222. It should be understood, of course, that in still other embodiments, any combination of these features may be provided, meaning that the provision of any one is independent relative to the provision of the others.

Notwithstanding the above, it should be understood that, in the embodiment of FIG. 19, any remaining structural features of the portable bag 1201 including, but not limited to, the illustrated eyelets 1205*a*, 1205*b* themselves, the side crease lines 1207, the handling openings 1206*a*, and the shipping indicia 1220 may be substantially the same in structure, shape, and/or configuration to the corresponding features illustrated in any of at least FIGS. 1-18, all as described previously herein. Alternatively, any combination of these structural features and still others not illustrated in FIG. 19 but understood to be present by analogy to FIGS. 1-18 can be substantially different in structure, shape, and/or configuration from those present in the portable bags 1, 101, 201, 301, 401, 501, 601, etc., however as may be desirable for particular scenarios or applications. Those structural features not illustrated in FIG. 19, but which may be either substantially the same or substantially different from those corresponding structures in FIGS. 1-18 may include, in a non-limiting manner, rear surfaces, bottom surfaces and any crease(s) contained therein/thereon, and the like.

Portable Bag 1301

Figure 20:
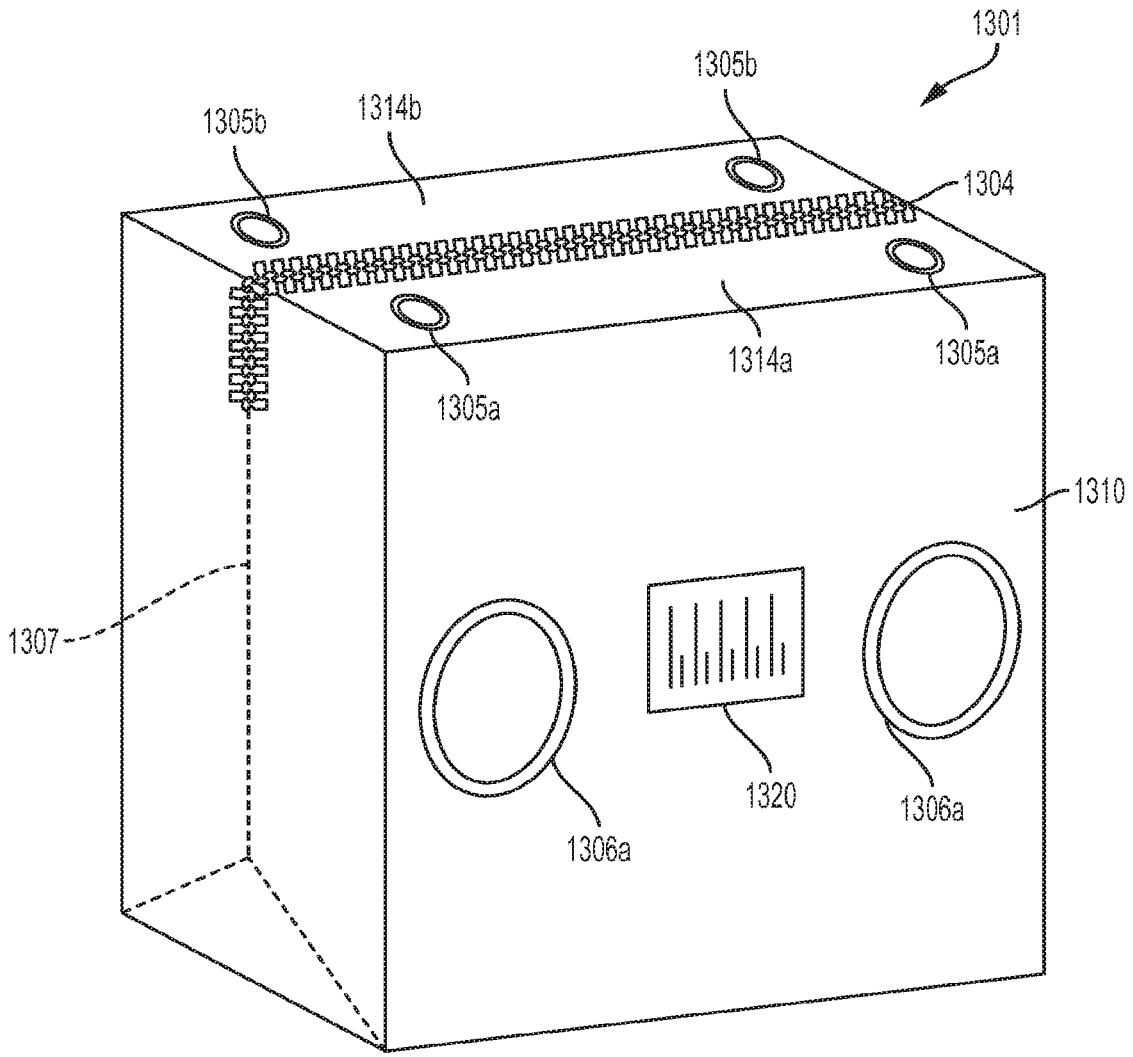
FIG. 20 is a perspective view of a portable bag 1301 having integrated handling openings according to a fourteenth exemplary embodiment of the present invention.

Turning now to FIG. 20, illustrated therein is another exemplary embodiment of a portable bag 1301. One non-limiting difference between this embodiment of the portable bag 1301, as compared to any of those previously described herein is a closure mechanism 1304 (as illustrated, a zipper; although other types of closure mechanisms may be substituted therefor) that extends not only across a top surface 1314 of the portable bag but that also extends at least partially onto at least one side surface of the portable bag. This feature may also be understood with reference to the portable bag 1201 embodiment, as described immediately above.

Another non-limiting difference is the provision in this embodiment of the portable bag 1301 of a plurality of eyelets 1305*a*, 1305*b* adjacent opposing edges of the top surfaces 1314*a*, 1314*b* of the portable bag. Such may be understood in contrast with the respective front and rear surface positioned eyelets of the embodiments of at least FIGS. 1-16, all as described previously herein. In the embodiment of portable bag 1301, however, the eyelets 1305*a*, 1305*b* are provided in the respective top surface portions 1314*a*, 1314*b* of the portable bag, such that when the bag is placed upon a wire rack (or a comparable dispensing component) that includes prongs or tusks thereon, the bag in this embodiment is in an open configuration upon the rack. In other words, when on the rack or dispenser, the top surface portions 1314*a*, 1314*b* are necessarily folded upward for engagement with the tucks or prongs of the wire rack or dispensing component.

Remaining with FIG. 20, it should be understood with reference thereto that although such illustrates only a perspective view of the portable bag 1301 and certain features thereof, the portable bag 1301 is configured according to various embodiments in substantially the same fashion as those illustrated in FIGS. 1-19, but for the incorporation of an extended closure mechanism 1304, and placement of eyelets 1305*a*, 1305*b* upon respective top surface portions 1314*a*, 1314*b* (as compared to on respective front and rear surfaces of the bag). It should be understood, of course, that in still other embodiments, any combination of these features (and/or still others as previously described elsewhere herein with respect to any of the embodiments of FIGS. 1-19) may be provided, meaning that the provision of any one is independent relative to the provision of the others.

Notwithstanding the above, it should be understood that, in the embodiment of FIG. 20, any remaining structural features of the portable bag 1301 including, but not limited to, the size and shape of the illustrated eyelets 1305*a*, 1305*b* themselves, the side crease lines 1307, the handling openings 1306*a*, and the shipping indicia 1320 (e.g., a barcode, a shipping label, or the like) may be substantially the same in structure, shape, and/or configuration to the corresponding features illustrated in any of at least FIGS. 1-19, all as described previously herein. Alternatively, any combination of these structural features and still others not illustrated in FIG. 20 but understood to be present by analogy to FIGS. 1-19 can be substantially different in structure, shape, and/or configuration from those present in the portable bags 1, 101, 201, 301, 401, 501, 601, etc., however as may be desirable for particular scenarios or applications. Those structural features not illustrated in FIG. 20, but which may be either substantially the same or substantially different from those corresponding structures in FIGS. 1-19 may include, in a non-limiting manner, rear surfaces, bottom surfaces and any crease(s) contained therein/thereon, and the like.

Portable Bag 1401

Figure 21:
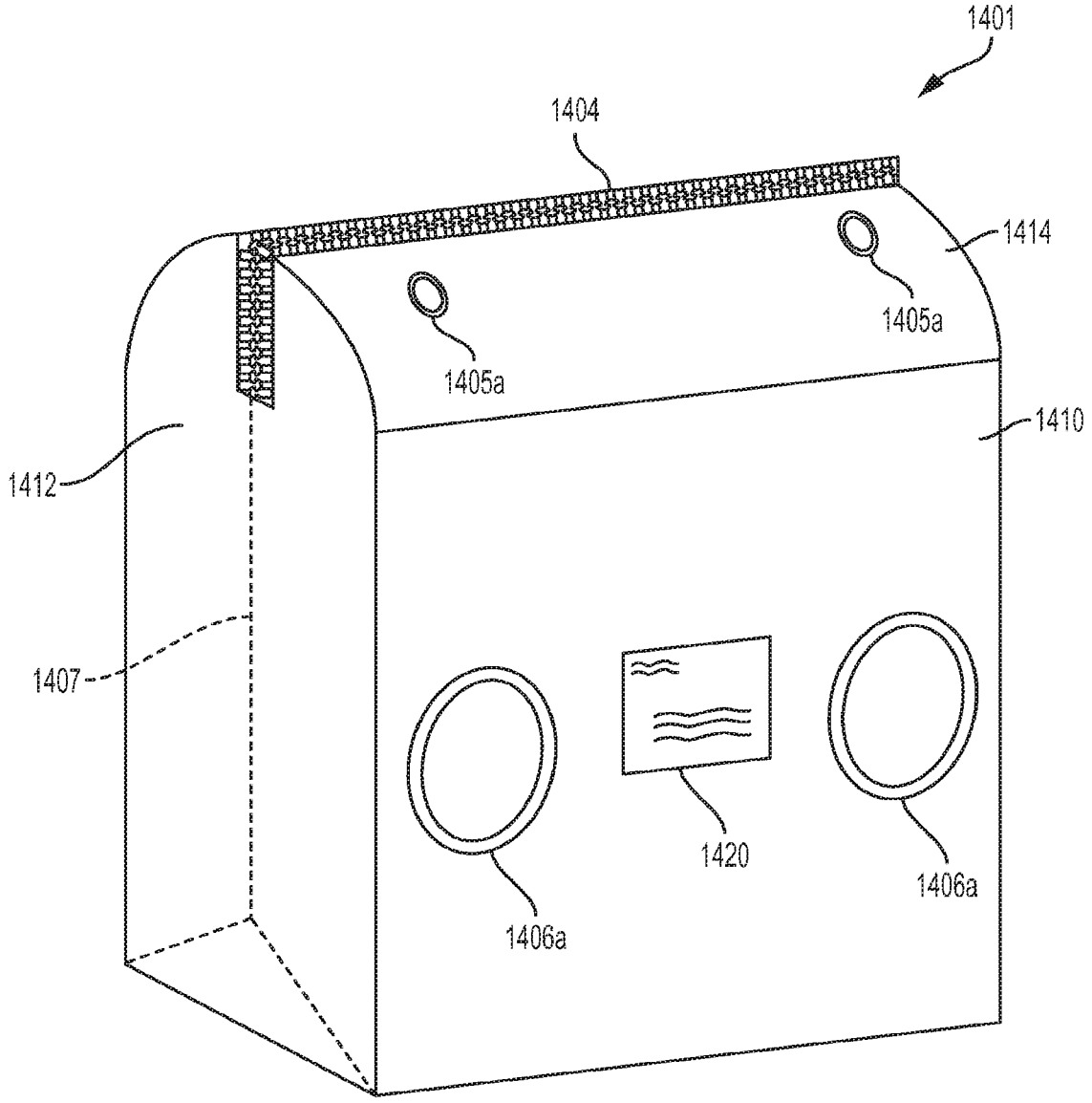
FIG. 21 is a perspective view of a portable bag 1401 having integrated handling openings according to a fifteenth exemplary embodiment of the present invention.

Turning now to FIG. 21, illustrated therein is another exemplary embodiment of a portable bag 1401. One non-limiting difference between this embodiment of the portable bag 1401, as compared to any of those previously described herein is a rounded top surface 1414 that instead of being substantially planar and parallel with a corresponding bottom surface (not illustrated) of the bag, extends upwardly and outwardly, thus still further increasing the volume capacity of the bag. In at least the illustrated embodiment of FIG. 21, a closure mechanism 1404 is also illustrated that extends not only along a length of the top surface 1414 but also extends onto at least one (and in certain embodiments both) of the respective side surfaces 1412 of the portable bag 1401. Although not illustrated, in other embodiments, a pocket or flap, as provided in the embodiment of FIG. 19 may also be provided on the portable bag 1401, so as to similarly protect and retain ends and/or edges of the closure mechanism (as illustrated, a zipper).

Remaining with FIG. 21, it should be understood with reference thereto that although such illustrates only a perspective view of the portable bag 1401 and certain features thereof, the portable bag 1401 is configured according to various embodiments in substantially the same fashion as those illustrated in FIGS. 1-20, but for the incorporation of an extended closure mechanism 1404, and provision of a rounded and/or otherwise upwardly extending top surface 1404. It should be understood, of course, that in still other embodiments, any combination of these features (and/or still others as previously described elsewhere herein with respect to any of the embodiments of FIGS. 1-20) may be provided, meaning that the provision of any one is independent relative to the provision of the others.

Notwithstanding the above, it should be understood that, in the embodiment of FIG. 21, any remaining structural features of the portable bag 1401 including, but not limited to, the size and shape of the illustrated eyelets 1405*a*, 1405*b* themselves, the side crease lines 1407, the handling openings 1406*a*, and the shipping indicia 1420 (e.g., a shipping label (as illustrated), a barcode, or the like) may be substantially the same in structure, shape, and/or configuration to the corresponding features illustrated in any of at least FIGS. 1-20, all as described previously herein. Alternatively, any combination of these structural features and still others not illustrated in FIG. 21 but understood to be present by analogy to FIGS. 1-20 can be substantially different in structure, shape, and/or configuration from those present in the portable bags 1, 101, 201, 301, 401, 501, 601, etc., however as may be desirable for particular scenarios or applications. Those structural features not illustrated in FIG. 21, but which may be either substantially the same or substantially different from those corresponding structures in FIGS. 1-20 may include, in a non-limiting manner, rear surfaces, bottom surfaces and any crease(s) contained therein/thereon, and the like.

Portable Bag 1500

Figure 22:
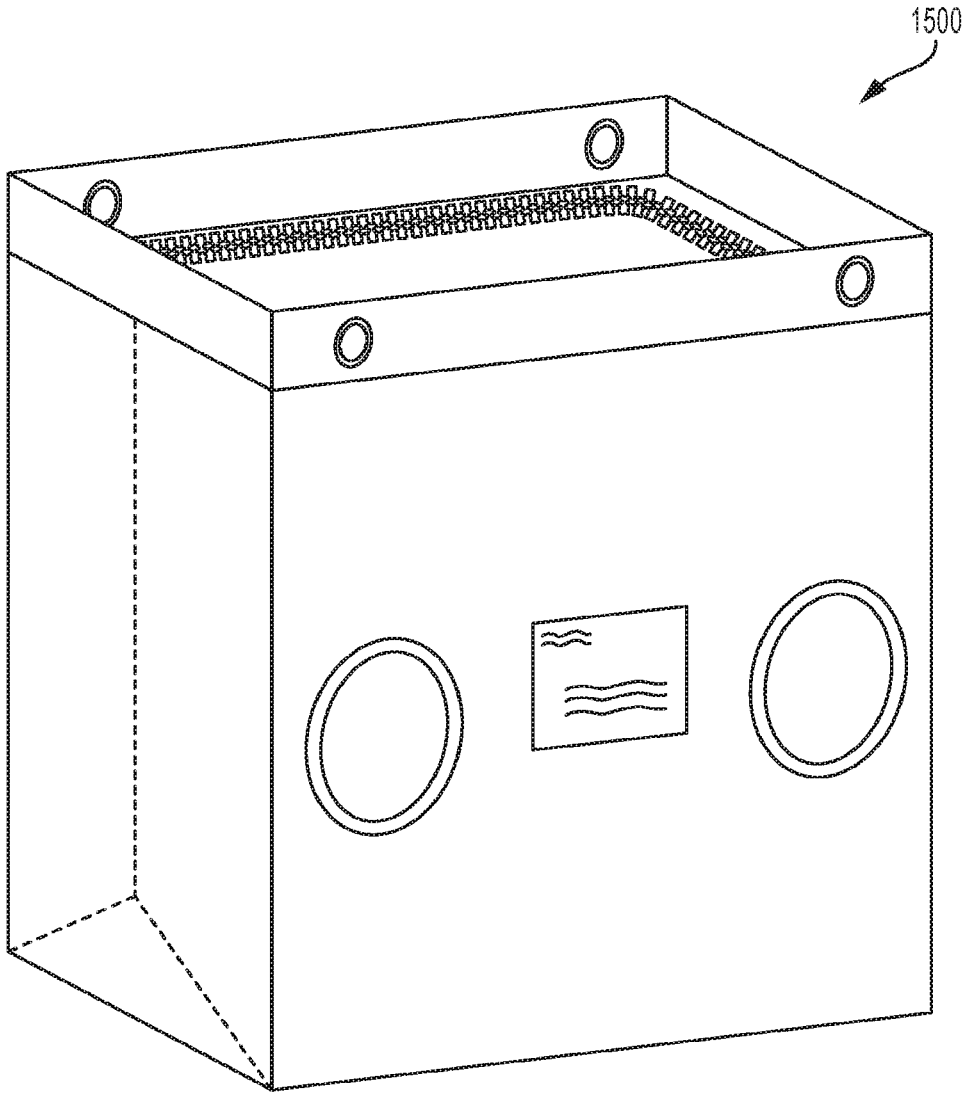
FIG. 22 is a perspective view of a portable bag 1500 having integrated handling openings according to a sixteenth exemplary embodiment of the present invention.

Turning now to FIG. 22, illustrated therein is another exemplary embodiment of a portable bag 1500. One non-limiting difference between this embodiment of the portable bag 1500, as compared to any of those previously described herein is the provision of respective side hem extensions or flaps extending between corresponding eyelet hem extensions, which may be understood by analogy with reference to FIG. 19 and the embodiment of portable bag 1201, as described previously herein. In the embodiment of FIG. 22, the side hem extensions or flaps provide increased stability as compared to the configuration of FIG. 19. In certain embodiments, such as that illustrated, the side hem extensions or flaps may extend substantially along a length of each of the respective side surfaces of the portable bag, such that the side hem extensions and the eyelet hem extensions are further hemmed relative to one another so as to provide a continuous extension surface atop the top surface of the portable bag. In other embodiments, the side hem extensions and the eyelet hem extensions may be provided internal to the top surface edges, such that they are accessible only upon opening of the top surface, as also described previously herein with reference to FIG. 19. In any of these and still other embodiments, the side hem extensions and the eyelet hem extensions provide straight line edge surfaces thereof.

It may also be understood with reference to FIG. 22 that the embodiment therein of portable bag 1500 provides a combination of the embodiments of FIGS. 18 and 19, namely in that in conjunction with the eyelet hem extensions (and still further the side hem extensions extending therebetween), the embodiment of portable bag 1500 in certain embodiments further includes a substantially U-shaped closure mechanism, as in portable bag 1101. Of course, any of a variety of closure mechanisms may be utilized in conjunction with portable bag 1500, as may be desirable.

Remaining with FIG. 22, it should be understood with reference thereto that although such illustrates only a perspective view of the portable bag 1500 and certain features thereof, the portable bag 1500 is configured according to various embodiments in substantially the same fashion as those illustrated in FIGS. 1-21, but for the incorporation of respective side surface hem extensions, and the provision of a U-shaped closure mechanism in combination therewith. It should be understood, of course, that in still other embodiments, any combination of these features (and/or still others as previously described elsewhere herein with respect to any of the embodiments of FIGS. 1-21) may be provided, meaning that the provision of any one is independent relative to the provision of the others.

Notwithstanding the above, it should be understood that, in the embodiment of FIG. 22, any remaining structural features of the portable bag 1500 including, but not limited to, the size and shape of the illustrated eyelets themselves, the side crease lines, the handling openings, and the shipping indicia (e.g., a barcode (as illustrated), a shipping label (as illustrated), or the like) may be substantially the same in structure, shape, and/or configuration to the corresponding features illustrated in any of at least FIGS. 1-21, all as described previously herein. Alternatively, any combination of these structural features and still others not illustrated in FIG. 22 but understood to be present by analogy to FIGS. 1-21 can be substantially different in structure, shape, and/or configuration from those present in the portable bags 1, 101, 201, 301, 401, 501, 601, etc., however as may be desirable for particular scenarios or applications. Those structural features not illustrated in FIG. 22, but which may be either substantially the same or substantially different from those corresponding structures in FIGS. 1-21 may include, in a non-limiting manner, rear surfaces, bottom surfaces and any crease(s) contained therein/thereon, and the like.

Portable Bag 1600

Figure 23:
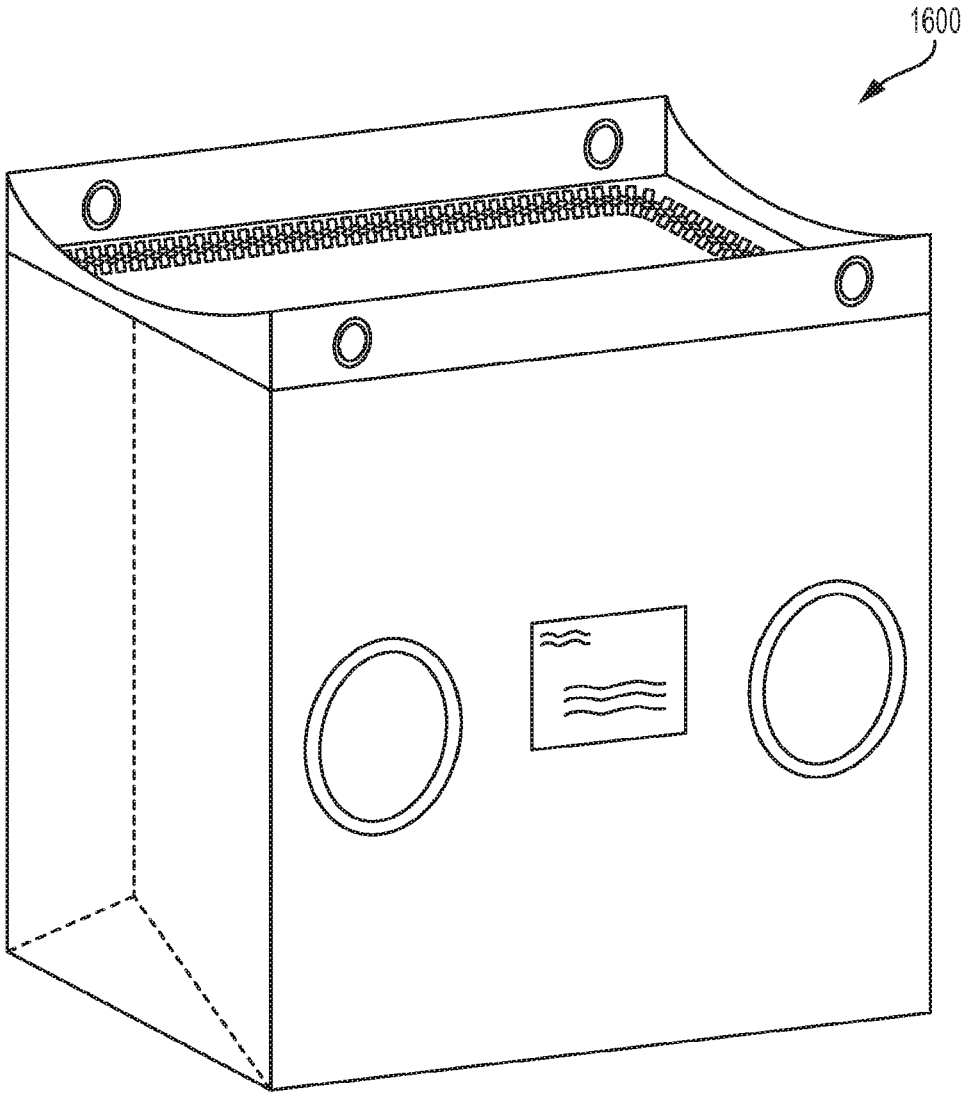
FIG. 23 is a perspective view of a portable bag 1600 having integrated handling openings according to a seventeenth exemplary embodiment of the present invention.

Turning now to FIG. 23, illustrated therein is another exemplary embodiment of a portable bag 1600. One non-limiting difference between this embodiment of the portable bag 1600, as compared to any of those previously described herein is the provision of respective side hem extensions or flaps extending between corresponding eyelet hem extensions, which may be understood by analogy with reference to FIG. 22, as described immediately above. In contrast with the embodiment of FIG. 22, the portable bag 1600 includes side hem extensions that are scalloped between the eyelet hem extensions. In this manner, the side hem extensions provide a combination of flexibility and stability for the portable bag. In addition, with the reduced profile of the side hem extensions, the likelihood of such becoming entangled in or on external processing components is reduced. In certain embodiments, such as that illustrated, the side hem extensions or flaps may extend substantially along a length of each of the respective side surfaces of the portable bag, such that the side hem extensions and the eyelet hem extensions are further hemmed relative to one another so as to provide a continuous extension surface atop the top surface of the portable bag. In other embodiments, the side hem extensions and the eyelet hem extensions may be provided internal to the top surface edges, such that they are accessible only upon opening of the top surface, as also described previously herein with reference to FIG. 19.

It may also be understood with reference to FIG. 23 that the embodiment therein of portable bag 1600 provides a combination of the embodiments of FIGS. 18 and 19, namely in that in conjunction with the eyelet hem extensions (and still further the side hem extensions extending therebetween), the embodiment of portable bag 1600 in certain embodiments further includes a substantially U-shaped closure mechanism, as in portable bag 1101. Of course, any of a variety of closure mechanisms may be utilized in conjunction with portable bag 1600, as may be desirable.

Remaining with FIG. 23, it should be understood with reference thereto that although such illustrates only a perspective view of the portable bag 1600 and certain features thereof, the portable bag 1600 is configured according to various embodiments in substantially the same fashion as those illustrated in FIGS. 1-22, but for the incorporation of respective side surface hem extensions, and the provision of a U-shaped closure mechanism in combination therewith. It should be understood, of course, that in still other embodiments, any combination of these features (and/or still others as previously described elsewhere herein with respect to any of the embodiments of FIGS. 1-22) may be provided, meaning that the provision of any one is independent relative to the provision of the others.

Notwithstanding the above, it should be understood that, in the embodiment of FIG. 23, any remaining structural features of the portable bag 1500 including, but not limited to, the size and shape of the illustrated eyelets themselves, the side crease lines, the handling openings, and the shipping indicia (e.g., a barcode (as illustrated), a shipping label (as illustrated), or the like) may be substantially the same in structure, shape, and/or configuration to the corresponding features illustrated in any of at least FIGS. 1-22, all as described previously herein. Alternatively, any combination of these structural features and still others not illustrated in FIG. 23 but understood to be present by analogy to FIGS. 1-22 can be substantially different in structure, shape, and/or configuration from those present in the portable bags 1, 101, 201, 301, 401, 501, 601, etc., however as may be desirable for particular scenarios or applications. Those structural features not illustrated in FIG. 23, but which may be either substantially the same or substantially different from those corresponding structures in FIGS. 1-22 may include, in a non-limiting manner, rear surfaces, bottom surfaces and any crease(s) contained therein/thereon, and the like.

Portable Bag 1700

Figure 24:
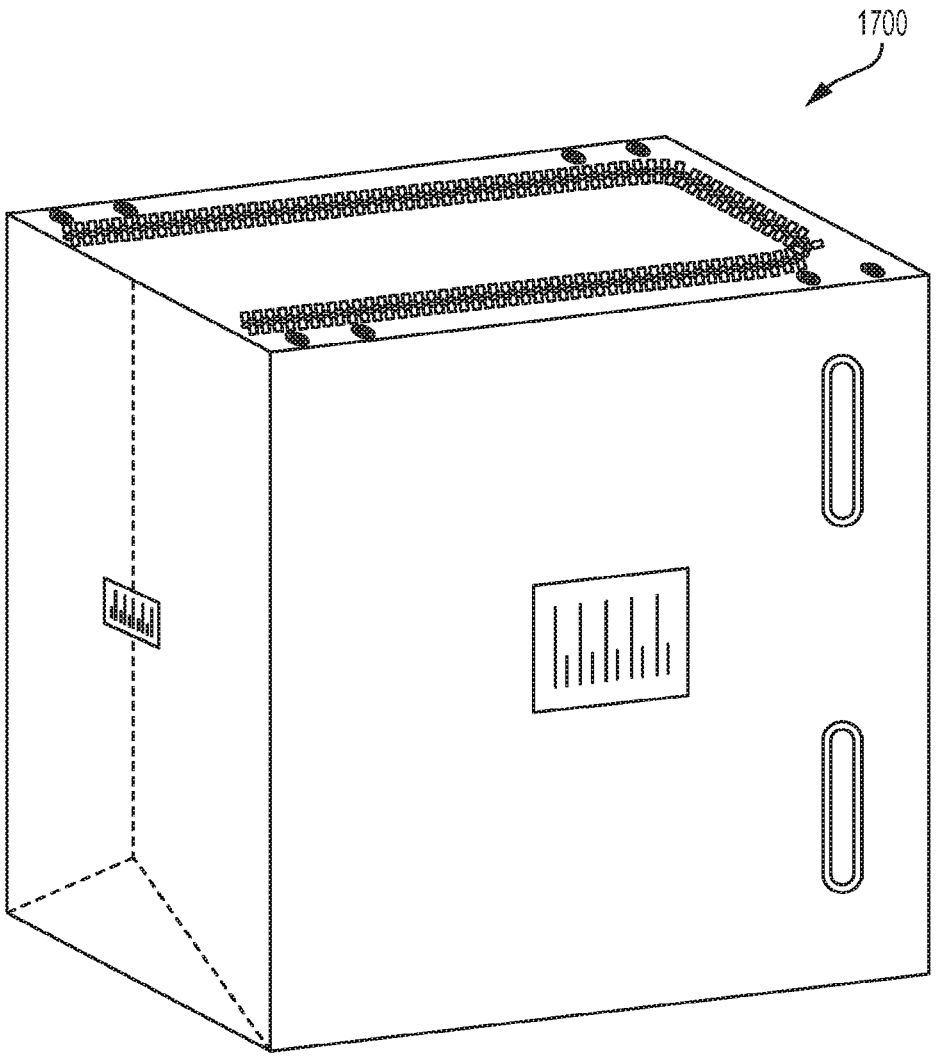
FIG. 24 is a perspective view of a portable bag 1700 having integrated handling openings according to an eighteenth exemplary embodiment of the present invention.

Turning now to FIG. 24, illustrated therein is another exemplary embodiment of a portable bag 1700. One non-limiting difference between this embodiment of the portable bag 1700, as compared to any of those previously described herein is the provision of an inset U-shaped closure mechanism (e.g., a zipper) in conjunction with eyelets provided on a top surface of the portable bag. This embodiment was previously referenced herein, but illustrated and described here for purposes of a comprehensive disclosure. As may be seen with reference to FIG. 24, the U-shaped closure mechanism is inset relative to each of the respective three edges of the top surface, so as to provide sufficient surface space for the associated eyelets adjacent at least two of the edges of the top surface.

Still further, as may be understood from FIG. 24, in certain embodiments, such as herewith portable bag 1700, respective sets of two (for a total of eight) eyelets may be provided, as compared to the set of four in the various embodiments described previously herein. Of course, any of a variety of combinations and configurations of eyelets may be provided, so long as such is particularly and specifically configured so as to facilitate engagement of the portable bag with tusks or prongs of an associated wire rack or dispensing component. Additional details of such a rack or external processing components or the like and/or any prongs or tusks associated therewith may be understood with reference to FIGS. 25-26, as described elsewhere herein, but also applicable for use with the portable bags 1700 of the present embodiment.

FIG. 24 also illustrates additional configurations for the eyelets and handling openings, as compared to those that are substantially oval or circular in the embodiments of FIGS. 1-23. Although various shapes and even sizes of the eyelets and handling openings have been described elsewhere herein, as illustrated in FIG. 24, the eyelets may be significantly smaller relative to the handling openings. Still further, the handling openings may be at least partially elongated in shape, so as to define an oblong opening that conforms to the shape of a user's fingers and/or palm, as may extend there-through during use or handling of the portable bag.

Also illustrated in FIG. 24 is an additional type of shipping indicia, which may include a pocket for placement of a shipping label and/or a shipping manifest within. In other embodiments, a reusable surface may be provided, for placement upon of a shipping label or other shipping indicia, as such are commonly known and understood in the art, and as have been described elsewhere herein. FIG. 24 also illustrates an additional and optional barcode, as may be unique and reusable, such that the barcode may be associated with the specific bag upon which it is placed, providing a consolidated tracking identifier for any small packages shipped or otherwise transported therein. The barcode may be further linked to the printed shipping label, so as to provide improved read rates through the automation process. Still further, the barcodes and/or shipping indicia may be placed on two or more (i.e., multiple) sides of the bag so as to still further improve read rates during automated processing, handling, and/or transport of the bags from one destination to another.

Remaining with FIG. 24, it should be understood with reference thereto that although such illustrates only a perspective view of the portable bag 1700 and certain features thereof, the portable bag 1700 is configured according to various embodiments in substantially the same fashion as those illustrated in FIGS. 1-23, but for the incorporation of the features described immediately above. It should be understood, of course, that in still other embodiments, any combination of these features (and/or still others as previously described elsewhere herein with respect to any of the embodiments of FIGS. 1-23) may be provided, meaning that the provision of any one is independent relative to the provision of the others.

Notwithstanding the above, it should be understood that, in the embodiment of FIG. 24, any remaining structural features of the portable bag 1600 including, but not limited to, the size and shape of the illustrated eyelets themselves, the side crease lines, the handling openings, and the shipping indicia (e.g., a barcode (as illustrated), a shipping label (also as illustrated), or the like) may be substantially the same in structure, shape, and/or configuration to the corresponding features illustrated in any of at least FIGS. 1-23, all as described previously herein. Alternatively, any combination of these structural features and still others not illustrated in FIG. 24 but understood to be present by analogy to FIGS. 1-23 can be substantially different in structure, shape, and/or configuration from those present in the portable bags 1, 101, 201, 301, 401, 501, 601, etc., however as may be desirable for particular scenarios or applications. Those structural features not illustrated in FIG. 24, but which may be either substantially the same or substantially different from those corresponding structures in FIGS. 1-23 may include, in a non-limiting manner, rear surfaces, bottom surfaces and any crease(s) contained therein/thereon, and the like.

Exemplary Materials and Additional Features

In various embodiments, the portable bags (e.g. bags 1, 101, 201, 301, 401, 501, 601, 701, 801, 901, 1001, or the like, as described elsewhere herein) may be constructed of a fabric or otherwise woven material. The fabric material may include, but is not limited to, polyester, rayon, burlap, canvas, or any combination of the same. In other embodiments, the portable bags may be constructed of one or more of a variety of non-fabric materials, such as flexible materials including but not limited to, a wire mesh material, an interlaced mesh material, a steel wire and/or steel mesh material, a Kevlar® incorporating material, and the like. It should be understood generally that the material of the portable bags may be any of a variety of materials, as known and understood in the art, provided such are sufficiently strong, resilient, and durable to withstand long-term and repetitious handling of multiple small packages within the portable bags, ranging in weight up to approximately 150 pounds.

As previously described elsewhere herein, according to certain embodiments, a grommet may be included as part of the eyelets (see e.g., eyelets 5*a*) and/or the handling openings (see e.g., openings 6*a*). The grommet may be incorporated according to these embodiments with respect to any of the various portable bag embodiments described previously herein (see e.g., bags 1, 101, 201, 301, 401, 501, 601, 701, 801, 901, and/or 1001). The grommet may define the eyelet and/or handling openings and may be made of, as non-limiting examples, plastic, ceramic, or metal. The grommet may in some embodiments include a first side portion and a second side portion; in other embodiments the grommet may be only one sided. Where two sided, still further, the first and second side portions may be different colors and/or different materials. The grommet may be selectively removable from and selectively attachable to the portable bag, as may be desirable. In such embodiments and still further those where no grommet may be provided, the edges of the eyelets and/or handling openings may be hemmed in a fashion similar to the hemming of the respective surface edges of the portable bags. In these and still other embodiments, the grommet, where such is incorporated within the eyelets and/or handling openings may be shaped substantially the same as such, whether that shape be substantially square, rectangular, triangular, circular, elliptical, or any other shape as known or understood in the arts, such that the eyelets and/or handling openings remain functional for the purposes described elsewhere herein.

In this regard, it may be understood from reference to any of FIGS. 1-17 that the intersections of any respective surfaces (see e.g., surfaces 310, 312, 314*a*—as illustrated particularly in FIG. 13) may be hemmed or otherwise stitched relative to one another. In this manner, according to various embodiments, the respective surfaces are secured in a fixed, but flexible manner relative to one another. In certain embodiments, the hem or stitching may be provided in a sewn fashion, as commonly known and understood in the art. In other embodiments, a specialty hem or stitching may be used, so as to provide further strength characteristics to the portable bag. In still other embodiments, the hem or stitching may be an inherent characteristic of the material of the portable bag, for example when such is constructed of a mesh-like material that includes one or more layers of interwoven or interlaced fibers or components, as also described previously herein.

According to various embodiments, stiffeners (e.g., rigid inserts) may be strategically placed along various surfaces, edges, or extensions of the various portable bags described herein with reference to FIGS. 1-24. As non-limiting examples, the stiffeners may be placed along the sides, along the edges of the top, bottom, at corners, on the front and rear surfaces adjacent the eyelets and/or handling openings, and the like, however as may be desirable and/or beneficial for assisting the bag with retaining its shape when in use.

According to various embodiments, a hemmed extension or section may be further provided so as to overlay the various closure mechanisms described herein. In the case of a zipper-based closure mechanism, the hemmed extension may be configured so as to overlay and protect the zipper in a fashion similar to that of the flap that covers a zipper located on a pair of pants or jeans. In this manner, the likelihood of the closure mechanism or zipper becoming entangled or otherwise caught in external processing components is reduced.

Conclusion

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A portable bag comprising:

a plurality of surfaces configured to define an interior compartment for holding articles, the plurality of surfaces comprising at least a front surface and a rear surface connected relative to each other by a pair of planar side surfaces, at least one hemmed edge defined between the front surface, the pair of side surfaces and the rear surface, and further comprising at least a top surface, the top surface further comprising a first top portion, a second top portion, and a closure mechanism, the closure mechanism being operable to selectively open and close at least a portion of the top surface and positioned intermediate to the first and second top portions, wherein the closure mechanism is further operable to selectively separate the first and second top portions relative to one another, so as to define an opening there between, the opening being configured for receipt of said articles to be held in the portable bag;

at least two handling extensions each comprising two-sides, a respective each of the at least two handling extensions being positioned adjacent to and extending outwardly relative to a respective one of the pair of planar side surfaces as extensions of the at least one hemmed edge of the portable bag, each of the at least two handling extensions bisecting a respective area defined by each of the pair of planar side surfaces;

at least two handling openings, the at least two handling openings being integrally defined on at least one of the at least two handling extensions and positioned substantially adjacent opposing sides of the at least one of the plurality of surfaces; and at least one side crease bisecting each of the pair of planar side surfaces, each of the at least two handling extensions being positioned and extending along a length of the at least one side crease on each of the pair of planar side surfaces of the portable bag.

2. The portable bag of claim 1, wherein:

the at least two handling openings consist of two handling openings; and a single one of the two handling openings is located on each of the at least two handling extensions, wherein each of the single handling openings is aligned with a horizontal midpoint line of a corresponding one of the at least two handling extensions.

3. The portable bag of claim 1, wherein:

the at least two handling openings comprise four handling openings; and a pair of handling openings is located on each of the at least two handling extensions.

4. The portable bag of claim 3, wherein each of the pair of handling openings is offset a distance relative to a horizontal midpoint line of a corresponding one of at least two handling extensions, each of the handling openings within each of the pair of handling openings being positioned opposite the horizontal midpoint line relative to the other handling opening within the pair.

5. The portable bag of claim 1, wherein:

the plurality of surfaces are constructed of a foldable material; and each of the at least two handling extensions is hemmed along the length of the at least one side crease on each of the side surfaces of the portable bag.

6. The portable bag of claim 5, wherein the at least two handling extensions extend at least in part beyond the length of the at least one side crease on each of the side surfaces of the portable bag.

7. The portable bag of claim 5, wherein:

the plurality of surfaces further comprise a bottom surface and a top surface opposite the bottom surface; and each of the at least two handling extensions is elongate and extends an entirety of a height of the portable bag, extending substantially between an edge of the side surfaces adjacent the top surface and an edge of the side surfaces adjacent the bottom surface.

8. The portable bag of claim 5, wherein:

the at least two handling openings comprise two handling openings; and a single one of the two handling openings is located on each of the at least two handling extensions, wherein each of the single handling openings is aligned with a horizontal midpoint line of a corresponding one of the at least two handling extensions.

9. The portable bag of claim 5, wherein:

the at least two handling openings consist of four handling openings; and a pair of handling openings is located on each of the at least two handling extensions.

10. The portable bag of claim 9, wherein each of the pair of handling openings is offset a distance relative to a horizontal midpoint line of a corresponding one of the two handling extensions, each of the handling openings within each of the pair of handling openings being positioned opposite the horizontal midpoint line relative to the other handling opening within the pair.

11. The portable bag of claim 1, wherein the bag further comprises an interior liner further defining the interior compartment of the portable bag, the interior liner being positioned intermediate the interior compartment and the plurality of surfaces.

12. The portable bag of claim 1, wherein:

the plurality of surfaces further comprise a bottom surface and a top surface opposite the bottom surface;

the top surface further comprises a closure mechanism, the closure mechanism being operable to selectively open and close at least a portion of the top surface; and the closure mechanism is at least one of a zipper, a magnetic strip assembly, a spring-loaded assembly, or a draw-string assembly.

13. The portable bag of claim 12, wherein:

the top surface comprises a first top portion and a second top portion; and the closure mechanism is positioned intermediate the first and second top portions, the closure mechanism being further operable to selectively separate the first and second top portions relative to one another, so as to define an opening therebetween, the opening being configured for receipt of the articles to be held in the portable bag.

14. The portable bag of claim 13, wherein:

the plurality of surfaces are constructed of a foldable material; and the closure mechanism is configured such that the first and second top portions are biased toward each other such that the portable bag is, in its natural orientation, in a closed configuration.

15. The portable bag of claim 1, wherein:

the plurality of surfaces further comprise a bottom surface;

the plurality of surfaces are constructed of a foldable material;

the portable bag further comprises a plurality of side creases and a single bottom crease;

the plurality of side creases comprise at least three side creases defined on each of the pair of side surfaces, the at least three side creases each being oriented differently relative to one another; and the single bottom crease is defined on the bottom surface of the portable bag.

16. The portable bag of claim 1, wherein:

the plurality of surfaces further comprise a bottom surface and a top surface opposite the bottom surface;

the plurality of surfaces are constructed of a foldable material;

the portable bag further comprises a plurality of side creases and a single front crease;

the plurality of side creases comprise at least three side creases defined on each of the pair of side surfaces, the at least three side creases each being oriented differently relative to one another; and the single front crease is defined on a lower portion of the front surface of the portable bag, the lower portion being nearer the bottom surface of the portable bag than the top surface.

17. The portable bag of claim 1, wherein:

the plurality of surfaces further comprise a bottom surface and a top surface opposite the bottom surface;

the portable bag further comprises at least one set of eyelets configured to accept therethrough at least a portion of an assembly configured to hold or support a plurality of the portable bags; and the at least one set of eyelets is positioned nearer the top surface than the bottom surface of the portable bag, so as to enable a hanging configuration of the portable bag relative to the assembly.

18. The portable bag of claim 1, wherein the at least two handling extensions are each positioned substantially perpendicular to the respective one of the pair of side surfaces.

19. The portable bag of claim 1, wherein:

the at least two handling openings comprise eight handling openings; and at least two pair of handling openings are located on each of the at least two handling extensions.

20. A portable bag comprising:

a plurality of surfaces configured to define an interior compartment for holding articles, the plurality of surfaces comprising at least a front surface and a rear surface connected relative to each other by a pair of planar side surfaces;

at least two handling extensions, a respective each of the at least two handling extensions being positioned adjacent to and extending outwardly relative to a respective one of the pair of planar side surfaces, each of the at least two handling extensions bisecting a respective area defined by each of the pair of planar side surfaces; and at least two handling openings, the at least two handling openings being integrally defined on at least one of the at least two handling extensions, wherein the portable bag further comprises a closure mechanism associated with a top surface of the portable bag, the closure mechanism being configured to selectively open and close at least a portion of the top surface so as to selective create an opening therein for receipt of the articles for holding in the portable bag, the closure mechanism being operatively biased such that the top surface of the portable bag is naturally in a closed configuration.

* * * * *